US005604577A

United States Patent [19]

Wakuda et al.

[11] Patent Number: 5,604,577

[45] Date of Patent: Feb. 18, 1997

[54] DOUBLE-SIDE IMAGE FORMING APPARATUS AND REVERSE SHEET FEEDING DEVICE

[75] Inventors: Osamu Wakuda, Yamatotakada; Toshihiro Okahashi, Kashihara; Osamu Hashimoto, Ikoma, all of Japan

[73] Assignee: Sharp Kabushiki Kaisha, Osaka, Japan

[21] Appl. No.: 417,885

[22] Filed: Apr. 6, 1995

[30] Foreign Application Priority Data

Apr. 27, 1994 [JP] Japan ..... 6-090257

[51] Int. Cl.[6] ..... G03G 21/00

[52] U.S. Cl. ..... 399/364; 271/3.03

[58] Field of Search ..... 355/24, 319; 271/3.02, 271/3.03, 3.01, 3.14, 3.19, 902

[56] References Cited

U.S. PATENT DOCUMENTS

| | | | |
|---|---|---|---|
| 4,487,506 | 12/1984 | Repp et al. | 355/24 X |
| 4,579,446 | 4/1986 | Fujino et al. | 355/24 |
| 4,639,125 | 1/1987 | Okuda et al. | 355/23 |
| 4,772,917 | 9/1988 | Tani | 355/24 X |
| 4,903,043 | 2/1990 | Tajima | 355/24 X |
| 4,949,134 | 8/1990 | Iwaki et al. | 355/319 X |
| 4,986,529 | 1/1991 | Agarwal et al. | 271/902 X |
| 4,990,965 | 2/1991 | Kiya | 355/319 |
| 5,196,897 | 3/1993 | Trask | 355/319 |
| 5,327,206 | 7/1994 | Ueda et al. | 355/319 |

FOREIGN PATENT DOCUMENTS

| | | |
|---|---|---|
| 3546069 | 7/1986 | Germany . |
| 57-141655 | 9/1982 | Japan . |
| 60-247655 | 12/1985 | Japan . |
| 61-230165 | 10/1986 | Japan . |
| 3-42543 | 6/1991 | Japan . |
| 4-31871 | 5/1992 | Japan . |
| 4-37425 | 6/1992 | Japan . |

*Primary Examiner*—Robert Beatty

[57] ABSTRACT

A double-side image forming apparatus forms an image on one side of a sheet in a laser printer section, reverses the leading edge and the trailing edge of the sheet with respect to the transporting direction in a turnaround section, turns over the sheet by moving the sheet through an upper or lower reversing transport path, and transports the sheet to the laser printer section again. A sheet guiding device guides the sheet output from the turnaround section to one of the upper and lower reversing transport paths. When the sheet is again transported to the laser printer section, an image is formed on the other side of the sheets. This configuration simplifies the structure of the apparatus and reduces the size thereof compared to a configuration in which only one reversing transport path capable of holding the same number of sheets therein is formed.

26 Claims, 34 Drawing Sheets

DOUBLE-SIDE IMAGE FORMING APPARATUS AND REVERSE SHEET FEEDING DEVICE

FIELD OF THE INVENTION

The present invention relates to double-side image forming apparatuses such as copying machines and laser printers capable of producing double-side copies.

BACKGROUND OF THE INVENTION

As disclosed in Japanese Publication for Examined Patent Application (Tokukohei) No. 3-42543, 4-31871 and 4-37425, double-side image forming apparatuses such as copying machines and laser printers capable of producing image on both sides of a sheet based on image data stored in a memory device are conventionally known. In a double-side image forming apparatus of this type, first, an image is formed on one of the sides of a sheet by an image forming section based on image data which is to be printed, for example, on the back side and read out from the memory section. Second, the sheet passes through a reversing transport path, and is supplied again in a reversed state to the image forming section. Then, an image is formed on the other side of the sheet based on image data to be printed on the front side.

In order to repeatedly operate the image forming section in the double-side image forming apparatus, images are first formed on one of the sides of the respective sheets successively, and the sheets carrying the images on one side thereof are temporarily held in the reversing transport path. Then, the sheets carrying the images on one side thereof are fed one by one from the reversing transport path so as to form images on the other side of the sheets. This structure increases the processing speed when performing image forming operations successively. In order to carry out the image forming operations at high speeds through these steps, there is a need to arrange a long reversing transport path.

However, in the conventional double-side image forming apparatus, if a long reversing transport path is arranged by simply increasing the length thereof, it is necessary to curve the reversing transport path. With this arrangement, the transport path includes many curved sections. As a result, the structure of the double-side image forming apparatus is complicated and the size thereof is increased.

Japanese Publication for Examined Patent Application (Tokukohei) No. 3-42543 discloses two reversing transport paths. In this structure, each of the reversing transport path has a turnaround section for reversing the leading edge and trailing edge of a sheet with respect to a transporting direction. Thus, the apparatus of JP 3-42543 has a complicated structure. In addition, in a conventional structure in which sheets carrying images on one side thereof are temporarily stored in an intermediate tray and then fed one by one from the intermediate tray so as to form images on the other side of the sheets, the following two problems arise. One problem is a complicated structure and a large size of the apparatus that are caused by a pickup roller provided for feeding the sheets from the intermediate tray. The other problem is a lowering of the processing speed that is caused by feeding sheets one by one from the intermediate tray for forming images on the other side of the sheets.

SUMMARY OF THE INVENTION

In order to solve the above problems, it is an object of the present invention to simplify the sheet reversing structure and reduce the size of a double-side image forming apparatus for forming images on both sides of a sheet.

In order to achieve the above object, a double-side image forming apparatus of the present invention includes:

an image forming section for forming an image on a sheet;

a turnaround section for reversing a leading edge and a trailing edge of a sheet with respect to a transporting direction after the sheet passes through the image forming section;

a plurality of reversing transport paths, disposed in parallel between the turnaround section and the image forming section, for transporting the sheet output from the turnaround section to the image forming section while turning over the sheet;

sheet guiding means for guiding the sheet output from the turnaround section to the reversing transport paths; and controlling means for controlling the image forming section, the turnaround section, the reversing transport paths, and the sheet guiding means so that an image is formed on one side of each of sheets by the image forming section and that the sheets are sequentially stored in the reversing transport paths and then supplied from the reversing transport paths to the image forming section for forming an image on the other side of each of the sheets.

With this structure, when performing double-side image forming operations on a plurality of sheets, first, the image forming section successively forms images on one side of each of the sheets. Next, the sheets are sequentially fed to the reversing transport paths while being guided by the sheet guiding means, and turned over and held in the reversing transport paths. Then, the sheets are again transported in sequence to the image forming section where images are successively formed on the other side of the sheets.

As described above, since a plurality of reversing transport paths are formed in parallel, the length of each of the reversing transport paths is shortened compared to a configuration in which only one reversing transport path capable of holding the same number of sheets therein is formed. Moreover, this structure eliminates the necessity of curving the reversing transport paths. Consequently, the size of the apparatus is reduced, and the structure thereof is simplified.

In addition, the plurality of reversing transport paths may be formed as one upper reversing transport path above the turnaround section and one lower reversing transport path below the turnaround section. With this structure, since the upper and lower reversing transport paths are dispersed above and below the turnaround section, it is possible to prevent a concentration of accessory mechanisms such as transport rollers in one location. As a result, the space is effectively used, facilitating the simplification of the structure.

Moreover, if the upper and lower reversing transport paths are formed symmetrically, common members are used for the manufacture of the upper and lower reversing transport paths, resulting in a reduction in the cost.

Furthermore, in the double-side image forming apparatus, the turnaround section may include:

sheet input and output means having a reversible roller driven in forward and backward directions, and a separable roller capable of being pressed against and separated from the reversible roller, for inputting a sheet to a sheet feed position and outputting the sheet from the sheet feed position by the reversible roller and the separable roller pressed against the reversible roller; and adjusting means for adjusting the sheet in the sheet feed position to a position corresponding to a size of the sheet, and the double-side image forming apparatus may further include turnaround-section controlling means for controlling the adjusting means and the sheet input and output means so that, when a sheet is input to the sheet feed position by the sheet input and output means, the reversible roller is stopped rotating in a state in which the trailing edge of the sheet is nipped between the reversible roller and the separable roller, the separable roller is separated from-the reversible roller, the adjusting means performs an adjusting operation, and then the separable roller is pressed against the reversible roller.

With this structure, when the sheet is input to the sheet feed position by the sheet input and output means, the reversible roller is stopped in a state in which the trailing edge of the sheet is nipped between the reversible roller and the separable roller. After the separable roller is separated from the reversible roller, the adjusting operation is performed by the adjusting means. Then, the separable roller is pressed against the reversible roller. This structure eliminates the necessity of a pickup roller which is installed for outputting the sheet from the sheet feed position in a conventional apparatus, resulting in a simplified structure. Namely, the sheet is input to and output from the sheet feed position by the reversible roller and the separable roller. The adjusting operation of the adjusting means prevents defective feeding and displacement of sheets.

Additionally, in the double-side image forming apparatus, the turnaround section may include:

sheet input and output means having a reversible roller driven in forward and backward directions, and a separable roller capable of being pressed against and separated from the reversible roller, for inputting a sheet to a sheet feed position and outputting the sheet from the sheet feed position by the reversible roller and the separable roller pressed against the reversible roller; and adjusting means for adjusting the sheet in the sheet feed position to a position corresponding to a size of the sheet, and the double-side image forming apparatus may further include turnaround-section controlling means for controlling the adjusting means and the sheet input and output means so that, when a sheet is input to the sheet feed position by the sheet input and output means, the reversible roller is stopped rotating in a state in which the trailing edge of the sheet is nipped between the reversible roller and the separable roller, the separable roller is separated from the reversible roller, the adjusting means performs an adjusting operation and is stopped in an adjusted state, the separable roller is pressed against the reversible roller, an output of sheet from the sheet feed position is started by the sheet input and output means, and then the adjusting means resets the adjusted state.

With this structure, when the sheet is input to the sheet feed position by the sheet input and output means, the reversible roller is stopped in a state in which the trailing edge of the sheet is nipped between the reversible roller and the separable roller. After the separable roller is separated from the reversible roller, the adjusting operation is performed by the adjusting means and stopped in the adjusted state. Next, the separable roller is pressed against the reversible roller, and the output of sheet from the sheet feed position is started by the sheet input and output means. Then, the adjusting means resets the adjusted state.

This structure eliminates the necessity of a pickup roller which is installed for outputting the sheet from the sheet feed position in a conventional apparatus. Namely, in this structure, the sheet is input to and output from the sheet feed position by the reversible roller and the separable roller, and the adjusting means performs the adjusting operation for preventing defective feeding of sheets. It is therefore possible to prevent sheets from being obliquely fed from the turnaround section.

In order to achieve the above object, a reverse sheet feeding device of the present invention includes:

a turnaround section including sheet input and output means, for reversing a leading edge and a trailing edge of a sheet with respect to a transporting direction, the sheet input and output means having a reversible roller driven in forward and backward directions, and upper and lower auxiliary rollers, disposed above and below the reversible roller, the input and output means inputting a sheet from a sheet input and output position located on one side of the reversible roller to a sheet feed position located on the other side of the reversible roller and outputting the sheet from the sheet feed position to the sheet input and output position by the reversible roller and the upper and lower auxiliary rollers;

a pair of upper and lower reversing transport paths for holding a sheet output from the turnaround section and transporting the sheets while turning over the sheets, the reversing transport paths being formed so that a starting point thereof is located on the sheet input and output position in the turnaround section, the reversing transport paths are separated from each other at the starting point to run above and below the turnaround section;

a sheet input path for supplying the sheet to the sheet input and output position in the turnaround section, the sheet input path being formed so that an end point thereof is located on the separating point of the upper and lower reversing transport paths; and sheet guiding means disposed between the starting point of the upper and lower reversing transport paths or the end point of the sheet input path and the sheet input and output means, the sheet guiding means being switched between a first guide state in which the sheet is input from the sheet input path to a section between the upper auxiliary roller and the reversible roller and the sheet is output from a section between the lower auxiliary roller and the reversible roller to the lower reversing transport path and a second guide state in which the sheet is input from the sheet input path to the section between the lower auxiliary roller and the reversible roller and the sheet is output from the section between the upper auxiliary roller and the reversible roller to the upper reversing transport path.

With this structure, when the sheet guiding means is set into the first guide state, a sheet transported to the sheet input and output position of the turnaround section from the sheet input path is guided to the section between the upper auxiliary roller and the reversible roller by the sheet guiding means, and then transported to the sheet feed position by the reversible roller rotated in a direction. At this time, a sheet in the sheet feed position is transported from the section between lower auxiliary roller and the reversible roller to the lower reversing transport path by the reversible roller rotated in the above-mentioned direction while being guided by the sheet guiding means.

On the other hand, when the sheet guiding means is set into the second guide state, a sheet transported to the sheet input and output position from the sheet input path is guided to the section between the lower auxiliary roller and the reversible roller by the sheet guiding means, and then transported to the sheet feed position by the reversible roller rotated in the reverse direction. At this time, a sheet in the sheet feed position is transported from the section between upper auxiliary roller and the reversible roller to the upper reversing transport path by the reversible roller rotated in the above-mentioned reverse direction while being guided by the sheet guiding means.

As described above, in this reverse sheet feeding device, the input of sheet from the sheet input path to the turnaround section and the output of sheet from the turnaround section to the upper or lower reversing transport path are simultaneously performed. It is thus possible to increase the processing speed in feeding sheets while reversing the sheets.

Additionally, in the sheet guiding means, one guiding member may be disposed between the sheet input and output means and the starting point of the upper and lower reversing transport paths or the end point of the sheet input path so that the guiding member is rotatable on an end thereof near the reversible roller. This arrangement further simplifies the structure and increases the processing speed in feeding sheets while reversing the sheets.

Moreover, in the above-mentioned reverse sheet feeding device, the upper and lower auxiliary rollers of the sheet input and output means may be formed by separable rollers which are capable of being pressed against and separated from the reversible roller, and the reverse sheet feeding device may further include:

transporting means, disposed in the upper and lower reversing transport paths, for holding and transporting a sheet; and controlling means for controlling the sheet input and output means so that, when feeding a sheet to the upper or lower reversing transport path by the sheet input and output means, if another sheet exists in a forward location in a sheet transporting direction in the reversing transport path, the separable roller which is outputting the sheet being nipped by the transporting means toward the reversing transport path together with the reversible roller is separated from the reversible roller.

With this structure, when feeding a sheet to the reversing transport path, if another sheet exists in a forward location in a sheet transporting direction in the reversing transport path, the separable roller which is outputting the sheet being nipped by the transporting means toward the reversing transport path together with the reversible roller is separated from the reversible roller. Therefore, even if the transport of sheet from the sheet feed position of the turnaround section to the reversing transport path needs to be stopped due to the existence of another sheet in a forward location of the upper or lower reversing transport path when feeding the next sheet, the feeding of sheet to the sheet feed position can be continued by continuously rotating the reversible roller, i.e., by means of the reversible roller and another separable roller which is not separated from the reversible roller. Thus, this structure increases the processing speed in feeding sheets while reversing the sheets.

Furthermore, in this reverse sheet feeding device, the upper and lower auxiliary rollers of the sheet input and output means may be formed by separable rollers capable of being pressed against and separated from the reversible roller, and the reverse sheet feeding device may include:

transporting means, disposed in the upper and lower reversing transport paths, for holding and transporting a sheet; and transport controlling means for controlling the transporting means so that, when inputting a last sheet among a number of sheets capable of being held in the upper and lower reversing transport paths, a sheet which is previously fed and held in the reversing transport path is moved forward in the transporting direction by at least an amount required by the transporting means to nip a leading edge of the last sheet.

With this structure, when inputting a last sheet among a number of sheets capable of being held in the upper and lower reversing transport paths, a sheet which is previously fed and held in the reversing transport path is moved forward in the transporting direction by at least an amount required by the transporting means to hold the leading edge of the last sheet in a transportable condition. It is therefore possible to set the length of the reversing transport paths shorter than a length required for completely holding a predetermined storable number of sheets. Consequently, the size of the device is reduced.

For a fuller understanding of the nature and advantages of the invention, reference should be made to the ensuing detailed description taken in conjunction with the accompanying drawings.

DESCRIPTION OF THE PREFERRED EMBODIMENTS

The following description discusses one embodiment of the present invention with reference to FIGS. 1 to 39.

Figure 1:
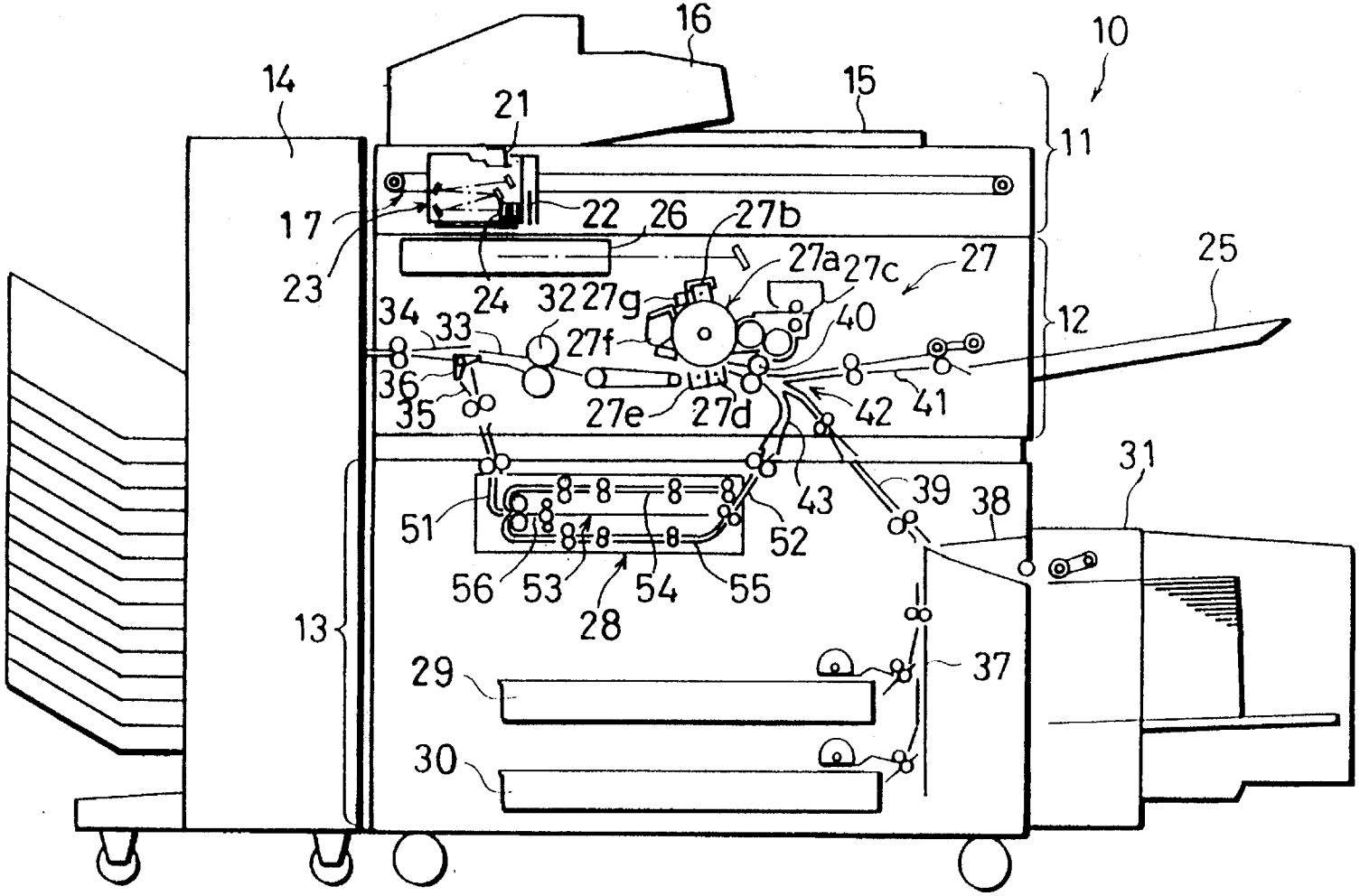
FIG. 1 is a front view schematically illustrating an overall structure of a digital copying machine as an embodiment of a double-side image forming apparatus of the present invention.

As illustrated in FIG. 1, a digital copying machine 10 as a double-side image forming apparatus of this embodiment includes a scanner section 11, a laser printer section 12 as an image forming section, a multi-level sheet feed unit 13, and a sorter 14.

The scanner section 11 is formed by a document platen 15 made of transparent glass, a recirculating document feeder (RDF) 16 compatible with double-side documents, and a scanner unit 17.

The RDF 16 automatically feeds a pile of a plurality of documents sheet by sheet to the scanner unit 17 in which one side or both sides of a document is (are) read according to an operator's request. The scanner unit 17 includes a lamp reflector assembly 21, a CCD (charge coupled device) 22 as a photoelectric converting element, a plurality of reflecting mirrors 23, and a lens 24. The lamp reflector assembly 21 applies light to a document. The reflecting mirror 23 guides reflected light from the document to the CCD 22. The lens 24 forms an image of the reflected light from the document on the CCD 22.

The image data obtained by reading the image on the document by the scanner unit 17 is subjected to various operations in an image processing section (not shown) in the digital copying machine 10, and temporarily stored in a memory in the image processing section. Then, the image data in the memory is supplied to the laser printer section 12 upon an output instruction, and output as a reproduced image to a sheet. Image data transferred from an external information processing device, for example, a word processor or micro computer is also stored in the memory. In this case, image data from the information processing device is output to a sheet.

The laser printer section 12 includes a manual-feed tray 25, a laser writing unit 26, and an electrophotographic processing section 27 for forming an image.

The laser writing unit 26 has a semiconductor laser, a polygon mirror, and an f-θ lens (none of them are shown). The semiconductor laser emits laser light corresponding to the image data obtained from the memory in the image processing section. The polygon mirror deflects the laser light at a constant angular velocity. The f-θ lens is adjusted so that the laser light deflected at the constant angular velocity is deflected at a constant velocity on a photoreceptor drum 27*a* in the electrophotographic processing section 27.

The electrophotographic processing section 27 includes a charger 27*b*, a developing device 27*c*, a transfer device 27*d*, a separating device 27*e*, a cleaning device 27*f* and a charge removing device 27*g* arranged in the well known manner around the photoreceptor drum 27*a* as well as a fixing device 32. A transport path 33 is disposed on a downstream side of the fixing device 32 in a sheet transporting direction. The transport path 33 is split into a transport path 34 and a transport path 35. The transport path 34 runs to the sorter 14, while the transport path 35 leads to the multi-level sheet feed unit 13. Also disposed on a sheet input side of a section between the photoreceptor drum 27*a* and the charger 27*d* are a register roller 40 for timely supplying a sheet to the section.

In the laser printer section 12, the image data read out from the memory in the image processing section is output as laser light from the laser writing unit 26. The laser light scans the photoreceptor drum 27*a* which has been charged to a predetermined potential by the charger 27*b* so as to form an electrostatic latent image on a surface thereof. The electrostatic latent image is visualized as a toner image developed by toner supplied from the developing device 27*c*. The toner image is transferred to a sheet supplied from the multi-level sheet feed unit 13 through the register rollers 40 by the transfer device 27*d*. The sheet is then separated from the surface of the photoreceptor drum 27*a* by the separating device 27*e*. Toner remaining on the surface of the photoreceptor drum 27*a* is collected by the cleaning device 27*f*. Residual charges on the photoreceptor drum 27*a* are removed by the charge removing device 27*g*. The toner image transferred to the sheet is fixed to the sheet, and sent to the sorter 14 by the transport path 33, a switching gate 36 and the transport path 34, or to a loop duplex unit (LDU) 28 as a reverse sheet feeding device in the multi-level sheet feed unit 13 by the transport path 33, the switching gate 36 and the transport path 35.

The multi-level sheet feed unit 13 includes the LDU 28, a first cassette 29, a second cassette 30, and an optional third cassette 31. Sheets stored in the first to third cassettes 29 to 31 are fed one by one from the topmost sheet to the electrophotographic processing section 27 in the laser printer section 12.

Sheets fed from the first and second cassettes 29 and 30 are directed to and transported by a common transport path 37. Whereas a sheet output from the third cassette 31 is directed to and transported by a transport path 38. The transport paths 37 and 38 join together, and are connected to the rear end of a transport path 39. The front end of the transport path 39 joins a transport path 41 that is connected to the manual-feed tray 25 at a joint 42 on the sheet input side with respect to the register roller 40. Moreover, a transport path 43 connected to a sheet output path 52 of the LDU 28 is also connected to the joint 42.

Figure 2:
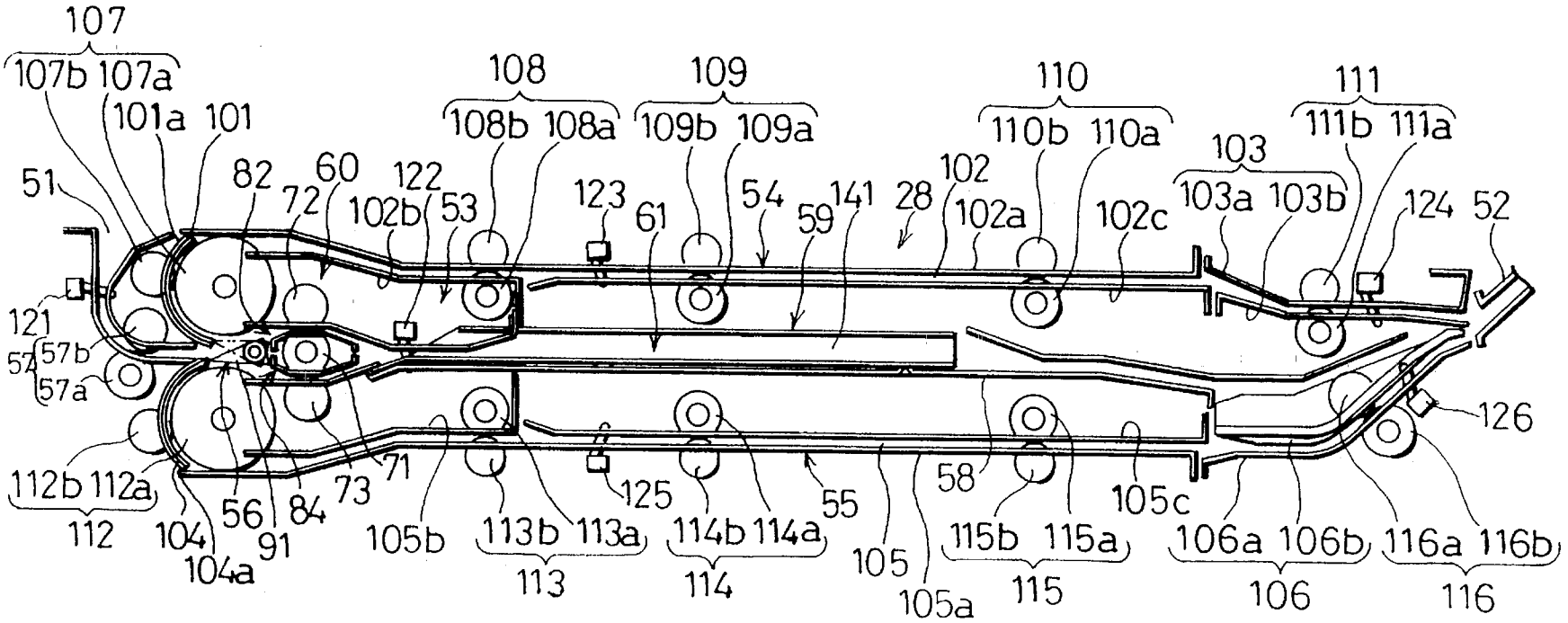
FIG. 2 is a front view illustrating the structure of an LDU shown in FIG. 1.

The LDU 28 is movable in directions orthogonal to a paper surface of FIG. 1 by operating a holding section, not shown. The LDU 28 is thus freely inserted into and removed from the multi-level sheet feed unit 13. As illustrated in FIG. 2, the LDU 28 includes a sheet input path 51, the sheet output path 52, a turnaround section 53, an upper reversing transport path 54 and a lower reversing transport path 55 as reversing transport paths, and a sheet guiding device 56 as sheet guiding means. The sheet input path 51 is connected to the transport path 35, while the sheet output path 52 is connected to the transport path 43. The turnaround section 53 is formed along a sheet transporting direction of the sheet input path 51.

Additionally, disposed in the sheet input path 51 is sheet input rollers 57 formed by a pair of rollers 57*a* and 57*b*, for transporting a sheet to the turnaround section 53.

Figure 3:
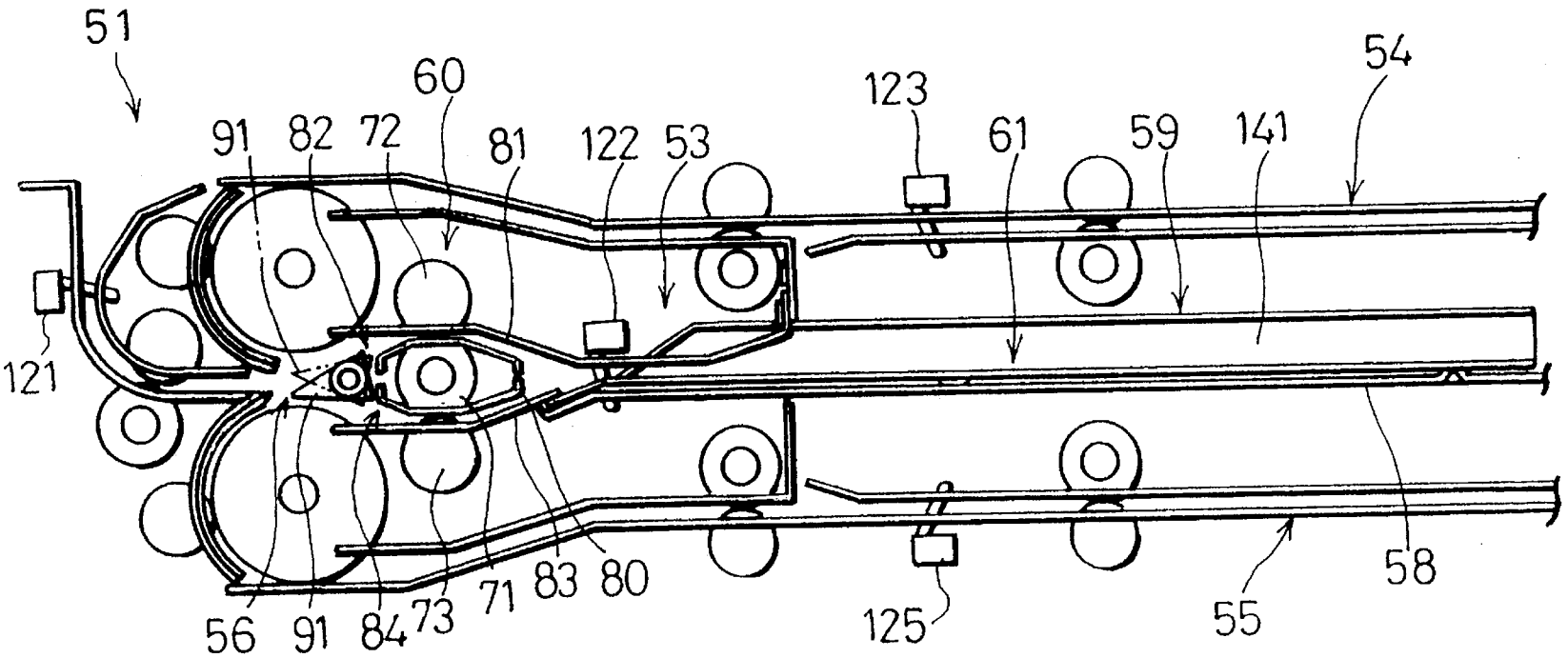
FIG. 3 is an enlarged view of a front section of the LDU.

When the sheet is supplied through the sheet input path 51, the turnaround section 53 reverses the leading and trailing edges of the sheet with respect to the sheet transporting direction by a switchback operation. As illustrated in FIG. 3, the turnaround section 53 includes an adjusting device 59, and a sheet input and output device 60. The adjusting device 59 is disposed on a supporting plate 58. The sheet input and output device 60 is positioned between the adjusting device 59 and the sheet input path 51. A side of the sheet input and output device 60 which is closer to the adjusting device 59 is a sheet input and output position of the turnaround section 53.

Figure 4:
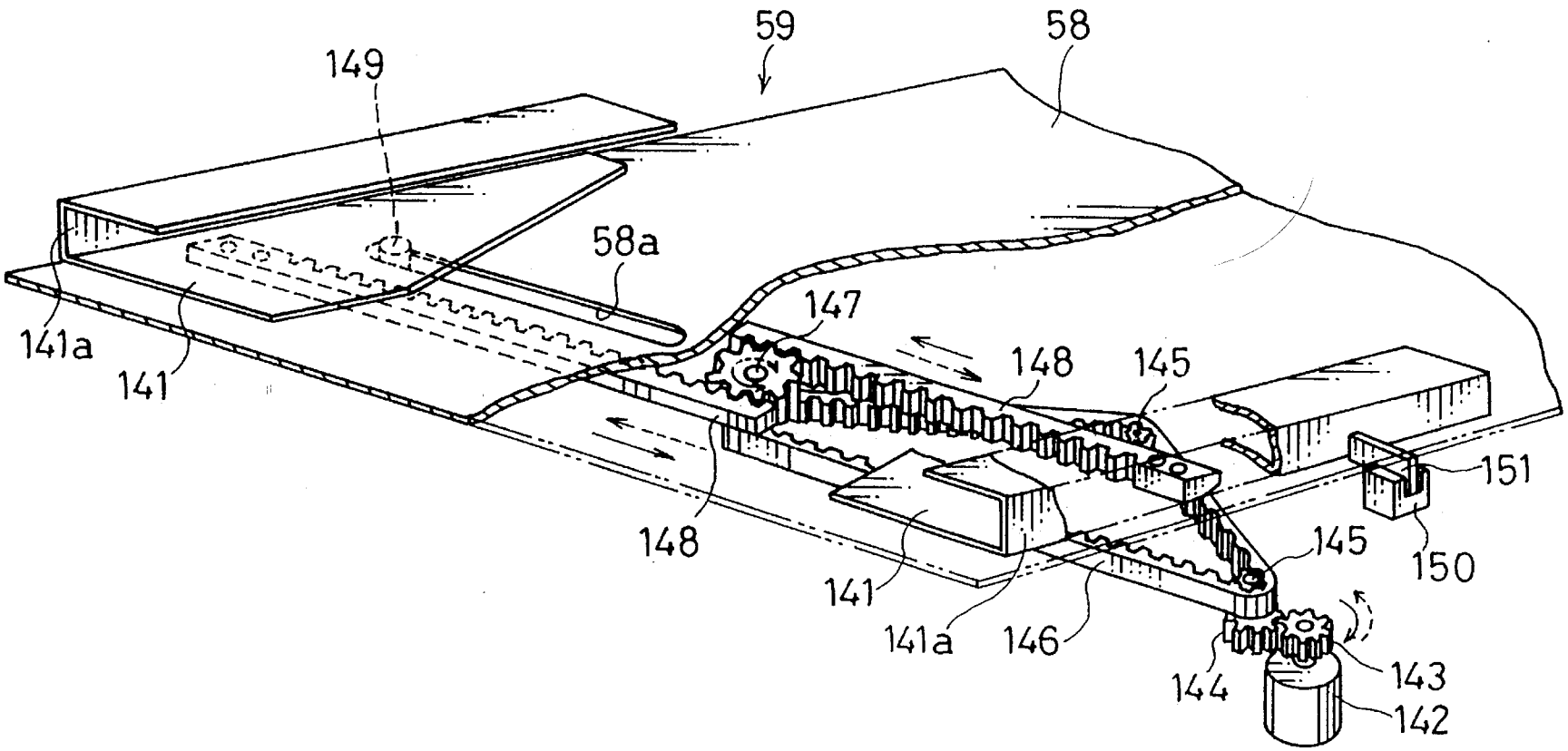
FIG. 4 is a perspective view of an essential section of an adjusting device shown in FIG. 2.

The adjusting device 59 is provided for positioning a sheet which has been transported to a sheet feed position 61 on the supporting plate 58 by the sheet input and output device 60 in a correct position so as to prevent the sheet output from the turnaround section 53 from being fed in an oblique direction by the sheet input and output device 60. Therefore, as illustrated in FIG. 4, the adjusting device 59 includes a pair of adjusting plates 141, and an adjusting motor 142. The adjusting plates-141 are movable in directions orthogonal to the sheet transporting direction. The adjusting motor 142 drives the adjusting plates 141 to carry out adjusting operations. The driving force of the adjusting motor 142 is transmitted to the adjusting plates 141 through gears 143 and 144, three sprockets 145, a timing belt 146, a pinion gear 147, and rack gears 148 mounted on the adjusting plates 141, respectively. Namely, the adjusting plates 141 are moved in directions on a straight line so that they come closer to each other, by a rotational movement of the adjusting motor 142 in a direction, for example, by a forward rotation. On the other hand, when the adjusting motor 142 is rotated in the reverse direction, the adjusting plates 141 are moved in directions on the straight line so that they are moved away from each other. Such movements of the adjusting plates 141 are guided by a movement of a pin 149 attached to the adjusting plate 141 along a slot 58*a* formed on the supporting plate 58. When the adjusting plates 141 are moved away from each other and reach their standby positions, respectively, an adjusting-plate home position sensor 150 detects the state. The detection is executed when the adjusting-plate home position sensor 150 detects a plate-like sensor actuator 151 mounted on the adjusting plate 141.

As illustrated in FIG. 3, the sheet input and output device 60 includes a reversible roller 71, and upper and lower separable rollers 72 and 73 mounted as upper and lower auxiliary rollers above and below the reversible roller 71, respectively. The upper separable roller 72 and the lower separable roller 73 are capable of being pressed against and separated from the reversible roller 71. The reversible roller 71 is positioned to face an end of the sheet input path 51, closer to the turnaround section 53.

Figure 5:
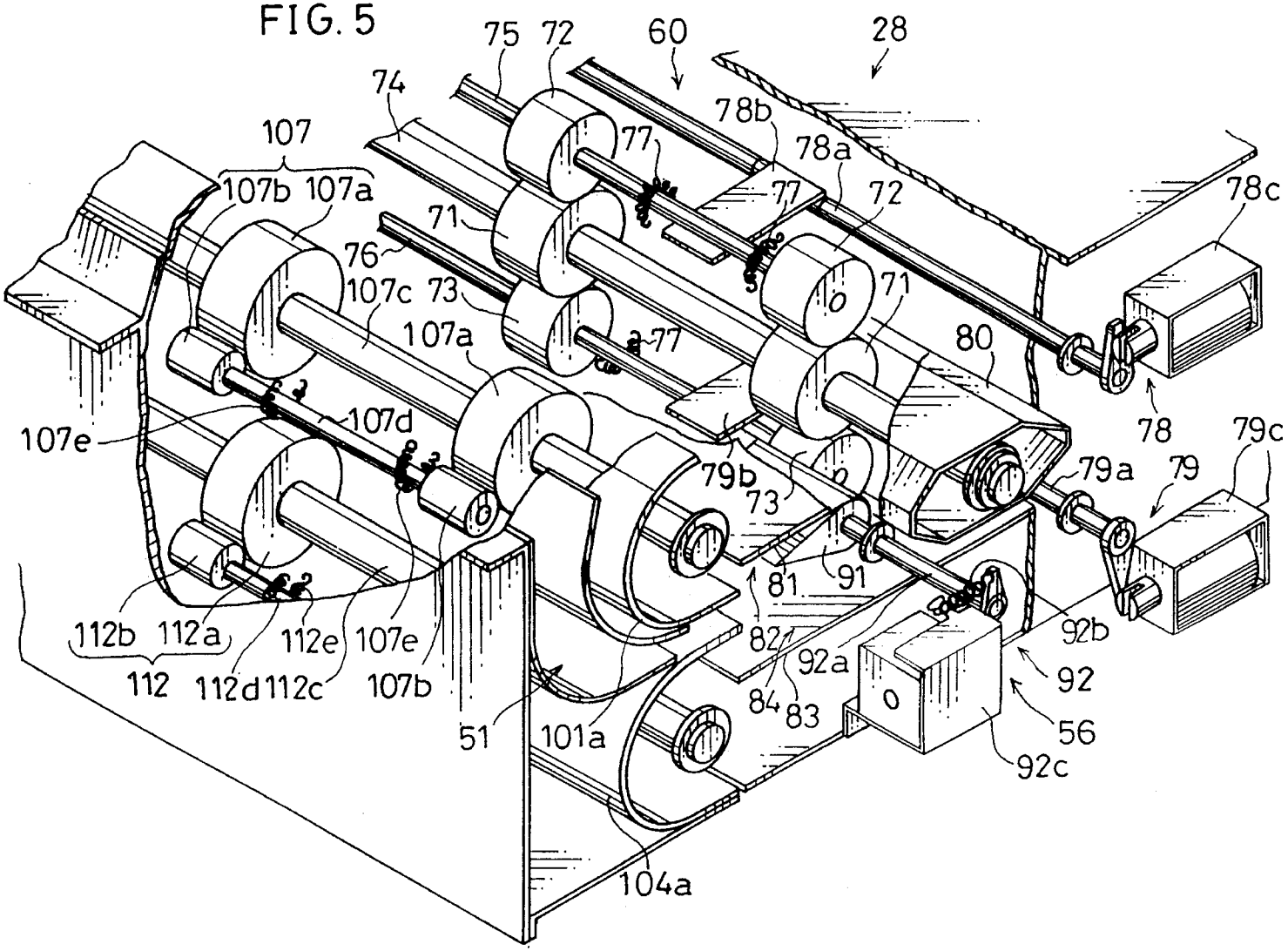
FIG. 5 is a perspective view illustrating the structure of the front section of the LDU.

As illustrated in FIG. 5, the reversible rollers 71 are mounted on a driving shaft 74 rotated by a roller driving motor, not shown. The upper and lower separable rollers 72 and 73 are mounted on roller shafts 75 and 76, respectively. When the upper and lower separable rollers 72 and 73 are pressed against the rotating reversible rollers 71, they are rotated. The roller shafts 75 and 76 are freely movable in upward and downward directions and pulled by a plurality of extension springs 77 in directions to which the upper and lower separable rollers 72 and 73 are pressed to come into contact with the reversible rollers 71. The separation movements of the upper and lower separable rollers 72 and 73 from the reversible rollers 71 are actuated by separation driving devices 78 and 79. The separation driving device 78 includes a rotation shaft 78*a*, a separation driving lever 78*b* mounted on the rotation shaft 78*a*, and an upper separating solenoid 78*c*. When the upper separating solenoid 78*c* is turned on, it rotates the rotation shaft 78*a* so that the upper separable rollers 72 are separated from the reversible rollers 71 by the separation driving lever 78*b*. Similarly to the separation driving device 78, the separation driving device 79 includes a rotation shaft 79*a*, a separation driving lever 79*b*, and a lower separating solenoid 79*c*.

As illustrated in FIG. 3, in the sheet input and output device 60, an upper sheet passage 82 is formed by an intermediate sheet guide 80, located above and below the reversible roller 71, and an upper sheet guide 81 located below the upper separable roller 72. A lower sheet passage 84 is also formed by the intermediate sheet guide 80 and a lower sheet guide 83 positioned above the lower separable roller 73.

As illustrated in FIG. 5, the sheet guiding device 56 includes a switching gate 91 as a sheet guiding member and a gate driving device 92. The switching gate 91 is pivotable on an end thereof in the sheet input and output device 60. As illustrated in FIG. 3, the switching gate 91 is movable to an upper-input and lower-output position as a first guide state or a first guide position shown by the solid line and to a lower-input and upper-output position as a second guide state or second guide position shown by the two-dot line. The upper-input and lower-output position is a position in which a sheet supplied through the sheet input path 51 is guided to the upper sheet passage 82, while a sheet output from the turnaround section 53 through the lower sheet passage 84 is guided to the lower reversing transport path 55. The lower-input and upper-output position is a position in which a sheet supplied from the sheet input path 51 is guided to the lower sheet passage 84, while the sheet output from the turnaround section 53 through the upper sheet passage 82 to the upper reversing transport path 54.

As illustrated in FIG. 5, the gate driving device 92 includes a rotation shaft 92*a*, an extension spring 92*b*, and a gate driving solenoid 92*c*. A switching gate 92 is mounted on the rotation shaft 92*a*. The extension spring 92*b* rotates the rotation shaft 92*a* by pulling so that the switching gate 91 is located in the upper-input and lower-output position. When the gate driving solenoid 92*c* is turned on, it rotates the switching gate 91 to the lower-input and upper-output position against the pulling force of the extension spring 92*b*. When the switching gate 91 is driven by the extension string 92*b*, it is positioned in the upper-input and lower-output position by a stopper, not shown.

As illustrated in FIG. 2, the upper and lower reversing transport paths 54 and 55 separate from each other at the end point of the sheet input path 51, and extend toward upper and lower directions from the end point, respectively. Then, the upper and lower reversing transport paths 54 and 55 pass over and under the turnaround section 53, and join together at the starting point of the sheet output path 52. The upper reversing transport path 54 includes a front section 101, an intermediate section 102 and a rear section 103.

The front section 101 has a circular shape and is formed between a circular sheet guide 101*a* and a turn roller 107*a* with a large diameter, located in the inner side of the circular sheet guide 101*a*. An auxiliary roller 107*b* which makes a pair with the turn roller 107*a* is pressed against the turn roller 107*a*. The rollers 107*a* and 107*b* form an upper first transport rollers 107 as transporting means. The structure of the upper first transport rollers 107 is shown in FIG. 5. The turn roller 107*a* and the auxiliary roller 107*b* are mounted on roller shafts 107*c* and 107*d*, respectively. The auxiliary rollers 107*b* are pressed against the turn rollers 107*a* by extension springs 107*e* attached to the roller shaft 107*d*.

The intermediate section 102 is formed by an intermediate upper sheet guide 102*a* as a movable member, an intermediate lower-front section sheet guide 102*b* and an intermediate lower-rear section sheet guide 102*c*. The intermediate lower-front section sheet guide 102*b* and the intermediate lower-rear section sheet guide 102*c* function as fixing members. The intermediate upper sheet guide 102*a* extends from the end point of the front section 101 to the starting point of the rear section 103. The intermediate lower-front section sheet guide 102*b* and the intermediate lower-rear section sheet guide 102*c* are positioned to face the intermediate upper sheet guide 102*a*. In the intermediate section 102, second to fourth upper transport rollers 108 to 110 are installed from the front toward the back of the intermediate section 102. A driving roller 108*a* of the upper second transport rollers 108 is mounted on the intermediate lower-front section sheet guide 102*b*. Driving rollers 109*a* and 110*a* of the upper third and fourth transport rollers 109 and 110 are mounted on the intermediate lower-rear section sheet guide 102*c*. Driven rollers 108*b* to 110*b* of the upper second to fourth transport rollers 108 to 110 are mounted on the intermediate upper sheet guide 102*a*.

Figure 6:
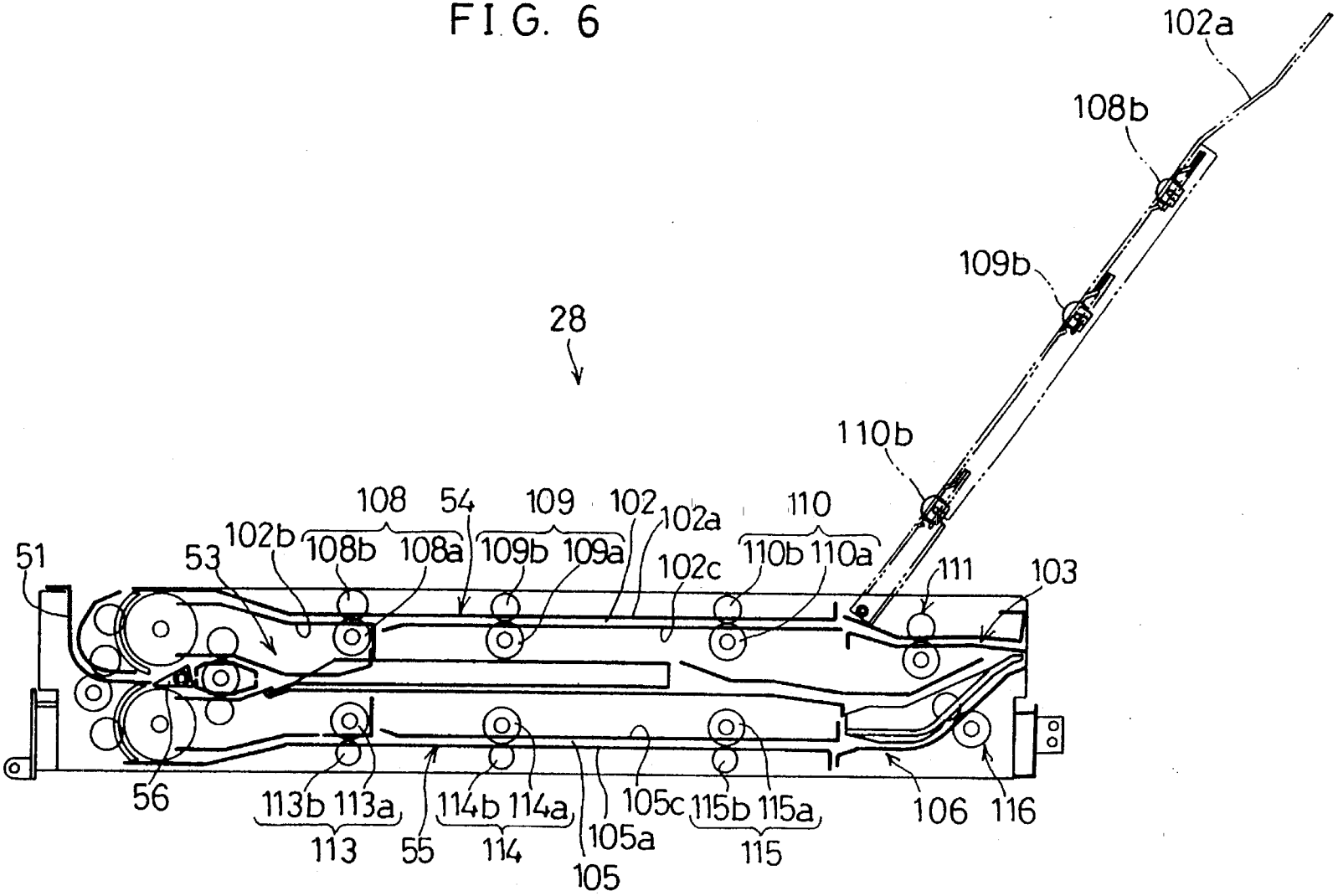
FIG. 6 is an explanatory view illustrating an opening operation when fixing a paper jam in an upper reversing transport path in the LDU.

As illustrated in FIG. 6, the intermediate upper sheet guide 102*a* is rotatable on an end of thereof in the rear section 103 with respect to the intermediate lower-front section sheet guide 102*b* and the intermediate lower-rear section sheet guide 102*c*. Therefore, if a paper jam occurs in the upper reversing transport path 54, the paper Jam is fixed by opening the intermediate upper sheet guide 102*a* to release the intermediate section 102. In this case, the driven rollers 108*b* to 110*b* of the upper second to fourth transport rollers 108 to 110 are also moved together with the intermediate upper sheet guide 102*a*.

The rear section 103 is formed by a rear upper sheet guide 103*a* and a rear lower sheet guide 103*b*, and extends from the end point of the intermediate section 102 to the starting point of the sheet output path 52. In the rear section 103, upper fifth rollers 111 including a driving roller 111*a* and a driven roller 111*b* are provided.

Like the upper reversing transport path 54, the lower reversing transport path 55 includes a front section 104, an intermediate section 105, and a rear section 106. The front section 104 has a circular sheet guide 104*a* corresponding to the circular sheet guide 101*a*. In the front section 104, lower first transport rollers 112 including a turn roller 112*a* and an auxiliary roller 112*b* are provided. The lower first transport rollers 112 correspond to the upper first transport rollers 107. The structure of the lower first transport rollers 112 is shown in FIG. 5. The turn roller 112*a* and the auxiliary roller 112*b* are mounted on roller shafts 112*c* and 112*d*, respectively. The auxiliary roller 112*b* is pressed against the turn roller 112*a* by an extension spring 112*e* attached to the roller shaft 112*d* of the auxiliary roller 112*b*.

The intermediate section 105 is formed by an intermediate lower sheet guide 105*a* as a movable member, an intermediate upper-front section sheet guide 105*b* and an intermediate upper-rear section sheet guide 105*c*. The intermediate upper-front section sheet guide 105*b* and the intermediate upper-rear section sheet guide 105*c* function as fixing members. The intermediate lower sheet guide 105*a*, the intermediate upper-front section sheet guide 105*b*, and the intermediate upper-rear section sheet guide 105*c* correspond to the intermediate upper sheet guide 102*a*, the intermediate lower-front section sheet guide 102*b* and the intermediate lower-rear section sheet guide 102*c*, respectively. In the intermediate section 105, lower second to fourth transport rollers 113 to 116 corresponding to the upper second to fourth transport rollers 108 to 110 are installed. Similarly to the intermediate upper sheet guide 102*a*, the intermediate lower sheet guide 105*a* is rotatable with respect to the intermediate upper-front section sheet guide 105*b* and the intermediate upper-rear section sheet guide 105*c*. One of the sides of the intermediate lower sheet guide 105*a*, for example, the back side in FIG. 2, is fixed, and the opposite side thereof is movable in the downward direction. Namely, the intermediate lower sheet guide a is opened by moving the movable side thereof in the downward direction.

In the lower second to fourth lower transport rollers to 116, driving rollers 113*a* to 116*a* are mounted on the intermediate upper-front section sheet guide 105*b* and the intermediate upper-rear section sheet guide 105*c*, while driven rollers 113*b* to 116*b* are mounted on the intermediate lower sheet guide 105*a*. The rear section 106 is formed by a rear lower sheet guide 106*a*, and a rear upper sheet guide 106*b*. Lower fifth transport rollers 116 formed by the driving roller 116*a* and the driven roller 116*b* are provided.

The front section 101 and the intermediate section 102 of the upper reversing transport path 54 and the front section 104 and the intermediate section 104 of the lower reversing transport path 55 are symmetrically arranged with respect to the turnaround section 53. The total length of the upper reversing transport path 54 is set equal to the total length of the lower reversing transport path 55.

Figure 7:
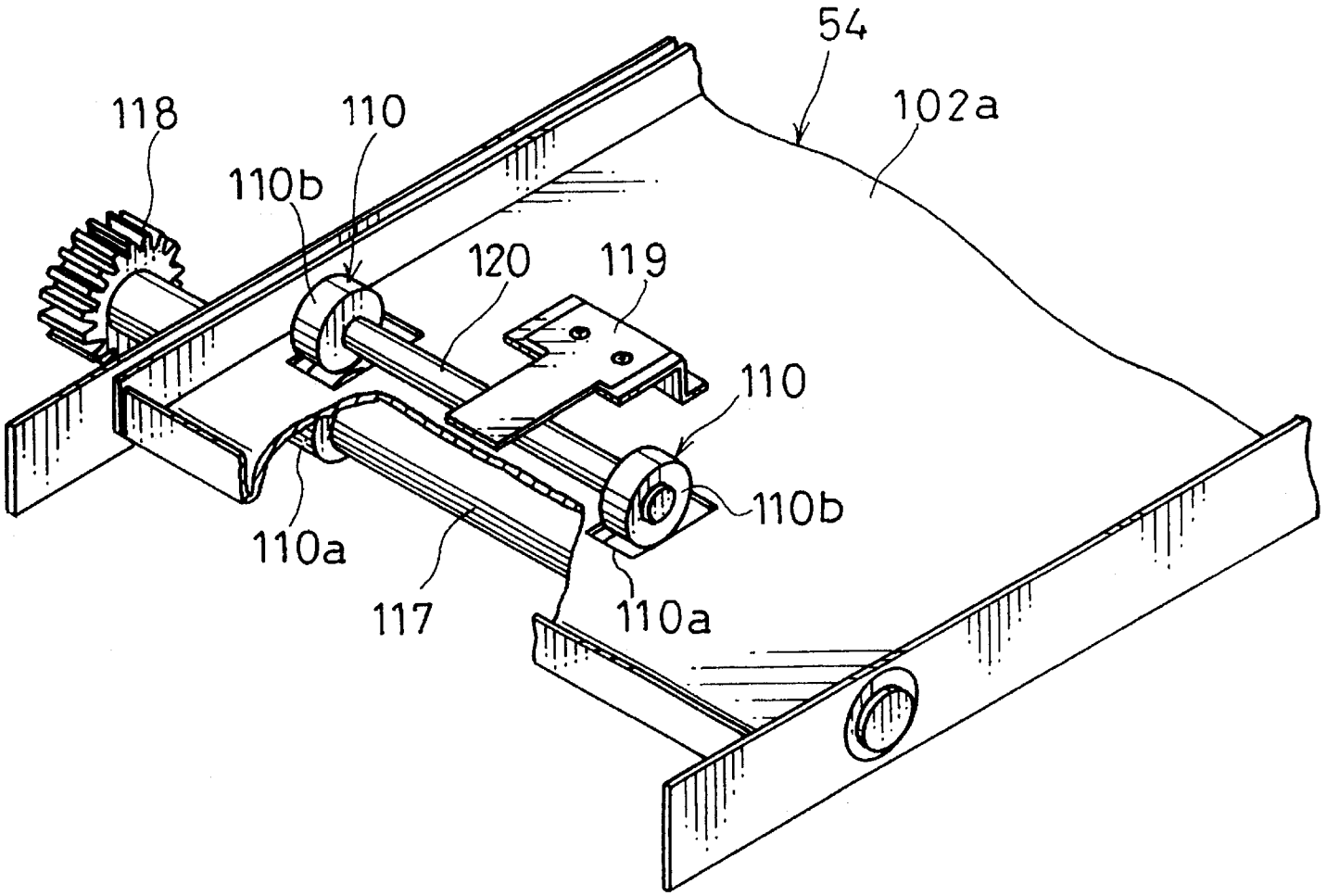
FIG. 7 is a perspective view illustrating the installation structure of transport rollers in the upper reversing transport path.

Regarding the upper fourth transport rollers 110, for example, as illustrated in FIG. 7, the driving roller 110*a* is mounted on a rotating shaft 117, and rotated when a driving force is input through a gear 118 attached to the rotating shaft 117. The driven roller 110*b* is rotatably mounted on a roller shaft 120 supported on the intermediate upper sheet guide 102*a* by a structure, not shown. The driven roller 110*b* is pressed against the driving roller 110*a* by a plate spring 119 pushing the roller shaft 120. Consequently, when a paper jam occurs, an operator releases the intermediate upper sheet guide 102*a* and removes the paper causing the paper jam in the upper reversing transport path 54. Then, when the intermediate upper sheet guide 102*a* is closed, the driven roller 110*b* is suitably pressed against the driving roller 110*a*. Moreover, since the driven roller 110*b* is mounted on the intermediate upper sheet guide 102*a* which is opened when fixing a paper jam, the installation structure of the upper fourth transport rollers 110 is simplified. Thus, the structure is also adopted in the upper second and third transport rollers 108 and 109 and the lower second to fourth transport rollers 113 to 116.

The LDU 28 includes an input path sheet sensor 121, a turnaround section sheet sensor 122, an upper intermediate section sheet sensor 123, an upper rear section sheet sensor 124, a lower intermediate section sheet sensor 125, and a lower rear section sheet sensor 126. The input path sheet sensor 121 is provided in the sheet input path 51. The turnaround section sheet sensor 122 is positioned in the joint of the upper sheet passage 82 and the lower sheet passage 84 in the turnaround section 53. The upper intermediate section sheet sensor 123 and the upper rear section sheet sensor 124 are mounted in the intermediate section 102 and the rear section 103 in the upper reversing transport path 54, respectively. The lower intermediate section sheet sensor 125 and the lower rear section sheet sensor 126 are disposed in the intermediate transport path 105 and the-rear transport path 106 in the lower reversing transport path 55.

The upper first to fifth transport rollers 107 to 111 in the upper reversing transport path 54 and the corresponding lower first to fifth transport rollers 112 to 116 in the lower reversing transport path 55 are located in corresponding positions equally separated from the starting point of the upper and lower reversing transport paths 54 and 55, respectively. Similarly, the upper intermediate section sheet sensor 123 and upper rear section sheet sensor 124 in the upper reversing transport path 54 and the corresponding lower intermediate section sheet sensor 125 and the lower rear section sheet sensor 126 in the lower reversing transport path 55 are located in corresponding positions equally separated from the starting point of the upper and lower reversing transport paths 54 and 55, respectively.

The LDU 28 includes an LDU controller 131, shown in FIG. 8, which constitutes controlling means together with a main body controller, to be described later. The LDU controller 131 includes a CPU (central processing unit), a ROM (read only memory) and a RAM (random access memory), not shown. The ROM stores a control program of the CPU. The RAM is a memory area in which various information related to control operations of the CPU is stored.

Connected to the LDU controller 131 are the input path sheet sensor 121, the turnaround section sheet sensor 122, the upper intermediate section sheet sensor 123, the upper rear section sheet sensor 124, the lower intermediate section sheet sensor 125, and the lower rear section sheet sensor 126. Also connected to the LDU controller 131 are a roller driving motor 132 as a driving source of the respective rollers in the LDU 28, an upper first clutch 133, an upper second clutch 134, a lower first clutch 135, a lower second clutch 136, the upper separating solenoid 78*c* of the separation driving device 78, a lower separating solenoid 79*c* of the separation driving device 79, a forward clutch 137, a reverse clutch 138, the adjusting motor 142 and a main body controller 161.

The driving force of the roller driving motor 132 is transmitted to the turn roller 107*a* of the upper first transport rollers 107 and the driving rollers 108*a* and 109*a* of the upper second and third transport rollers 108 and 109 through the upper first clutch 133, and transmitted to the upper fourth and fifth rollers 110 and 111 through the upper second clutch 134.

Similarly, the driving force of the roller driving motor 132 is transmitted to the turn roller 112*a* of the lower first transport rollers 112, the driving rollers 113*a* and 114*a* of the lower second and third transport rollers 113 and 114 through the lower first clutch 135, and to the lower fourth and fifth transport rollers 115 and 116 through the lower second clutch 136. The driving force of the roller driving motor 132 is transmitted to the reversible roller 71 through the forward clutch 137 or the reverse clutch 138. The forward clutch 137 transmits the driving force of the roller driving motor 132 to the reversible roller 71 so that the reversible roller 71 is rotated in a clockwise direction, for example, a forward direction in FIG. 2. On the other hand, the reverse clutch 138 transmits the driving force of the roller driving motor 132 to the reversible roller 71 so that the reversible roller 71 is rotated in a counterclockwise direction, for example, in the reverse direction in FIG. 2. The adjusting motor 142 drives the adjusting plates 141 to operate adjusting operations.

The following explanation simply explains the basic operations of the LDU 28 having the above-mentioned structure so that the operations thereof are easily understood.

Figure 9:
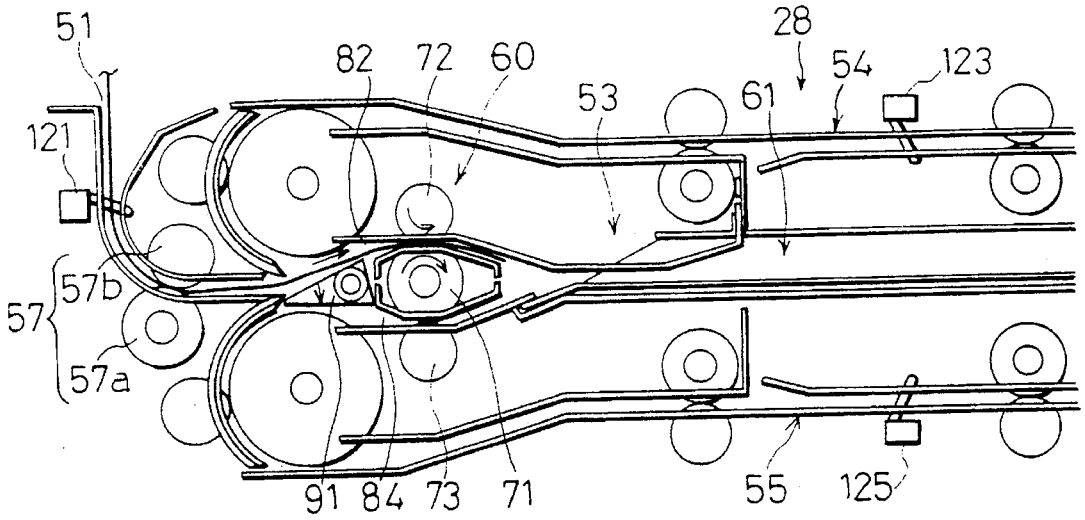
FIG. 9 is an explanatory view illustrating a state in which a sheet is input to a sheet feed position through an upper sheet passage in a turnaround section of the LDU.
Figure 10:
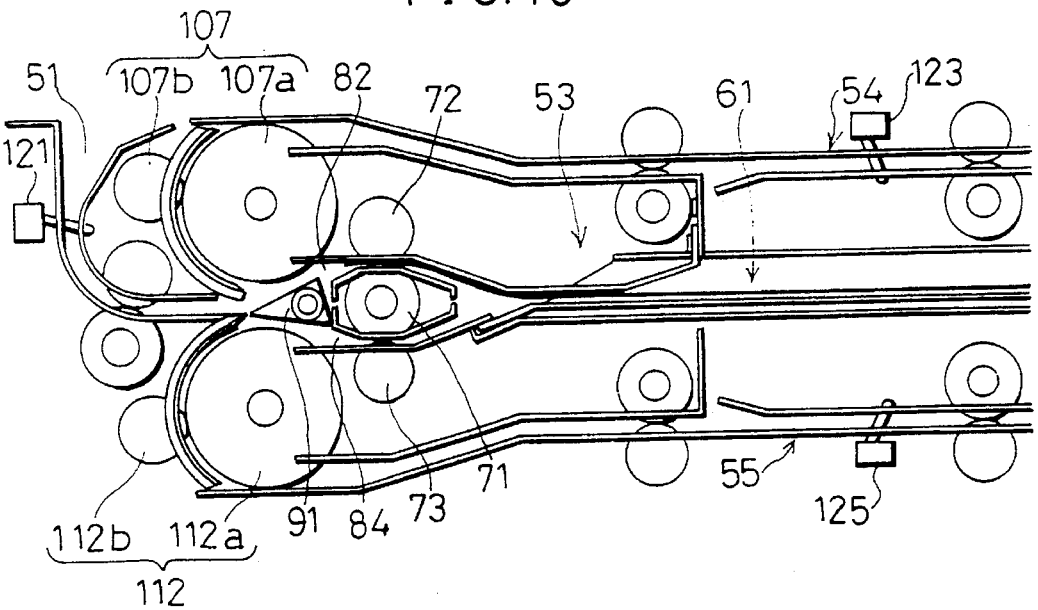
FIG. 10 is an explanatory view showing a state after the state of FIG. 9, in which the input of sheet to the sheet feed position is completed.

As illustrated in FIG. 9, the first sheet input from the sheet input path 51 is guided to the upper sheet passage 82 by the switching gate 91 which is switched to the upper-input and lower-output position. The sheet is transported to the sheet feed position 61 by the upper separable roller 72 pressed against the reversible roller 71 and the reversible roller 71 rotating in the clockwise direction or the forward direction in FIG. 9. Thereafter, the reversible roller 71 is stopped. In this state, as illustrated in FIG. 10, the trailing edge of the sheet is nipped between the reversible roller 71 and the upper separable roller 72.

The reversible roller 71 is controlled to be stopped when a predetermined time according to the size of a sheet elapses after the leading edge of the sheet is detected by the input path sheet sensor 121 in the sheet input path 51. The predetermined time is determined by the LDU controller 131 on the basis of the size of a sheet supplied from the first to third cassettes 29 to 31 or the manual-feed tray 25, and a transporting speed of sheet in the sheet input and output device 60.

Figure 11:
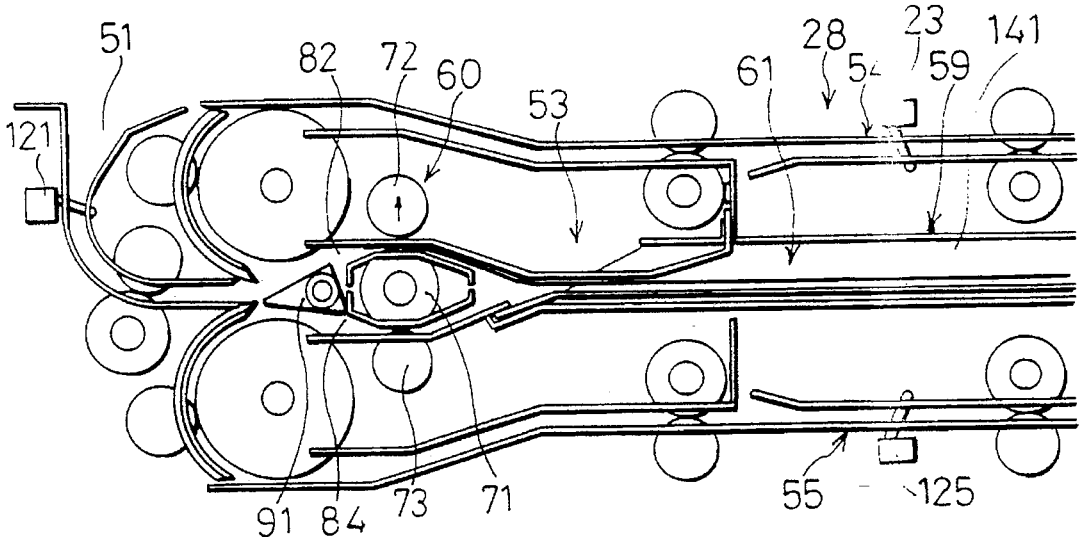
FIG. 11 is an explanatory view illustrating a state after the state of FIG. 10, in which the sheet is adjusted.

As illustrated in FIG. 11, after the fixed state of the sheet by the upper separable roller 72 is cleared by separating the upper separable roller 72 from the reversible roller 71 by several mm, the adjusting device 59 is actuated. As a result, the obliquely fed sheet is corrected to a predetermined position by the adjusting plates 141 of the adjusting device 59.

Figure 12:
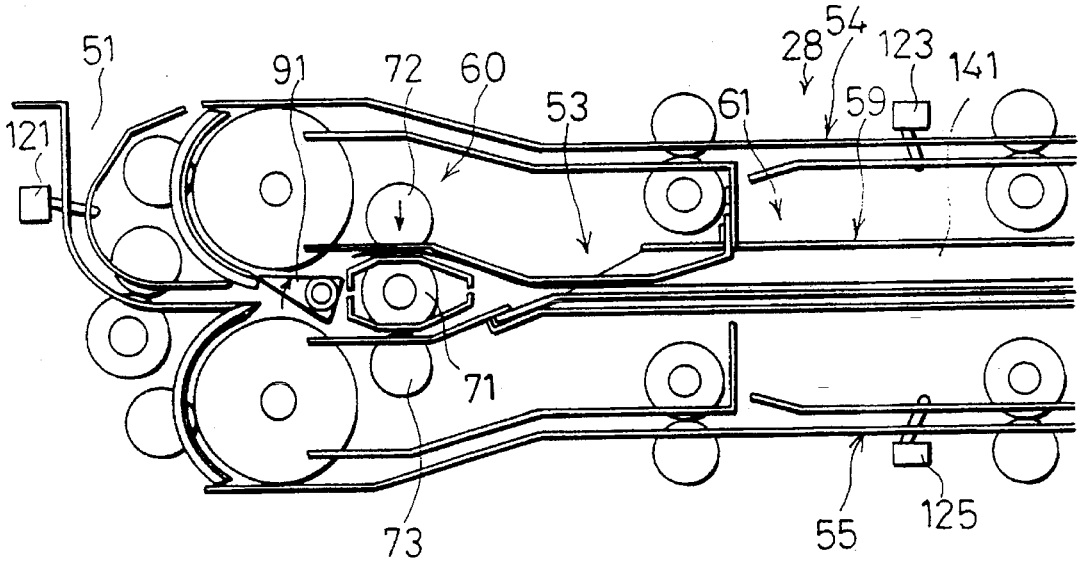
FIG. 12 is an explanatory view illustrating a state of the sheet before being output from the sheet feed position after the state of FIG. 11.

Next, as illustrated in FIG. 12, the upper separable roller 72 is pressed against the reversible roller 71, while the switching gate 91 is switched to the lower-input and upper-output position. Subsequently, the adjusting plates 141 return to the standby positions.

Figure 13:
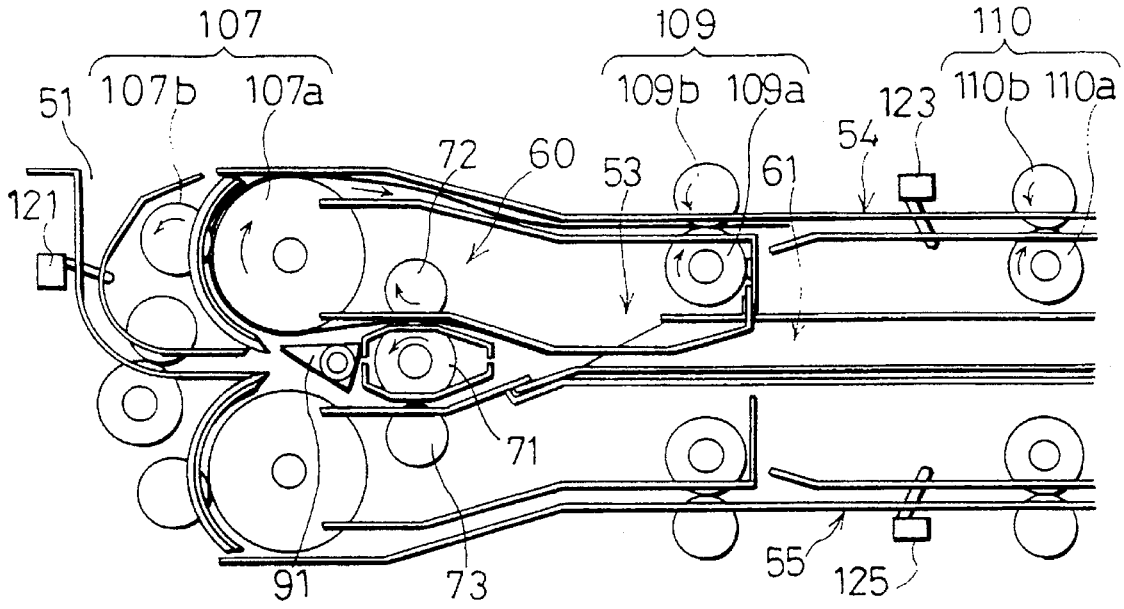
FIG. 13 is an explanatory view illustrating a state of the sheet being output to the upper reversing transport path from the sheet feed position after the state of FIG. 12.

Then, as illustrated in FIG. 13, the reversible roller 71 is rotated in the counterclockwise direction or the reverse direction, and the sheet in the sheet fed position 61 is guided to the switching gate 91 and transported to the upper reversing transport path 54. The sheet is then input into the upper reversing transport path 54 by the rotations of the upper first to third transport rollers 107 to 109. Thereafter, the sheet is output from the sheet output path 52 at a predetermined time and supplied to the laser printer section 12 by the rotations of the upper fourth and fifth transport rollers 110 to 111.

On the other hand, in order to improve the processing speed and prevent abrasion of particular rollers, after a second sheet is transported to the sheet feed position 61 by the switching gate 91, the reversible roller 71 and the lower separable roller 73, it is supplied to the laser printer section 12 through the lower reversing transport path 55.

Figure 14:
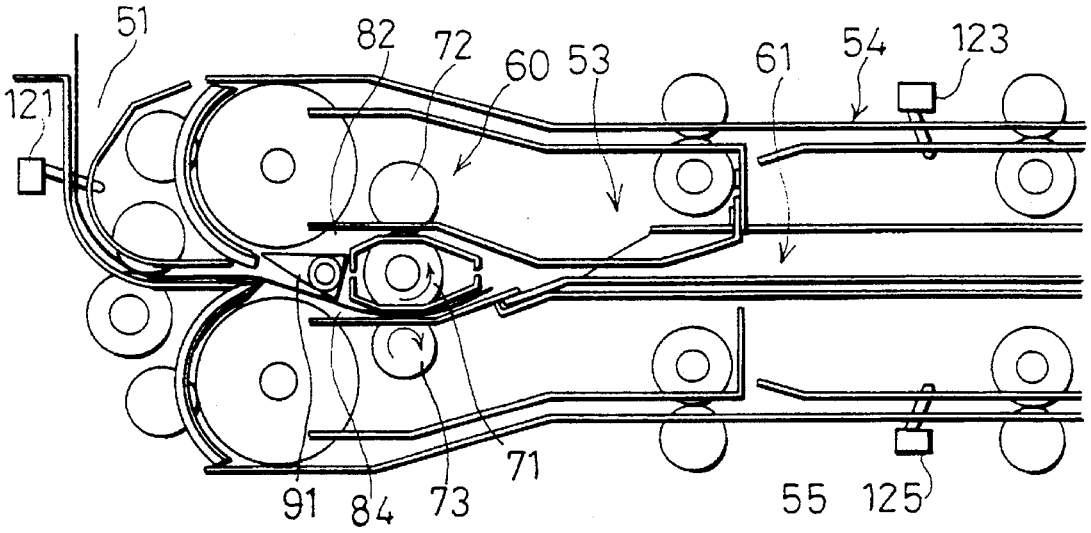
FIG. 14 is an explanatory view illustrating a state of the sheet being input to the sheet feed position through a lower sheet passage in the turnaround section after the state of FIG. 13.
Figure 15:
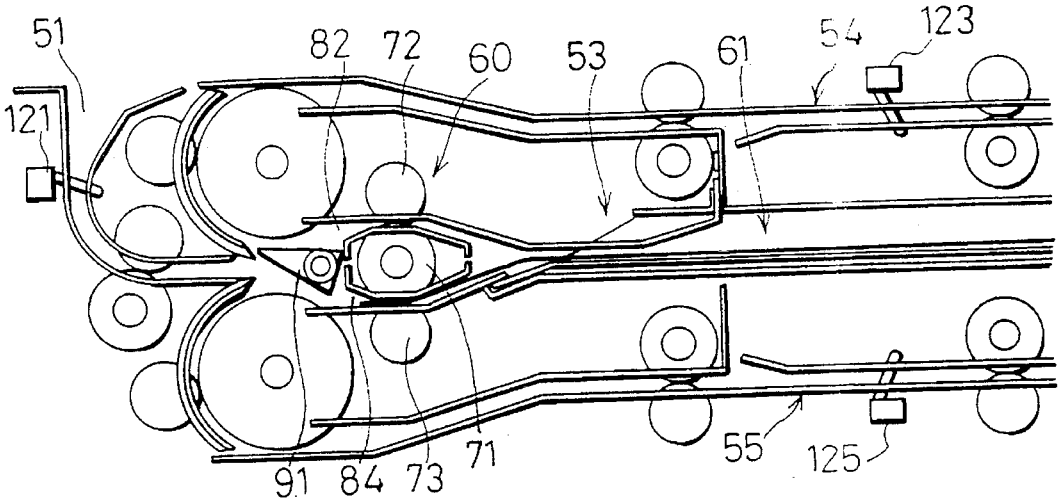
FIG. 15 is an explanatory view illustrating a state after the state of FIG. 14, in which the input of the sheet to the sheet feed position is completed.

In this case, when the switching gate 91 is switched to the lower-input and upper-output position, as illustrated in FIG. 14, the sheet supplied from the sheet input path 51 is guided to the lower sheet passage 84. Next, the sheet is transported to the sheet feed position 61 by the lower separable roller 73 pressed against the reversible roller 71 and the reversible roller 71 rotating in the reverse direction. Then, the reversible roller 71 is stopped. In this state, as illustrated in FIG. 15, the trailing edge of the sheet is nipped between the reversible roller 71 and the lower separable roller 73. In this case, the reversible roller 71 is stopped by the same control as mentioned above.

Figure 16:
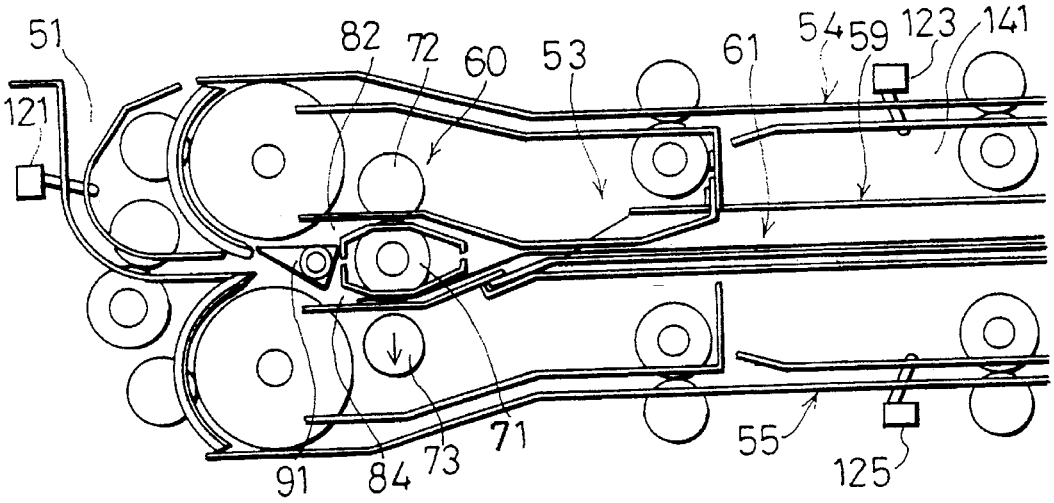
FIG. 16 is an explanatory view illustrating a state after the state of FIG. 15, in which the sheet is adjusted.

Thereafter, as illustrated in FIG. 16, the lower separable roller 73 is separated from the reversible roller 71 by several mm, and the adjusting plates 141 of the adjusting device 59 are moved to the adjusted positions. As a result, the sheet is located in the predetermined position.

Figure 17:
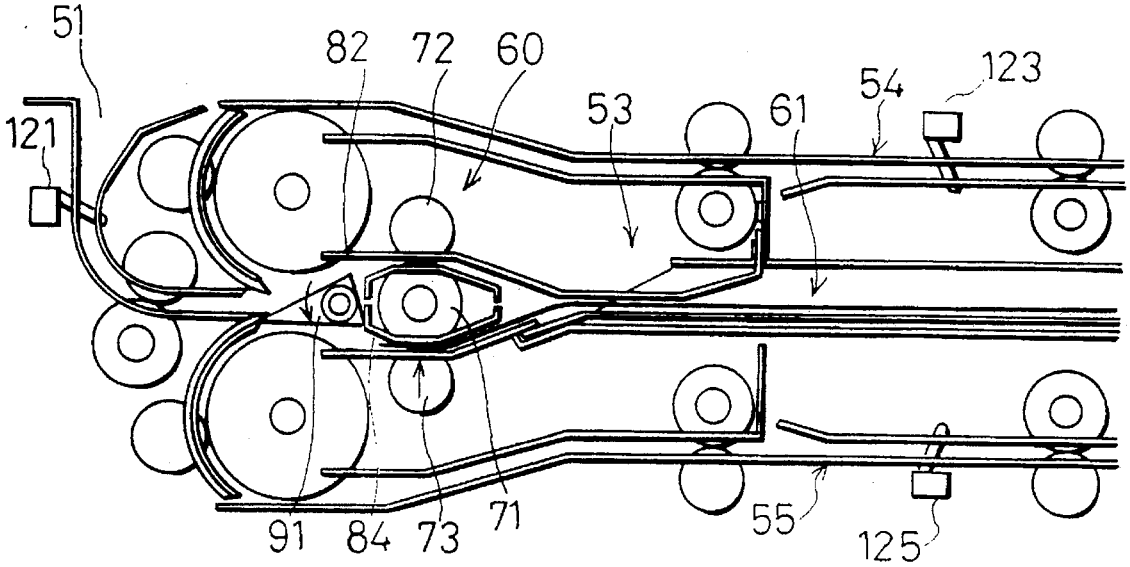
FIG. 17 is an explanatory view illustrating a state of the sheet before being output from the sheet feed position after the state of FIG. 16.

Subsequently, as illustrated in FIG. 17, the lower separable roller 73 is pressed against the reversible roller 71, and the switching gate 91 is switched to the upper-input and lower-output position. Then, the adjusting plates 141 return to the standby positions.

Figure 18:
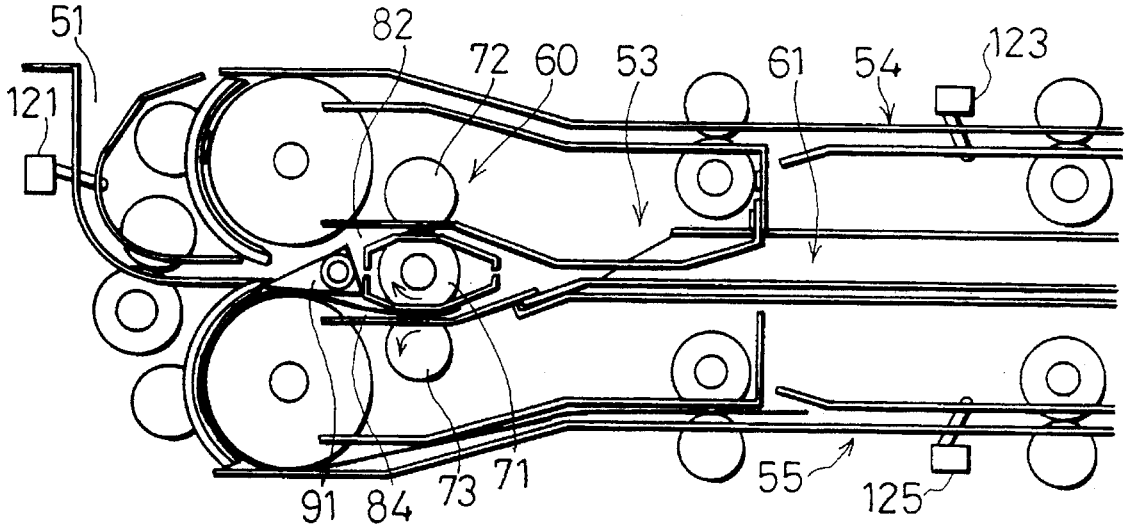
FIG. 18 is an explanatory view illustrating a state of the sheet being output to the lower reversing transport path from the sheet feed position after the state of FIG. 17.

Furthermore, as illustrated in FIG. 18, the reversible roller 71 rotates in the forward direction, and the sheet in the sheet feed position 61 is guided by the switching gate 91 and transported to the lower reversing transport path 55.

Next, the sheet is input into the lower reversing transport path 55 by the rotations of the lower first to third transport rollers 112 to 114. The sheet is then output from the sheet output path 52 at a predetermined time by the rotations of the lower fourth and fifth transport rollers 115 and 116, and supplied to the laser printer section 12.

Figure 19:
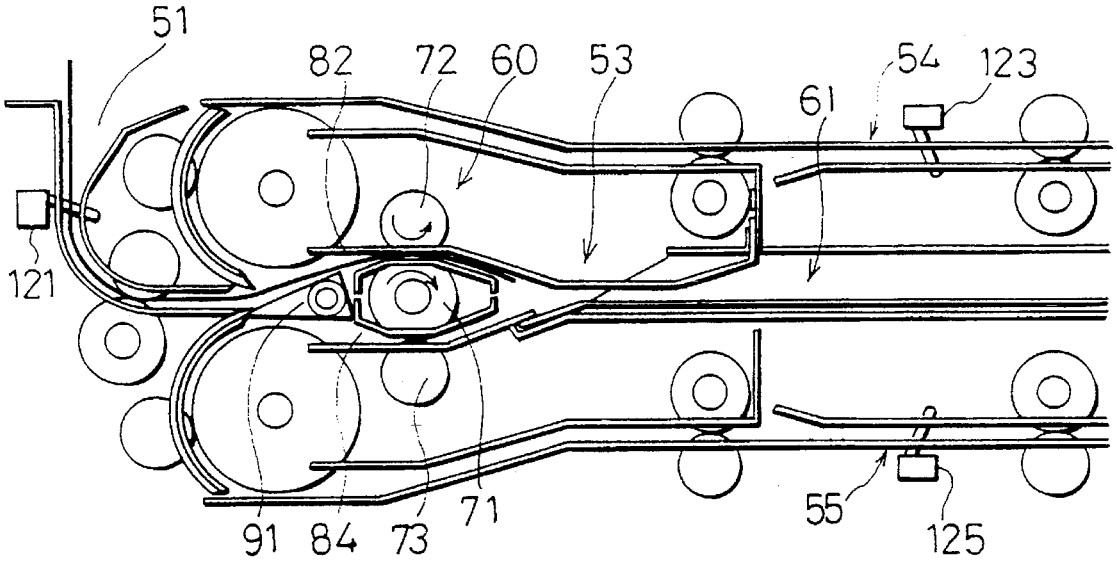
FIG. 19 is an explanatory view illustrating the state of the sheet being input to the sheet feed position through the upper sheet passage in the turnaround section after the state of FIG. 18.

As illustrated in FIG. 19, the third sheet is input to the sheet feed position 61 through the upper sheet passage 82. This operation is the same as that shown in FIG. 9, and then the above-mentioned operations are repeated. Namely, sheets successively supplied from the sheet input path 51 alternately pass through the upper sheet passage 82 and the lower sheet passage 84 according to a switching operation of the switching gate 91, and are fed to the sheet feed position 61. Thereafter, the sheets are output from the sheet feed position 61 to the upper reversing transport path 54 and the lower reversing transport path 55 alternately.

Figure 20:
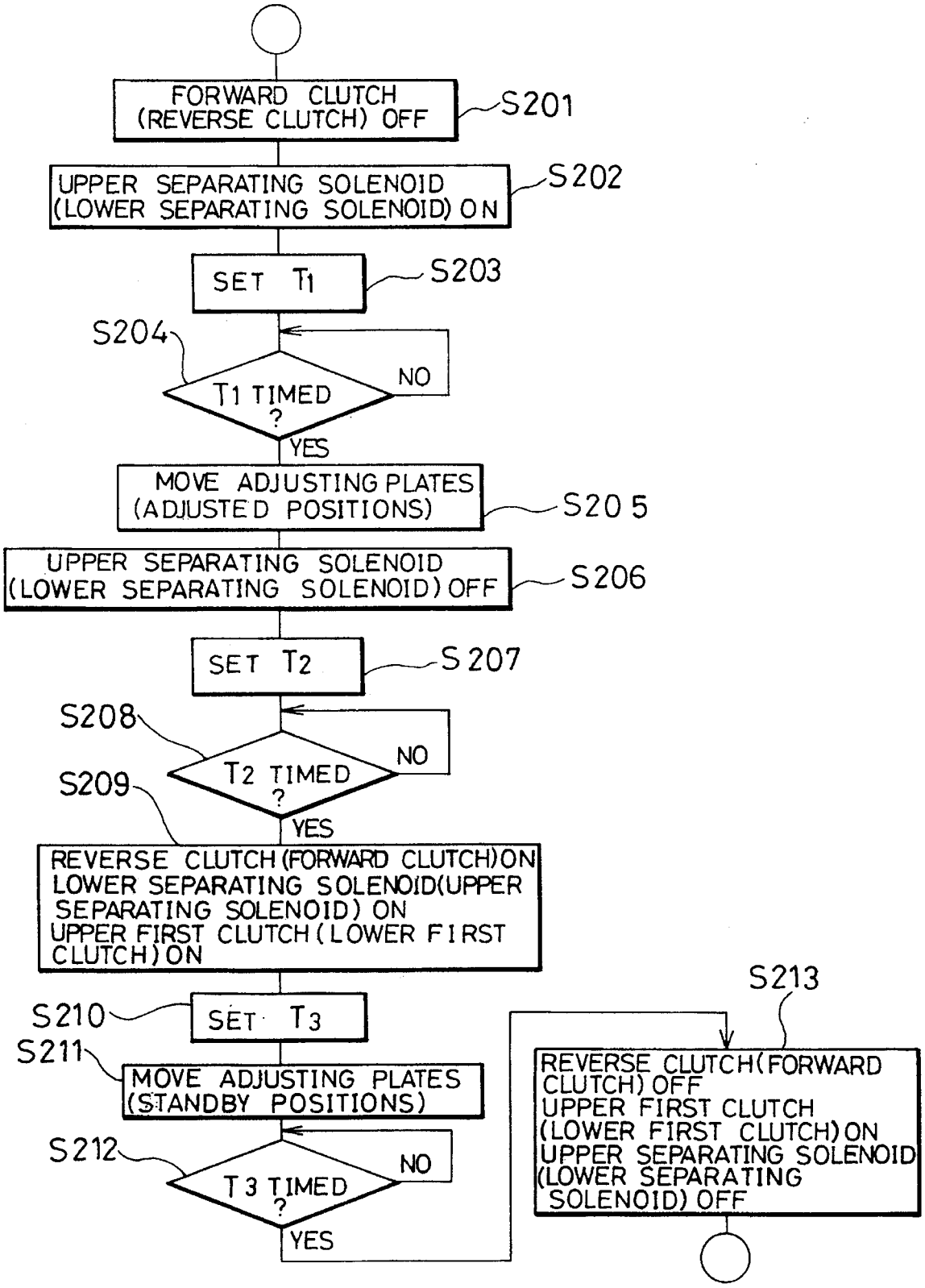
FIG. 20 is a flowchart explaining the operations of the adjusting device.

Referring now to the flowchart shown in FIG. 20, the following description discusses the operations of the adjusting device 59 controlled by the LDU controller 131.

In the adjusting device 59, when a power switch (not shown) or a door switch (not shown) is turned on, the adjusting motor 142 is rotated and the adjusting plates 141 are moved to the standby positions where they are detected by the adjusting-plate home position sensor 150. This operation is controlled by the LDU controller 131. The door switch is installed on a front door of the digital copying machine 10 provided for protection and maintenance purposes, and turned on when the front door is closed.

Upon an input to a control panel (not shown) or a detection operation of a document size sensor (nor shown), the size of a sheet to be used for copying is input to the LDU controller 131. Subsequently, when a copy start switch is turned on and feeding of sheet is started, the LDU controller 131 rotates the adjusting motor 142 in the forward direction so as to move the adjusting plates 141 to the standby positions. These positions are defined by arranging the distance between raised sections **141*a* shown in FIG. 4 of the adjusting plates 141, which come into contact with the side edges of a sheet when adjusted, to be 5 mm longer than the width of the sheet transported to the sheet feed position 61**.

With the above-mentioned operation, the adjusting device 59 promptly performs the subsequent adjusting operations. Moreover, since the standby positions are marginally set with respect to the sheet width, even if a sheet is obliquely fed to the sheet feed position 61 or a fed to a slightly shifted position, the sheet is not caught by the adjusting plates 141, thereby preventing a paper jam.

When the sheet is detected by the input path sheet sensor 121 and is transported to the sheet feed position 61 with the forward or reverse rotation of the reversible roller 71, the LDU controller 131 turns off the forward clutch 137 or the reverse clutch 138 so as to stop the rotation of the reversible roller 71 (step 201). Consequently, the sheet is stopped between the adjusting plates 141 in the standby positions. Moreover, the LDU controller 131 turns on the upper separating solenoid **78*c* or the lower separating solenoid 79*c* simultaneously with the operation of step 201 so as to separate the upper separable roller 72 or the lower separable roller 73 to which the sheet has been transported, from the reversible roller 71 (step 202**). As a result, the sheet becomes freely movable.

Next, the LDU controller 131 sets an internal timer therein for a time $T_1$ taken by the completion of operations of the reversible roller 71 and the upper separable roller 72 or the lower separable roller 73 (step 203). When the set time elapses (step 204), the LDU controller 131 rotates the adjusting roller 142 in the forward direction so as to move the adjusting plates 141 to adjusted positions corresponding to the size of the sheet (step 205). As a result, the sheet is located in the predetermined position. Namely, the sheet is adjusted to a correct position so that the sheet is stably transported from the sheet feed position 61. In this case, if the adjusting motor 142 is a pulse motor and moves the adjusting plates 141 by, for example, 0.25 mm with the rotations corresponding to one pulse, the adjusting motor 142 is rotated for a time period corresponding to 20 pulses.

When the movements of the adjusting plates 141 to the adjusted positions are completed, the LDU controller 131 immediately turns off the upper separating solenoid 78*c* or the lower separating solenoid 79*c* which was turned on in step 202 to press the upper separable roller 72 or the lower separable roller 73 against the reversible roller 71 (step 206). At this time, the LDU controller 131 sets the timer for a predetermined time T2 taken by pressing the upper separable roller 72 or the lower separable roller 73 against the reversible roller 71 in the operation of step 206 (step 207). When the set time elapses, as illustrated in FIG. 12 or 17, the sheet in the sheet feed position 61 is adjusted to the predetermined position and fixed so that the sheet is ready to be correctly transported from the sheet feed position 61.

When the set time elapses (step 208), the LDU controller 131 turns on the forward clutch 137 or the reverse clutch 138 to rotate the reversible roller 71 in a direction to which the sheet is to be output, and turns off the lower separating solenoid 79*c* or the upper separating solenoid 78*c* to separate from the reversible roller 71 the lower separable roller 73 or the upper separable roller 72, which is not in use. In addition, the LDU roller 131 turns on the upper first clutch 133 or the lower first clutch 135 to rotate the upper first to third transport rollers 107 to 109 or the lower first to third transport rollers 112 to 114 in the reversing transport path 54 or 55 being used for the transport of sheet (step 209). Then, the LDU controller 131 sets the timer for a predetermined time $T_3$ (step 210) and moves the adjusting plates 141 to the standby positions (step 211).

The reason for separating the lower separable roller 73 or the upper separable roller 72, which is not in use, from the reversible roller 71 in step 209 is to prevent transporting of a standby sheet that is stopped between the above-mentioned reversible roller 71 and the lower separable roller 73 or the upper separable roller 72. In this state, as to be described later, since the leading edge of the sheet is nipped between the upper first rollers 107 or the lower first rollers 108, the sheet can never fed in an oblique direction at the time the sheet comes into contact with the rotating reversible roller 71. Moreover, in step 211, the adjusting motor 142 is rotated in the reverse direction by a time period corresponding to 20 pulses. As a result, the adjusting plates 141 enter into the standby state for the transport of the next sheet to the sheet feed position 61.

Figure 21:
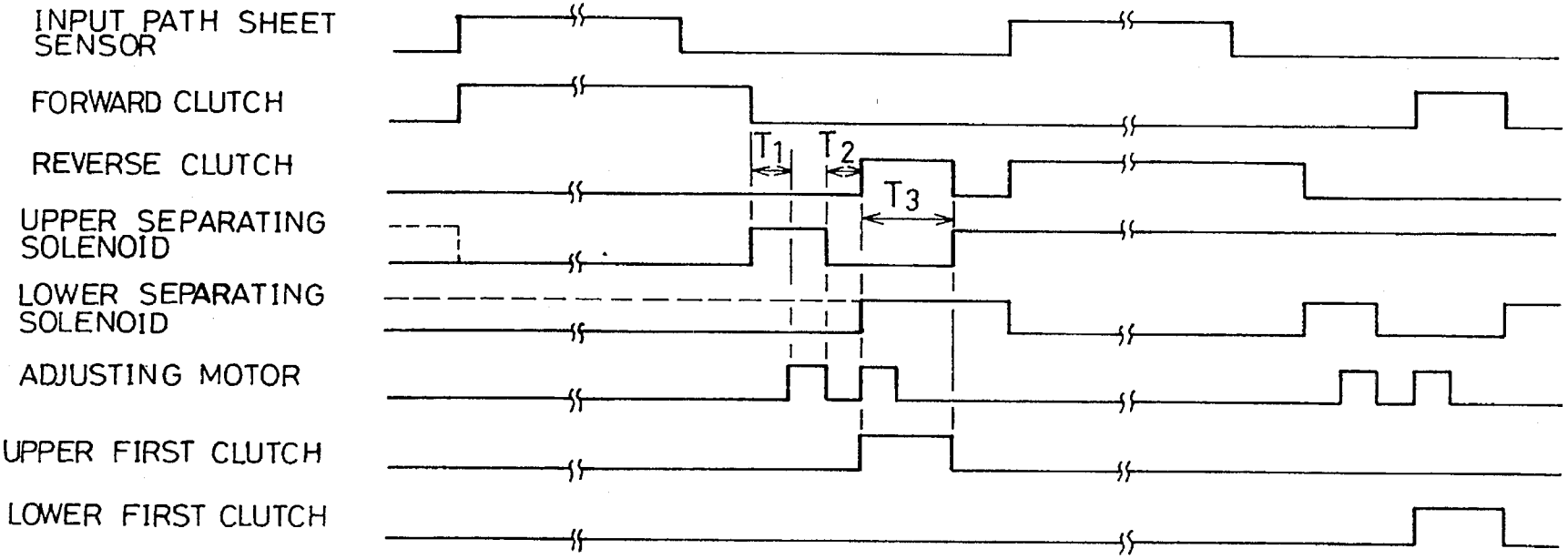
FIG. 21 is a timing chart explaining the operations of the adjusting device.

Furthermore, when the set time elapses (step 212), the LDU controller 131 turns off the forward clutch 137 or the reverse clutch 138 to stop the reversible roller 71, and turns off the upper first clutch 133 or the lower first clutch 135 to stop the upper first to third transport rollers 107 to 109 or the lower first to third transport rollers 112 to 114 in the reversing transport path 54 or 55 being used for the transport of sheet. In addition, the LDU controller 131 turns on the upper or lower separating solenoid 78*c* or 79*c* to separate the upper or lower separable roller 72 or 73 which has output the sheet from the reversible roller 71 (step 213). As a result, the sheet is stopped between the upper first transport rollers 107 or the lower first transport rollers 112. The timing of the operations is shown in FIG. 21.

Figure 8:
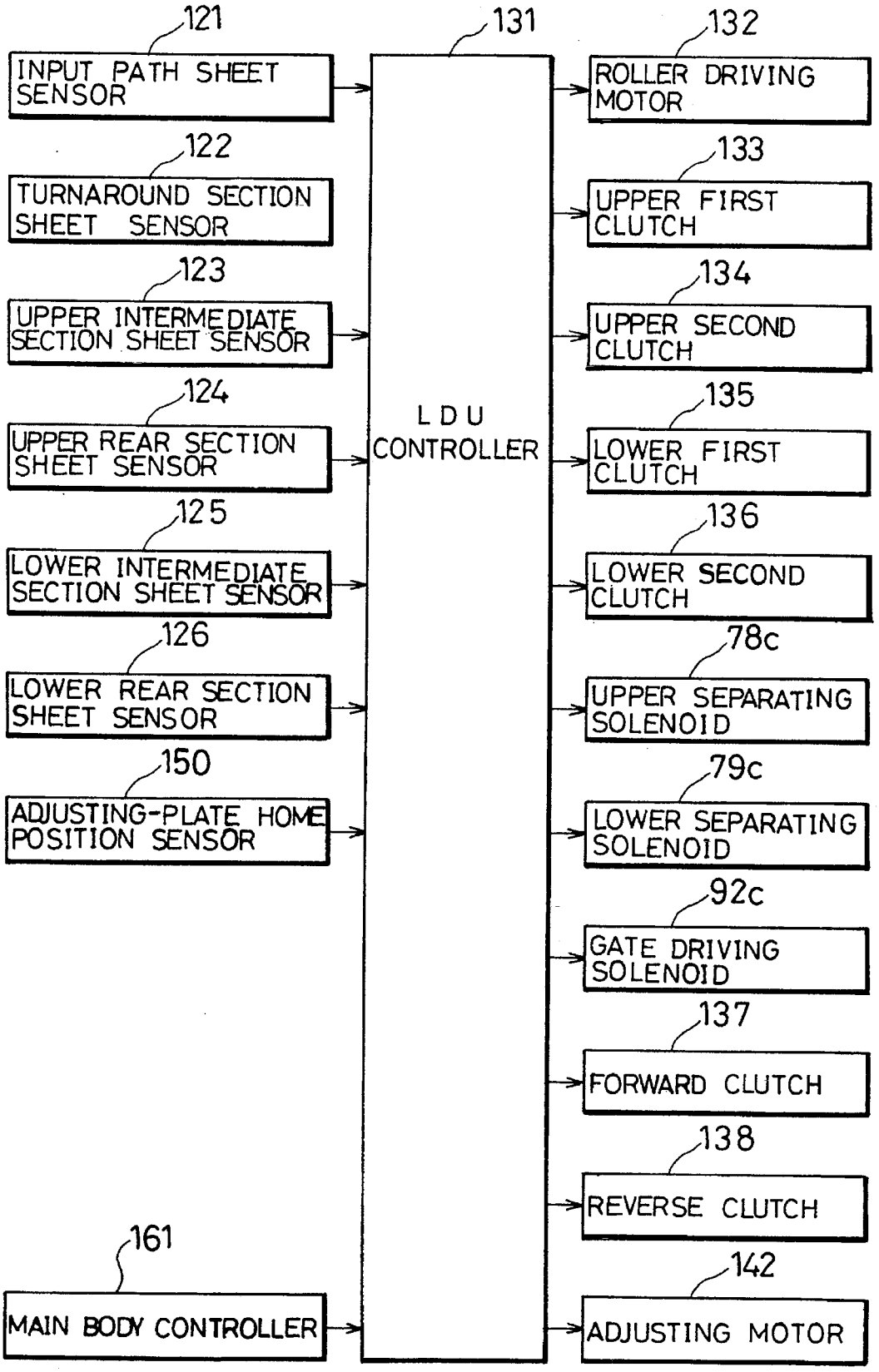
FIG. 8 is a block diagram showing the structure of a control system in the LDU.

Referring now to the flowcharts of FIGS. 22 to 30 and the timing charts of FIGS. 31 to 34, the following description discusses in detail the whole operations of the LDU 28 based on the control operations of the LDU controller 131 of FIG. 8.

Figure 31:
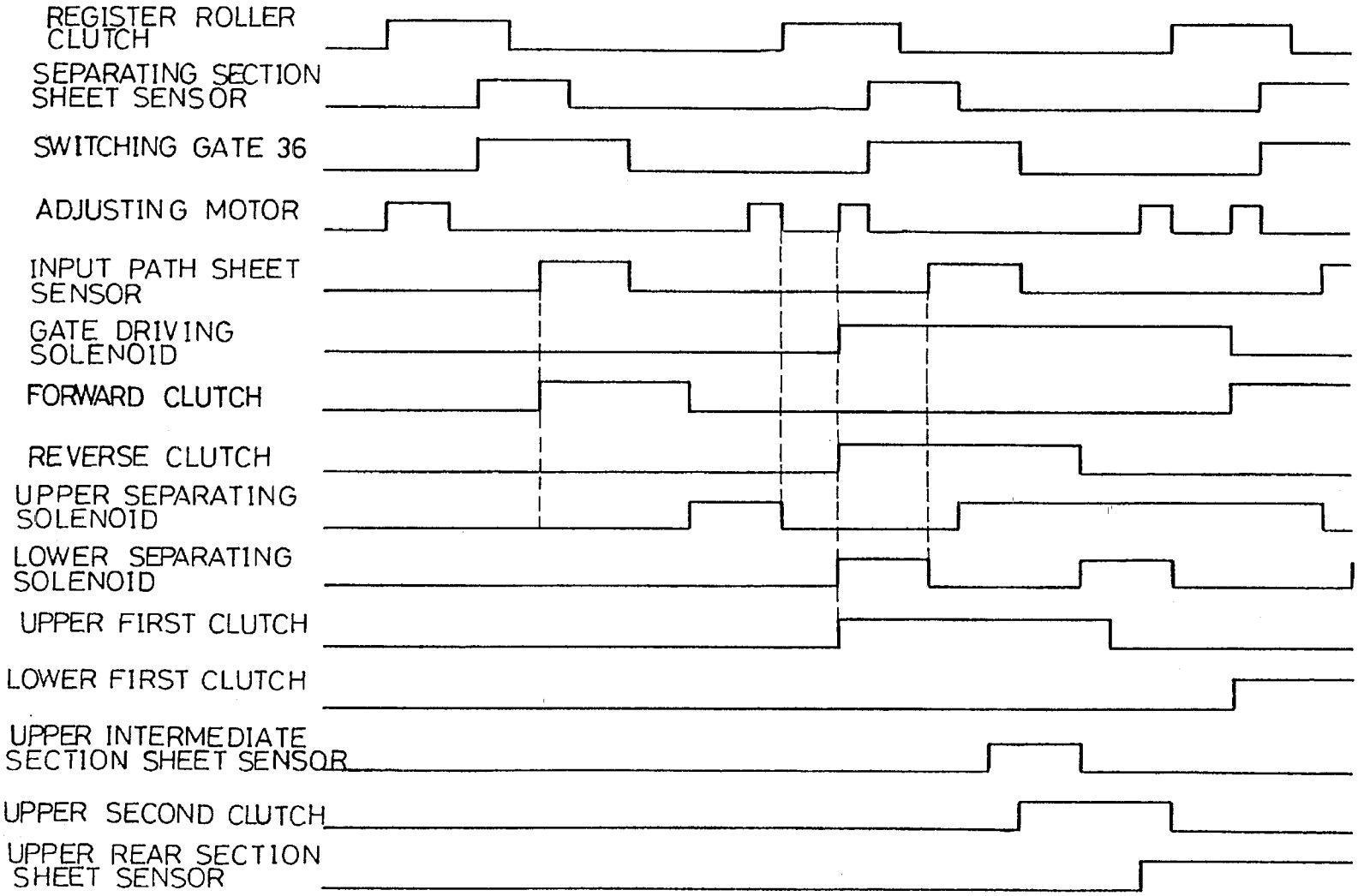
FIG. 31 is a timing chart showing operations of the respective sections of the LDU.
Figure 32:
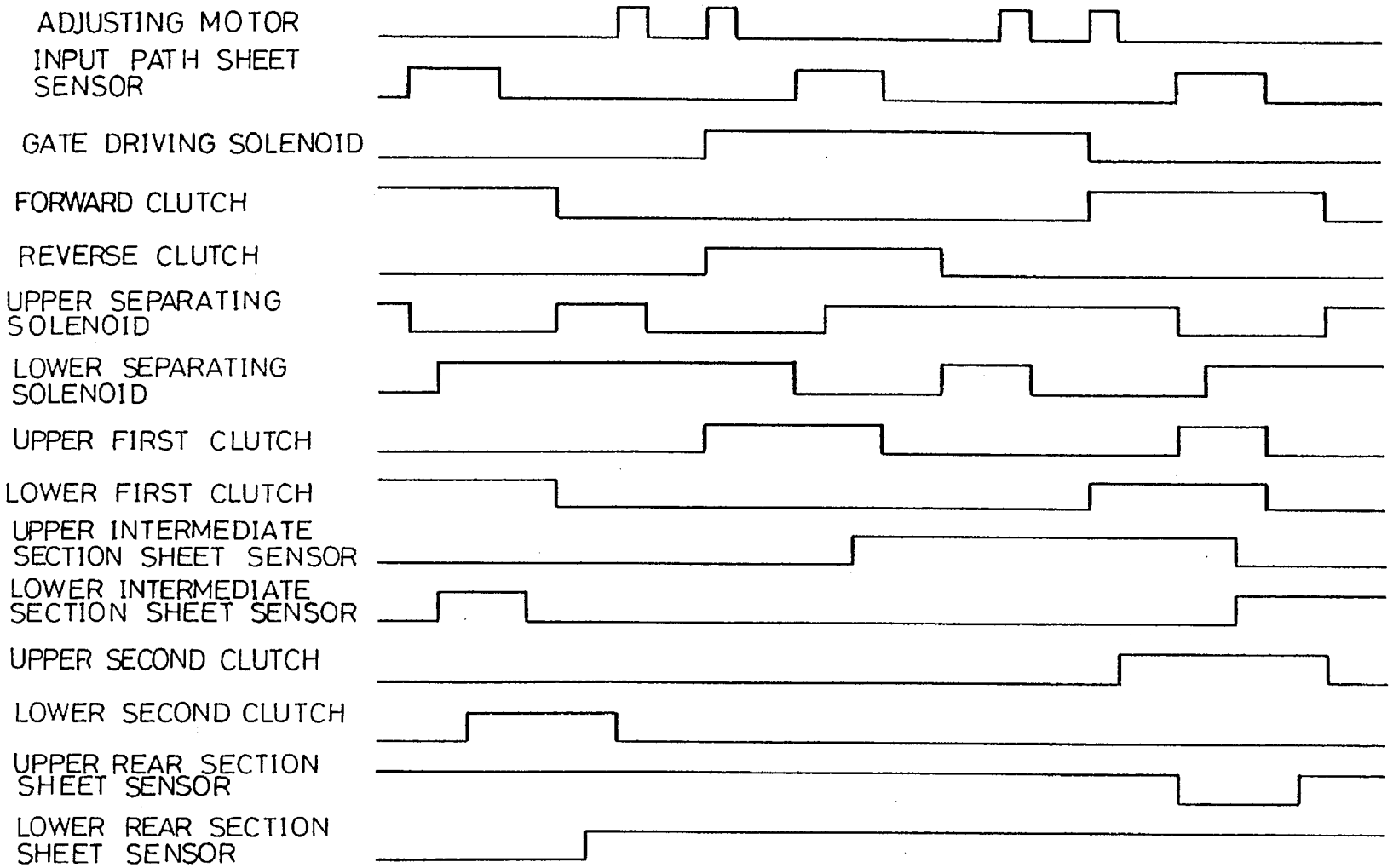
FIG. 32 is a timing chart showing the next operations of the respective sections of the LDU after the operations of FIG. 31.
Figure 33:
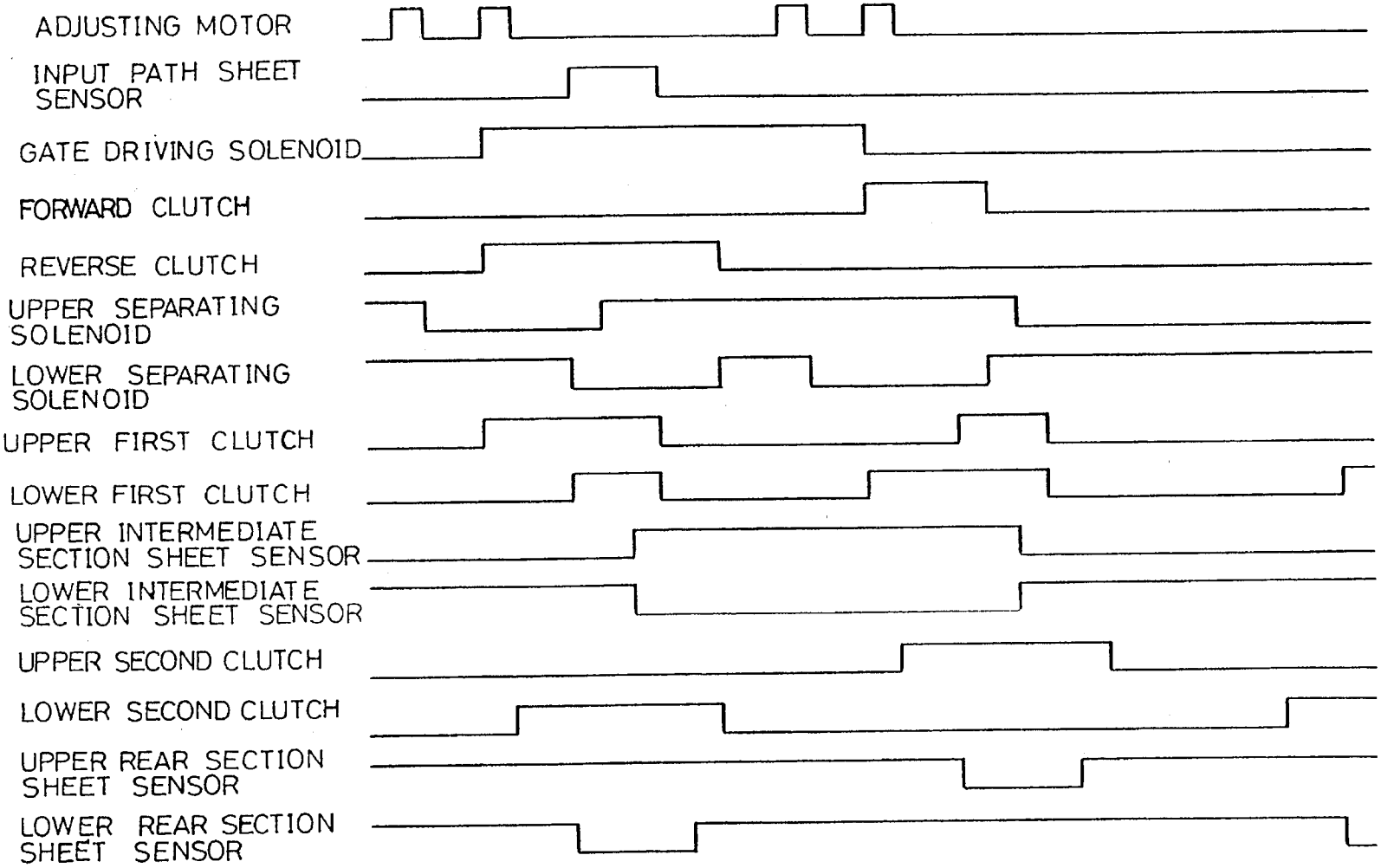
FIG. 33 is a timing chart showing the next operations of the respective sections of the LDU after the operations of FIG. 32.
Figure 34:
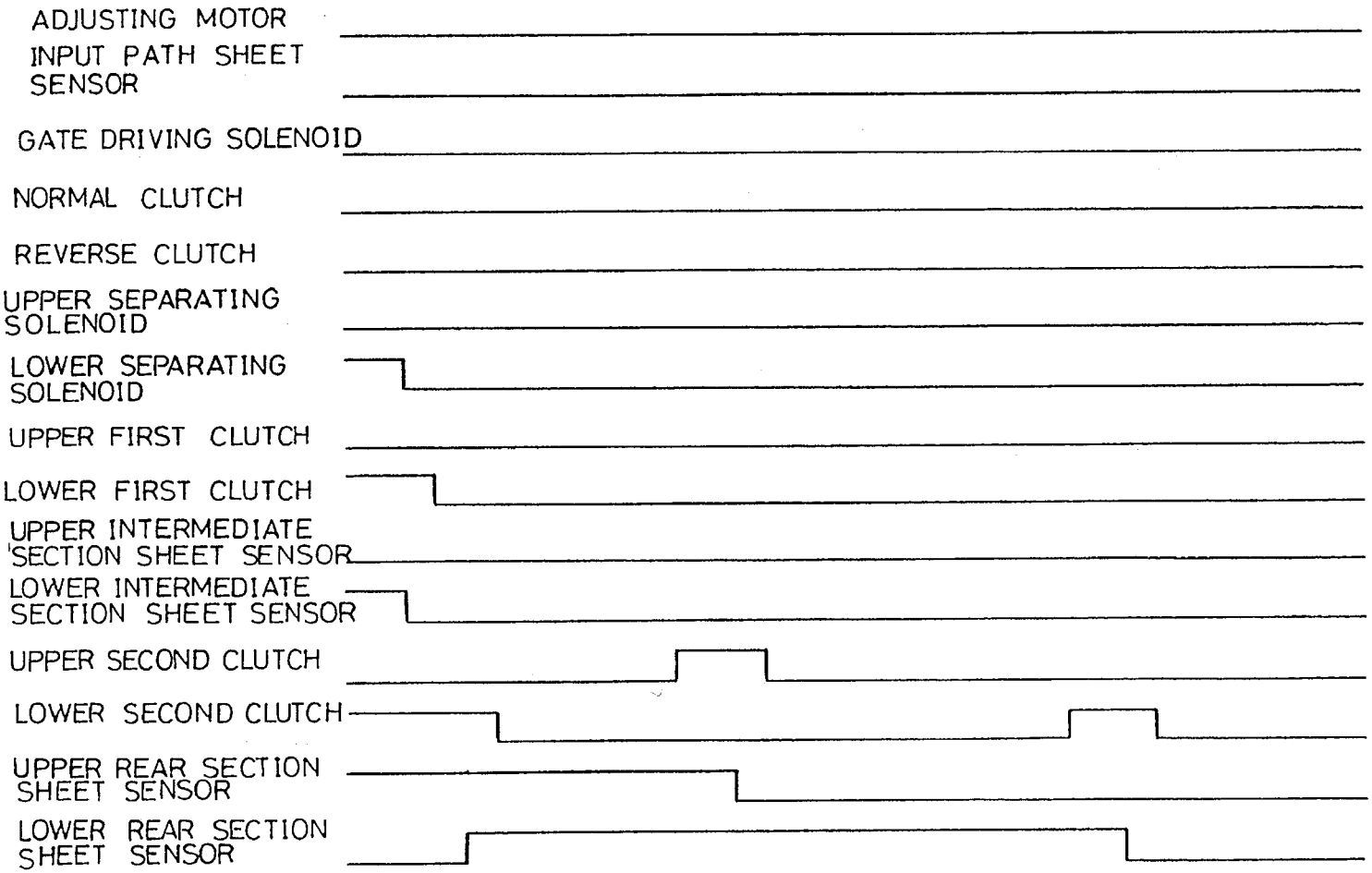
FIG. 34 is a timing chart showing the next operations of the respective sections of the LDU after the operations of FIG. 33.
Figure 35:
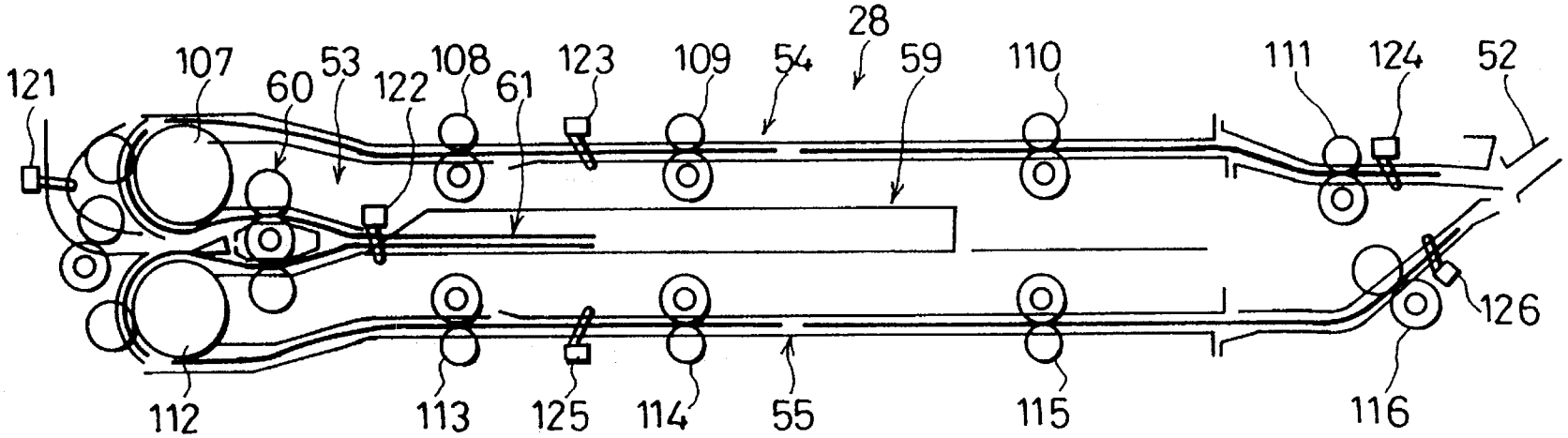
FIG. 35(*a*) is an explanatory view illustrating a state in which the LDU holds six A4-size laterally-fed sheets, and FIG. 35(*b*) is an explanatory view illustrating a state in which the LDU holds four A4-size longitudinally-fed sheets.
Figure 35:
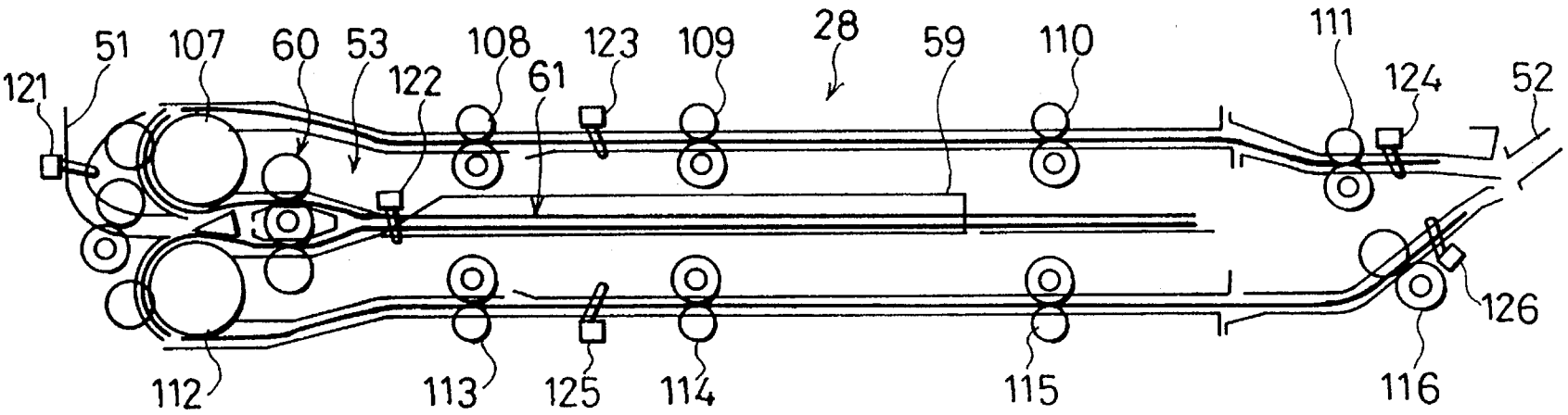
Figure 36:
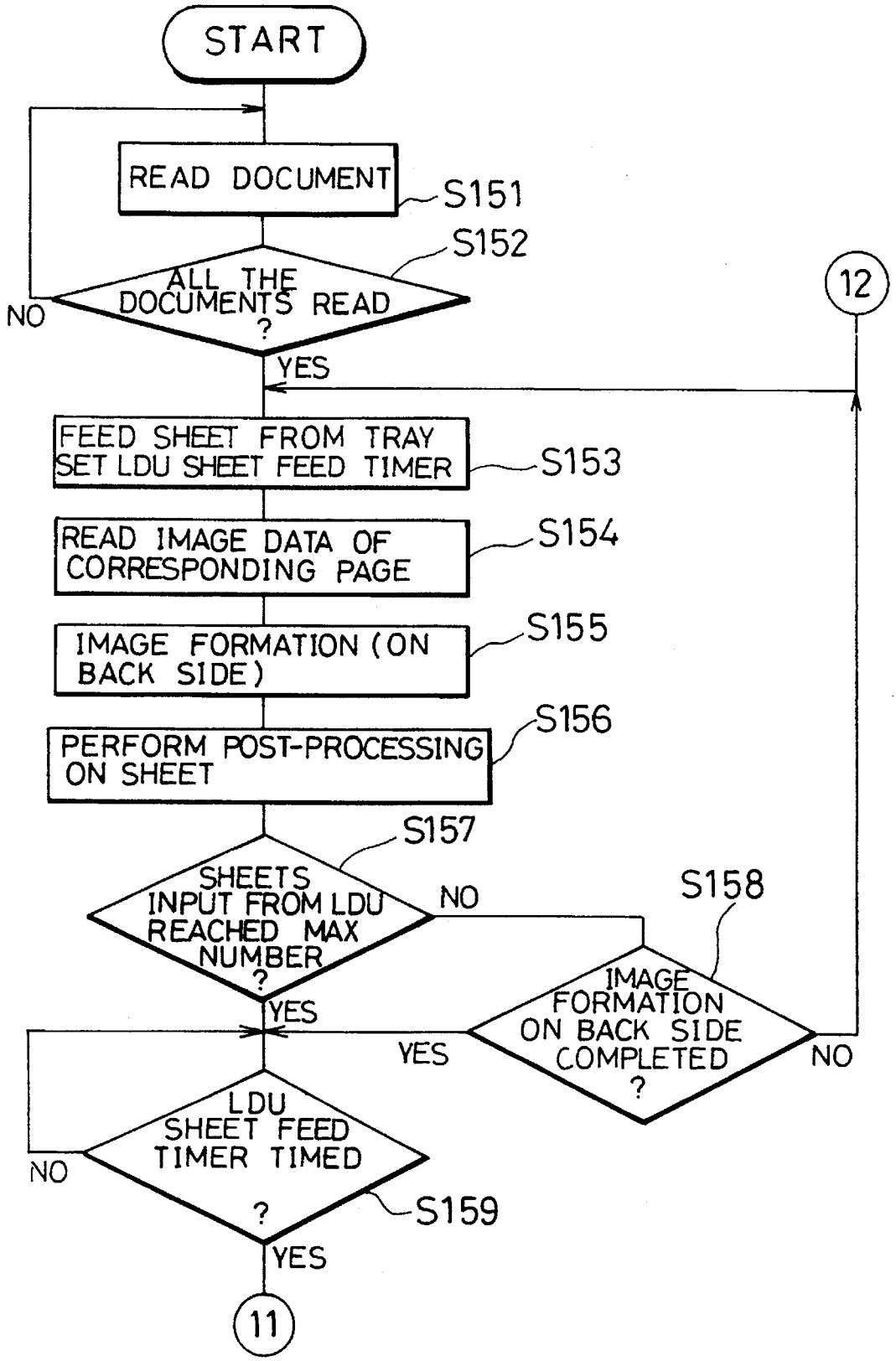
FIG. 36 is a flowchart of linkage operations between the LDU and the main body of the digital copying machine.
Figure 37:
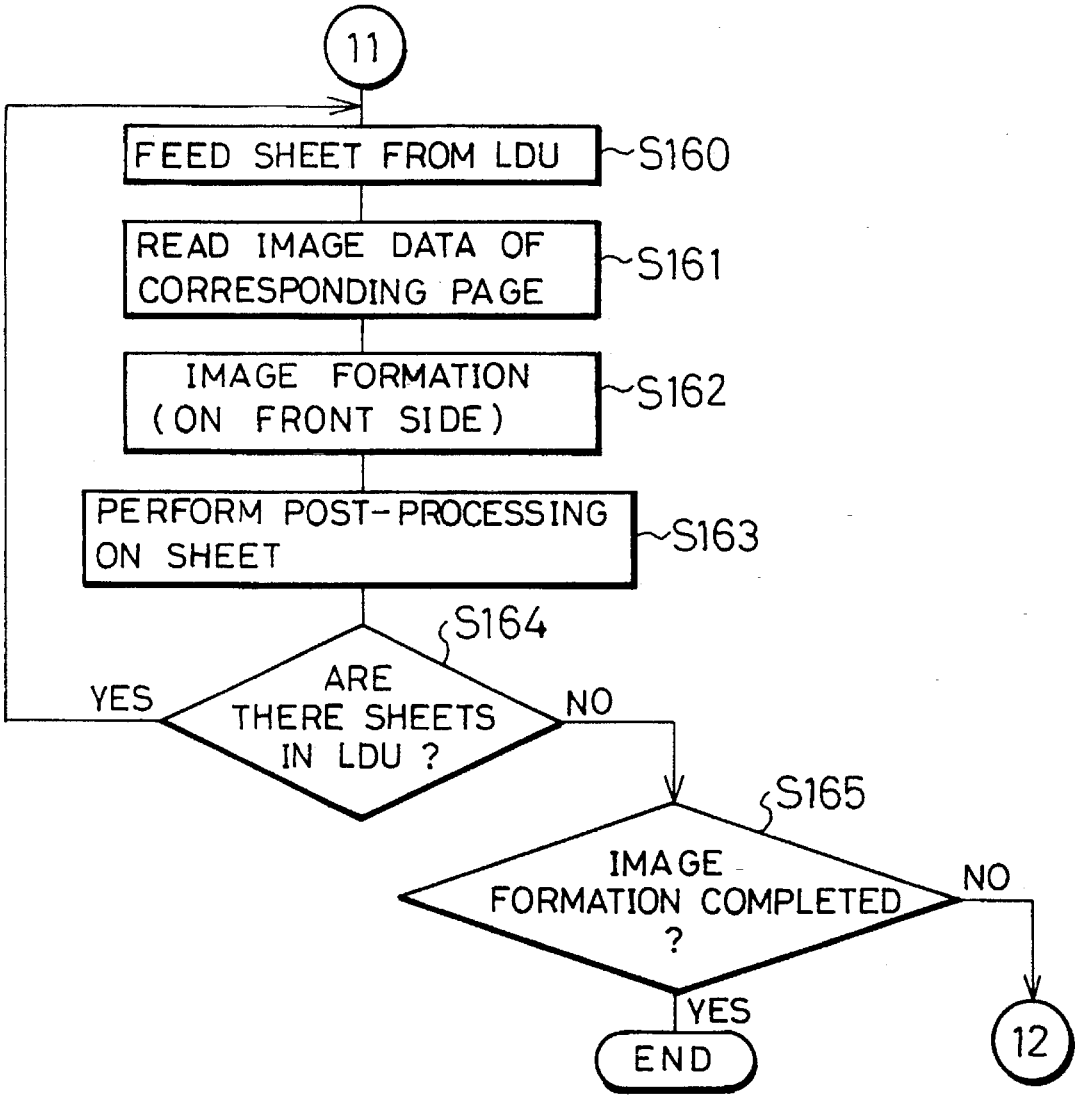
FIG. 37 is a flowchart of the next linkage operations between the LDU and the main body of the digital copying machine after the operations of FIG. 36.

In the LDU 28, the sheet is held as shown in FIGS. 35(*a*) and 35(*b*), and then successively transported. FIGS. 31 to 34 show an example in which six sheets are subsequently held in the upper and lower reversing transport paths 54 and 55 in the manner as shown in FIG. 35(*a*). A register roller clutch operated at the operational timing shown in FIG. 31 transmits the driving force of a driving source (not shown) to the register roller 40. The register roller 40 is rotated by turning on the register roller clutch. A separating section sheet sensor (not shown) operated at the operational timing shown in FIG. 31 is disposed on the sheet transporting side of the separating device 27*e* and detects the passage of sheet.

Figure 22:
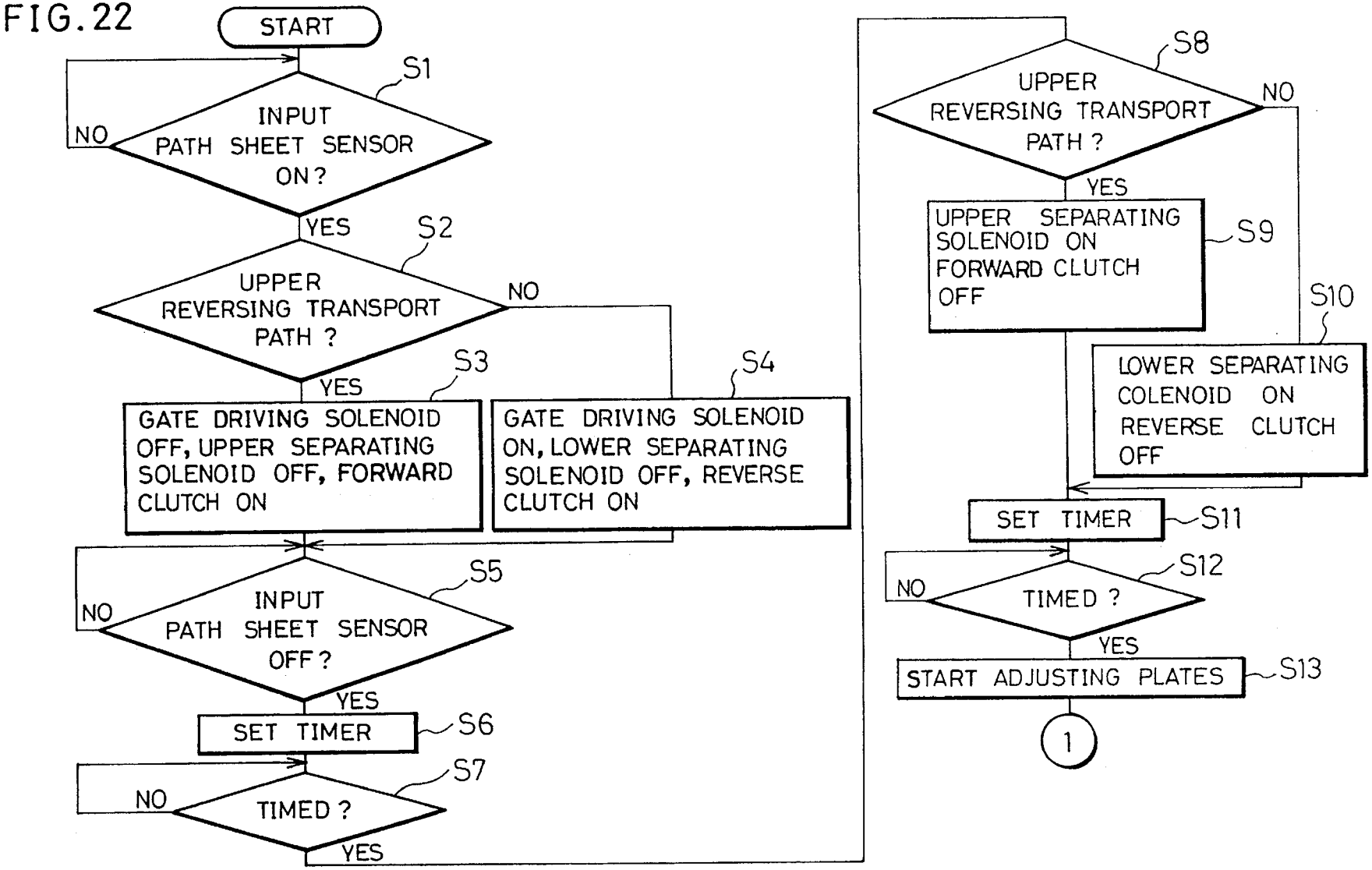
FIG. 22 is a flowchart showing the operations of LDU of FIG. 2.

The operations shown in steps 9 to 22 of FIG. 22 correspond to the above-mentioned operations shown in FIG. 20.

In the digital copying machine 10, when a double-side copying mode is set, first, a toner image is formed on a surface of a photoreceptor drum 27*a* through a predetermined copying process in the laser printer section 12 shown in FIG. 1. Then, as illustrated in FIG. 31, when the register roller clutch is turned on (see "REGISTER ROLLER CLUTCH" in FIG. 31), the adjusting plates 141 of the adjusting device 59 return to the standby positions (see "SEPARATING SECTION SHEET SENSOR" in FIG. 31).

When the register roller clutch is turned on, the register roller 40 rotates, and a sheet held by the register roller 40 is transported to a section between the photoreceptor drum 27*a* and the transfer device 27*d*. Next, the toner image on the surface of the photoreceptor drum 27*a* is transferred to the sheet by the transfer device 27*d*, and the sheet is separated from the surface of the photoreceptor drum 27*a* by the separating device 27*e*. Thereafter, the sheet is fed to the fixing device 32 and subjected to a fixing operation. After the fixing operation, the sheet is guided to the transport path 35 by the switching gate 36, and transported to the sheet input path 51.

Meanwhile, when the leading edge of the sheet which has passed the separating device 27*e* is detected by the separating section sheet sensor (see "SEPARATING SECTION SHEET SENSOR" in FIG. 31), the switching gate 36 is switched so that the sheet is guided toward the transport path 35 (see "SWITCHING GATE 36" in FIG. 31).

Then, as illustrated in FIG. 22, when the entry of the sheet to the sheet input path 51 is detected by the input path sheet sensor 121 (step 1), the LDU controller 131 judges whether the upper reversing transport path 54 is to be used, i.e., whether the upper reversing transport path 54 or the lower reversing transport path 55 is to be used for transporting the sheet (step 2). The LDU 28 transports sheets by alternately using the upper reversing transport path 54 and the lower reversing transport path 55 according to the judgement.

In this case, if the upper reversing transport path 54 is to be used, the LDU controller 131 turns off the gate driving solenoid 92*c* in the sheet guiding device 56, and switches the switching gate 91 to the upper-input and lower-output position. Moreover, the LDU controller 131 turns off the upper separating solenoid 78*c* in the separation driving device 78 to press the upper separable roller 72 against the reversible roller 71, and turns on the forward clutch 137 to rotate the reversible roller 71 in the forward direction (step 3).

On the other hand, if the lower reversing transport path 55 is to be used in step 2, the LDU controller 131 turns on the gate driving solenoid 92*c* and switches the switching gate 91 to the lower-input and upper-output position. Then, the LDU controller 131 turns off the lower separating solenoid 79*c* to press the lower separable roller 73 against the reversible roller 71, and turns on the reverse clutch 138 to rotate the reversible roller 71 in the reverse direction (step 4).

Thereafter, when the input path sheet sensor 121 is turned off after the passage of the sheet (step 5), the LDU controller 131 sets the internal timer for a time taken by bringing the sheet to the sheet feed position 61 and the trailing edge of the sheet to be held between the reversible roller 71 and the upper separable roller 72, i.e., by bringing the sheet into the state shown in FIG. 10 (step 6). When the set time elapses (step 7), if the upper reversing transport path 54 is in use (step 8), the LDU controller 131 turns on the upper separating solenoid 78*c* to separate the upper separable roller 72 from the reversible roller 71, and turns off the forward clutch 137 to stop the reversible roller 71 (step 9).

On the other hand, when the lower reversing transport path 55 is in use (step 8), the LDU controller 131 turns on the lower separating solenoid 79*c* to separate the lower separable roller 73 from the reversible roller 71, and turns off the reverse clutch 138 to stop the reversible roller 71 (step 10).

Thereafter, the LDU controller 131 sets the timer for a time taken by the completion of the operation in step 9 or 10 (step 11). When the set time elapses, for example, as illustrated in FIG. 11 or 16, the fixed state of the sheet is released.

When the set time elapses (step 12), the LDU controller 131 rotates the adjusting motor 142 to move the adjusting plates 141 to the adjusted positions (step 13). The adjusted positions vary depending on the sizes of sheets.

Figure 23:
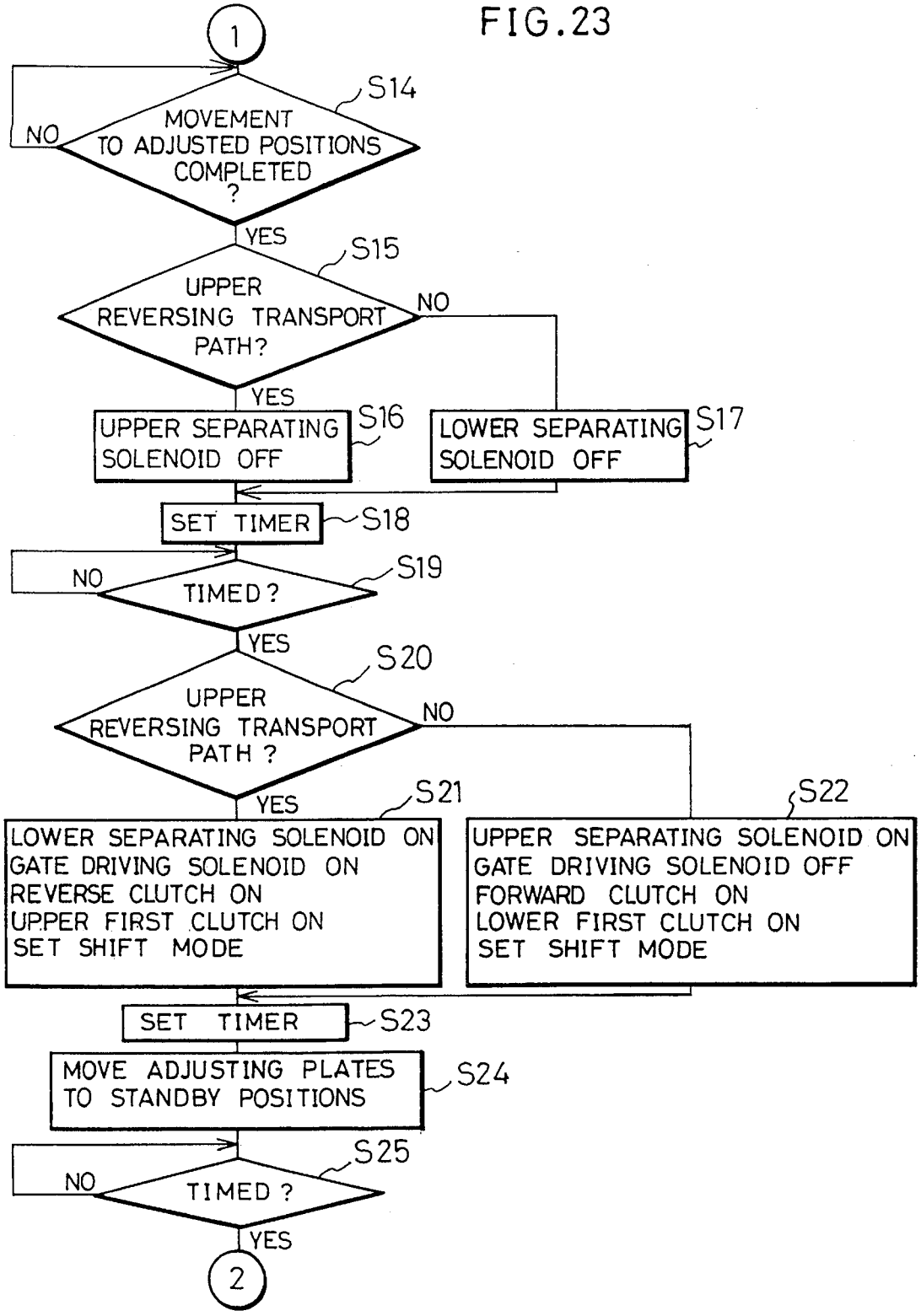
FIG. 23 is a flowchart showing the next operations of the LDU after the operations of FIG. 22.

As illustrated in FIG. 23, when the movements of the adjusting plates 141 to the adjusted positions are completed (step 14), if the upper reversing transport path 54 is in use (step 15), the LDU controller 131 immediately turns off the upper separating solenoid 78*c* (step 16). On the other hand, if the lower reversing transport path 55 is in use (step 15), the LDU controller 131 immediately turns off the lower separating solenoid 79*c* (step 17).

Next, the LDU controller 131 sets the timer for a time taken by pressing the upper separable roller 72 or the lower separable roller 73 against the reversible roller 71 in the operation of step 17 or 18 (step 18). When the set time elapses, as illustrated in FIG. 12 or 17, the sheet in the sheet feed position 61 is adjusted and fixed in the predetermined position.

When the set time elapses (step 19), if the upper reversing transport path 54 is in use (step 20), the LDU controller 131 turns on the lower separating solenoid 79*c* to separate the lower separable roller 73 from the reversible roller 71, and turns on the gate driving solenoid 92*c* to switch the switching gate 91 to the lower-input and upper-output position. Moreover, the LDU controller 131 turns on the reverse clutch 138 to rotate the reversible roller 71 in the reverse direction. Furthermore, the LDU controller 131 turns on the upper first clutch 133 to rotate the upper first to third transport rollers 107 to 109, and sets a shift mode (step 21).

On the other hand, when the lower reversing transport path 55 is in use, the LDU controller 131 turns on the upper separating solenoid 78*c* to separate the upper separable roller 72 from the reversible roller 71. Moreover, the LDU controller 131 turns off the gate driving solenoid 92*c* to switch the switching gate 91 to the upper-input and lower-output position. Furthermore, the LDU controller 131 turns on the forward clutch 137 to rotate the reversible roller 71 in the forward direction, turns on the lower first clutch 135 to rotate the lower first to third transport rollers 112 to 114, and sets the shift mode (step 22).

The sheet in the sheet feed position 61 is fed to the upper reversing transport path 54 or the lower reversing transport path 55 by the operation in step 21 or 22.

The reason for separating one of the upper and lower separable rollers 72 and 73, which is not in use in outputting the sheet, from the reversible roller 71 in the operation in step 21 or 22 is as follows. With this arrangement, when the sheet ready for output is nipped between the reversible roller 71 and the lower or upper separable roller 73 or 72, which is not being used for the output of the sheet, the movement of the sheet is prevented.

At this time, the position of the switching gate 91 and the rotating direction of the reversible roller 71 are selected so that the sheet is input to the sheet feed position 61 through one of the lower and upper sheet passages 83 and 82, which is not being used for outputting the sheet. Therefore, when the input and output of sheets are simultaneously performed, the lower separable roller 72 or the upper separable roller 73 on the sheet input side is pressed against the reversible roller 71.

In the shift mode, when feeding a sheet, if there is another sheet to be input to the upper reversing transport path 54, the former sheet being transported is controlled to be shifted in a forward direction, for example, by about 30 mm to feed the latter sheet to a position where it is nipped between the upper first transport rollers 107, thereby preventing the sheets from overlapping.

Figure 24:
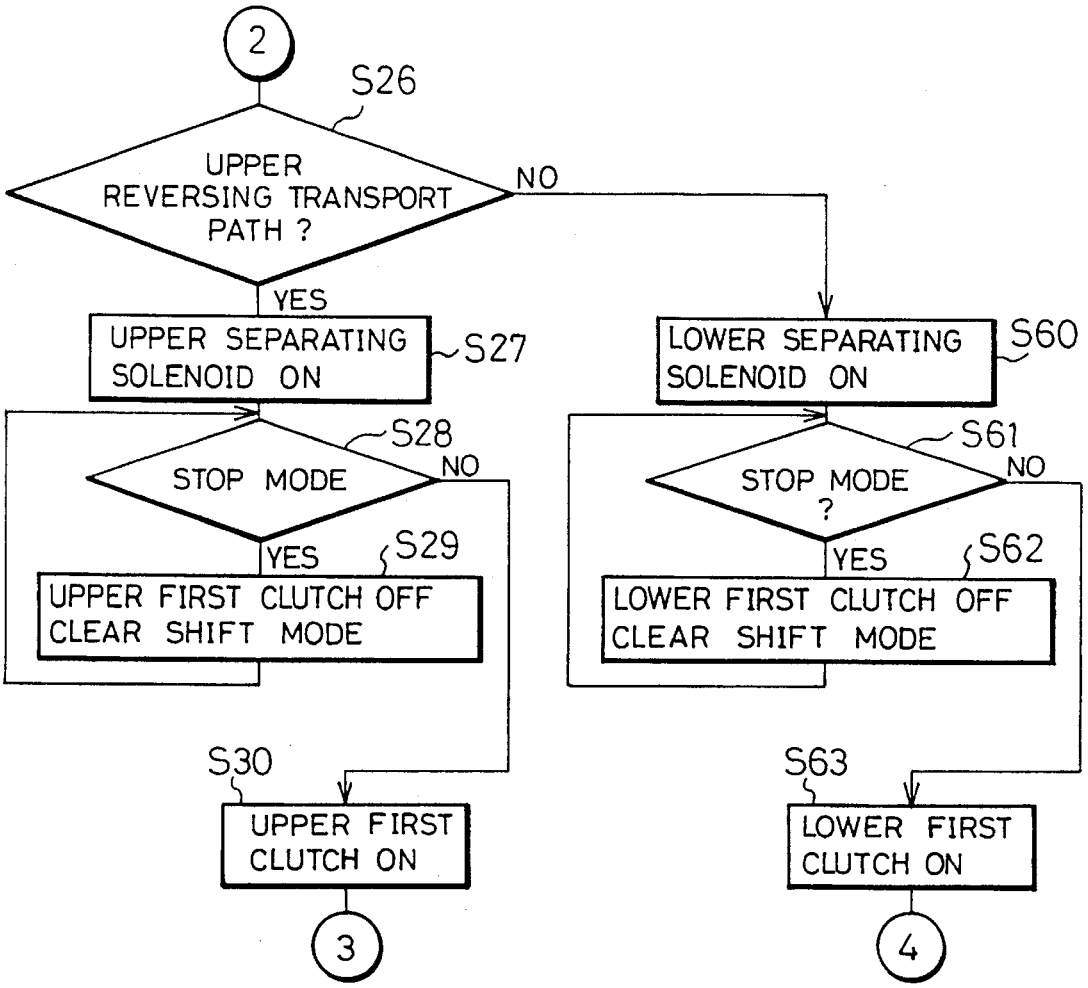
FIG. 24 is a flowchart showing the next operations of the LDU after the operations of FIG. 23.

Next, the LDU controller 131 sets the timer for a time taken from the start of outputting the sheet from the sheet feed position 61 to the transport of sheet to the above-mentioned position where the sheet is satisfactorily nipped between the upper first transport rollers 107 or the lower first transport rollers 112 (step 23). Then, the LDU controller 131 moves the adjusting plates 141 to the standby positions (step 24). When the set time elapses (step 25), as illustrated in FIG. 24, if the upper reversing transport path 54 is in use (step 26), the LDU controller 131 turns on the upper separating solenoid 78*c* to separate the upper separable roller 72 from the reversible roller 71 (step 27). In this state, since the sheet is nipped between the upper first transport rollers 107, it is not transported even if the reversible roller 71 is rotated. It is therefore possible to transport the next sheet to the sheet feed position 61 through the lower sheet passage 84 by the reversible roller 71 and the lower separable roller 73.

When inputting a sheet in the upper reversing transport path 54, if another sheet exists in a forward position in the transporting direction, a stop mode for stopping the transport of sheet is set (step 28) in order to prevent the sheets from overlapping. Then, the LDU controller 131 turns off the upper first clutch 133 to stop the upper first to third transport rollers 107 to 109, and clears the shift mode (step 29). To more specifically explain the above-mentioned state, for instance, if the upper reversing transport path 54 is capable of holding three sheets, the state is observed when the third sheet is to be input into the upper reversing transport path 54. In this case, the sheets are detected by the upper intermediate section sheet sensor 123 and the upper rear section sheet sensor 124, respectively. It is also possible to input the sheet to the sheet feed position 61 through the lower sheet passage 84 by the reversible roller 71 rotating in the reverse direction and the lower separable roller 73 pressed against the reversible roller 71.

On the other hand, when inputting a sheet in the upper reversing transport path 54, if there is no sheet in a forward position in the transporting direction, the transport of sheet is not stopped, i.e., the stop mode is not set. Then, the LDU controller 131 turns on the upper first clutch 133 to continue the transport of sheet (step 30).

Figure 25:
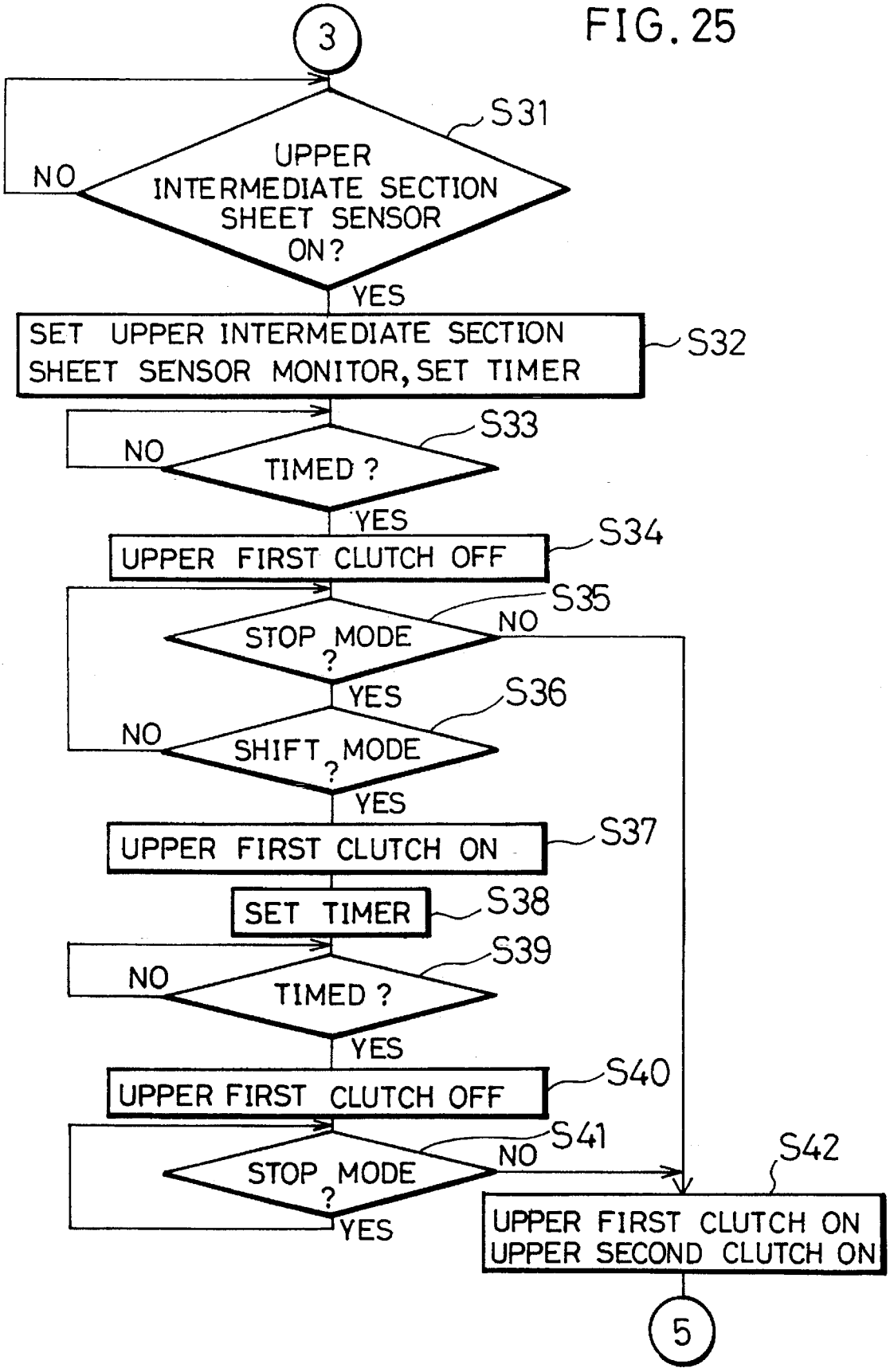
FIG. 25 is a flowchart showing the next operations of the LDU after the operations of FIG. 24.

Thereafter, as illustrated in FIG. 25, when the leading edge of the sheet is detected by the upper intermediate section sheet sensor 123 (step 31), the LDU controller 131 sets an upper intermediate section sheet sensor monitor, and sets the timer for a predetermined time (step 32).

Figure 29:
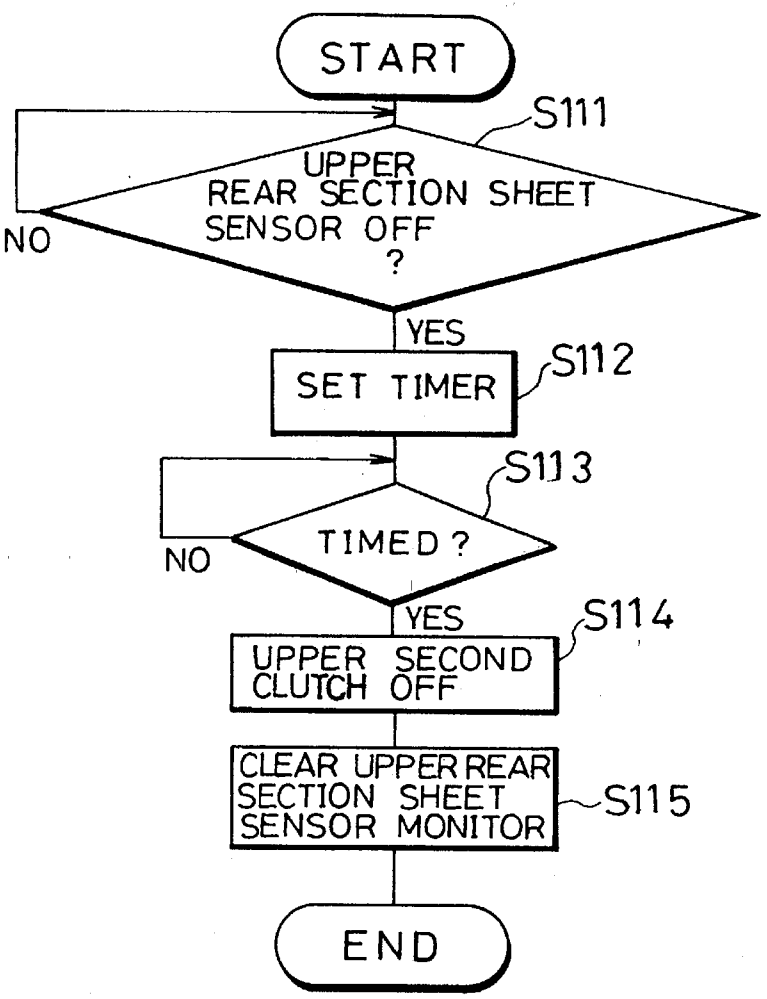
FIG. 29(*a*) is a flowchart explaining the operations of step 32 in FIG. 25, and FIG. 29(*b*) is a flowchart explaining the operations of step 44 in FIG. 26.
Figure 29A:
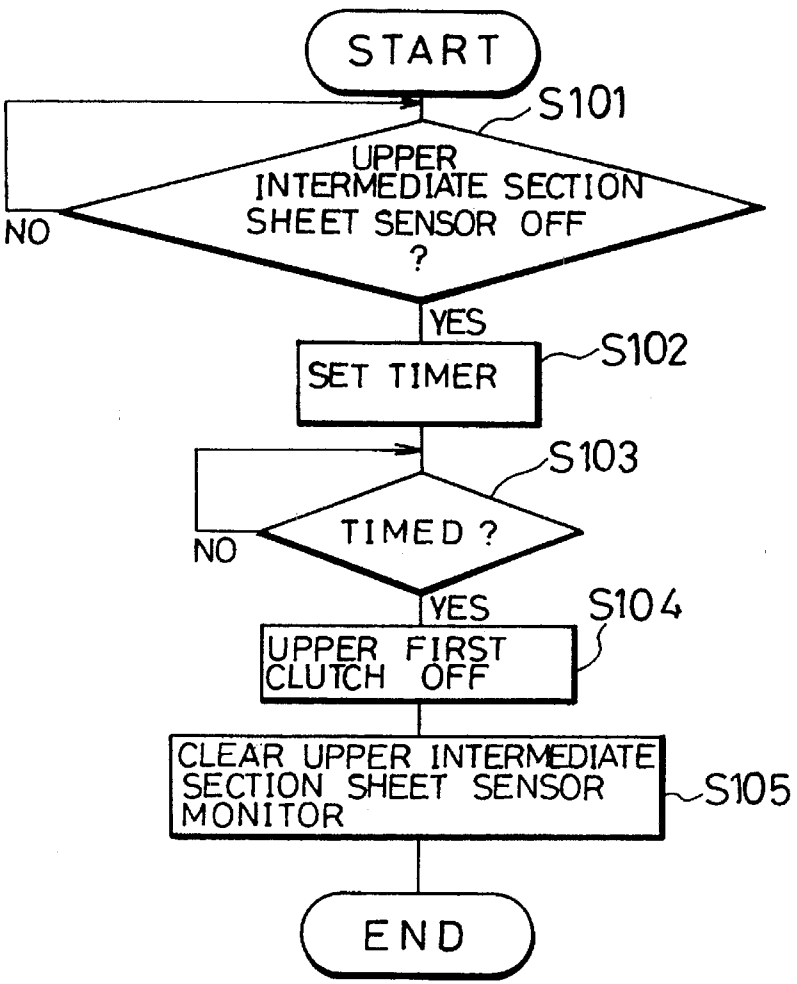

The upper intermediate section sheet sensor monitor is controlled in the manner shown in the flowchart of FIG. 29(*a*). When the upper intermediate section sheet sensor monitor 123 is turned off, i.e., when the sheet passes through the upper intermediate section sheet sensor 123 (step 101), the LDU controller 131 sets the timer for a predetermined time, for example, the time taken to further transport the sheet to a more suitable position (step 102). When the set time elapses (step 103), the LDU controller 131 turns off the upper first clutch 133 so as to stop the upper first to third transport rollers 107 to 109 which have finished the transport of sheet (step 104), and clears the upper intermediate section sheet sensor monitor (step 105).

When the time set in step 32 elapses, the LDU controller 131 temporarily turns off the upper first clutch 133 to stop the upper first to third transport rollers 107 to 109.

Next, when inputting a sheet in the upper reversing transport path 54, if another sheet exists in a forward position in the transporting direction, the LDU controller 131 sets the stop mode (step 35). At this time, if the shift mode is also to be set, the LDU controller 131 sets the shift mode (step 36), and turns on the upper first clutch 133 so as to rotate the upper first to third transport rollers 107 to 109 (step 37). Simultaneously, the LDU controller 131 sets the timer for a predetermined time taken by shifting the sheet (step 38). When the set time elapses (step 39), the LDU controller 131 turns off the upper first clutch 133 to stop the first to third transport rollers 107 to 109 (step 40).

Thereafter, if the stop mode continues (step 41), the LDU controller 131 is held in the standby state until when the sheet is to be forwarded, i.e., when the stop mode is to be cancelled. Then, when the sheet in the forward position is transported and the stop mode is cancelled, the operational step is forwarded to step 42. Whereas when the shift mode should not be set in step 36, i.e., when no sheet is further input to the upper reversing transport path 54, the LDU controller 131 waits the cancellation of the stop mode, and then proceeds to step 42.

On the other hand, when there is no sheet in a forward position in the transporting direction in step 35, i.e., when the stop mode is not set, or when the stop mode is cancelled in step 35 or 41, the LDU controller 131 turns on the upper first clutch 133 to rotate the upper first to third transport rollers 107 to 109, and turns on the upper second clutch 134 to rotate the upper fourth to fifth transport rollers 110 and 111 (step 42).

Figure 26:
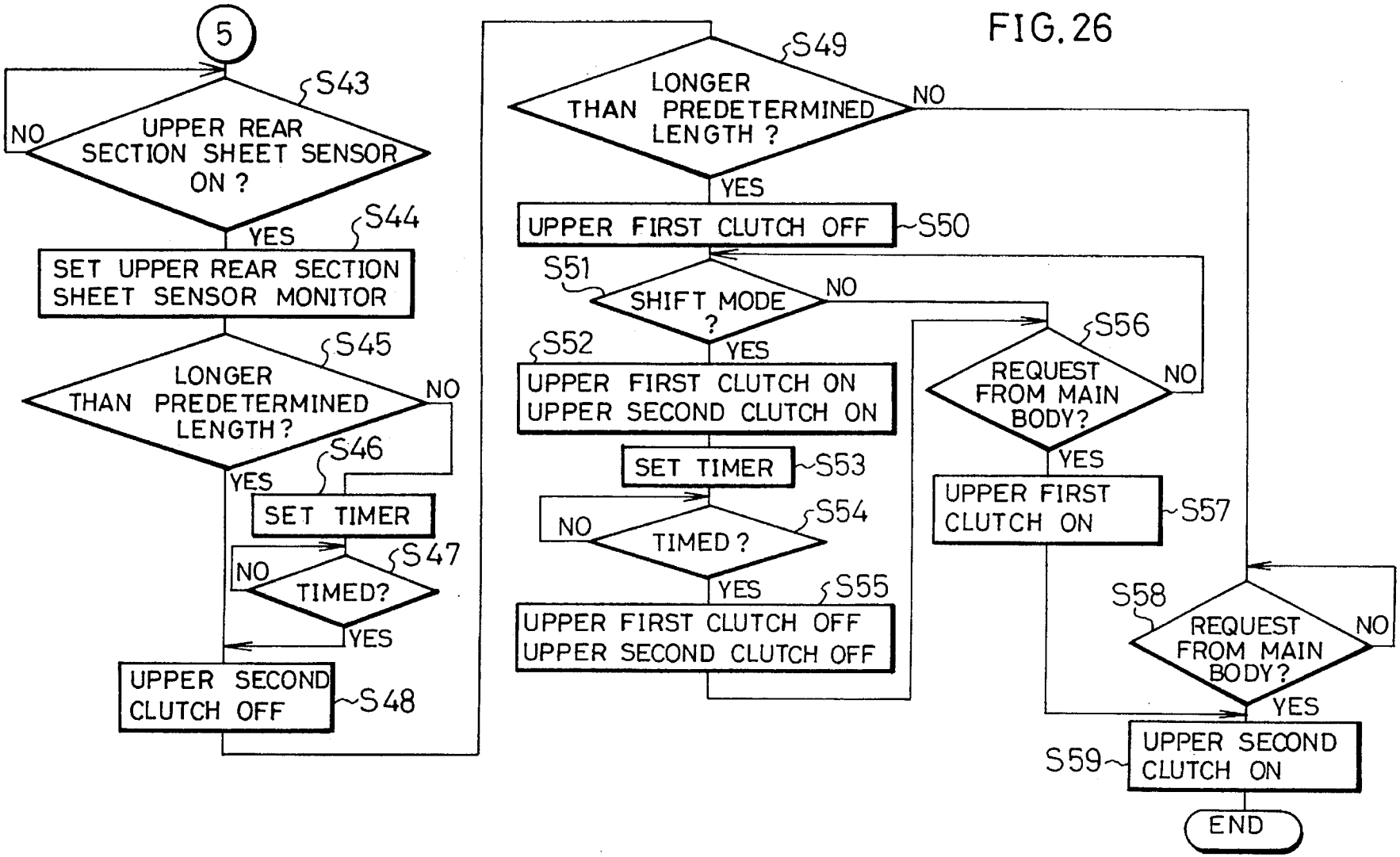
FIG. 26 is a flowchart showing the next operations of the LDU after the operations of FIG. 25.

Then, as illustrated in FIG. 26, when the leading edge of the sheet is detected by the upper rear section sheet sensor 124 (step 43), the LDU controller 131 sets the upper rear section sheet sensor monitor (step 44).

As illustrated in FIG. 29(*b*), like the control of the upper intermediate section sheet sensor monitor, when the upper rear section sheet sensor 124 is turned off (step 111), the LDU controller 131 sets the timer for a predetermined time (step 112). Then, when the set time elapses (step 113), the LDU controller 131 turns off the upper second clutch 134 to stop the upper fourth and fifth transport rollers 110 and 111 (step 114) which have completed the transport of sheet, and clears the upper rear section sheet sensor monitor (step 115).

Next, if the sheet is long, i.e., a dimension of the sheet in a transporting direction is longer than that of a laterally-fed A4-size sheet, the LDU controller 131 turns off the upper second clutch 134 to stop the upper fourth and fifth transport rollers 110 and 111 (step 48).

By contrast, if the sheet is short, i.e., a dimension of the sheet in a transporting direction is shorter than that of a laterally-fed A4-size sheet (step 45), the LDU controller 131 sets the timer for a predetermined time (step 46). When the set time elapses (step 47), the LDU controller 131 stops the upper second clutch 134 (step 48). This operation is performed to control the short sheet to be shifted in advance independently of whether the shift mode is set or not. As a result, the responsibility to a sheet output request from the main body controller 161 for controlling the laser printer section 12 is improved by a degree equivalent to the moving time corresponding to the amount of shift.

When the upper second clutch 134 is turned off, if the sheet is long (step 49), the LDU controller 131 turns off the upper first clutch 133 and stops the upper third transport rollers 109 (step 50) due to the following reason. When the sheet is long, the trailing edge thereof is nipped between the upper third transport rollers 109, and therefore the transporting operation of the transport rollers 109 is also stopped. As a result, the sheet is stopped over the rear section 103 and the intermediate section 102 of the upper reversing transport path 54.

When the shift mode is set (step 51), the LDU controller 131 turns on the upper first and second clutches 133 and 134 to rotate the upper first to fifth transport rollers 107 to 111 (step 52). Simultaneously, the LDU controller 131 sets the timer for a predetermined time (step 53). When the set time elapses (step 54), the LDU controller 131 turns off the upper first and second clutches 133 and 134 to stop the upper first to fifth transport rollers 107 to 111 (step 55).

Thereafter, if the main body controller 161 sends a request for output of sheet from the upper reversing transport path 54 (step 56), the LDU controller 131 turns on the upper first clutch 133 to rotate the upper third transport rollers 109 (step 57), and turns on the upper second clutch 134 to rotate the upper fourth and fifth transport rollers 110 and 111 (step 59). As a result, a long sheet located in the most forwarded position in the upper reversing transport path 54 is moved to the sheet output path 52, and supplied through the transport path 43 to the laser printer section 12. The upper first and second clutches 133 and 134 are then controlled to be turned off by the upper intermediate section sheet sensor monitor and the upper rear section sheet sensor monitor shown in FIGS. 29(*a*) and 29(*b*), respectively.

When the shift mode is not set in step 51, the LDU controller 131 waits the sheet output request from the main body controller 161 in step 56, and outputs the sheet in steps 57 and 59. On the other hand, if there is no sheet output request in step 56, the operational step returns to step 51. In this case, however, if the operations of steps 51 to 55 have been performed once, they are not repeated.

By contrast, when the sheet is short in step 49, the LDU controller 131 waits until a sheet output request is sent by the main body controller 161 (step 58). When the sheet output request is received, the LDU controller 131 turns on the upper second clutch 134 to rotate the upper fourth and fifth transport rollers 110 and 111 (step 59). As a result, a short sheet located in the most forwarded position in the upper reversing transport path 54 is supplied to the laser printer section 12.

Figure 27:
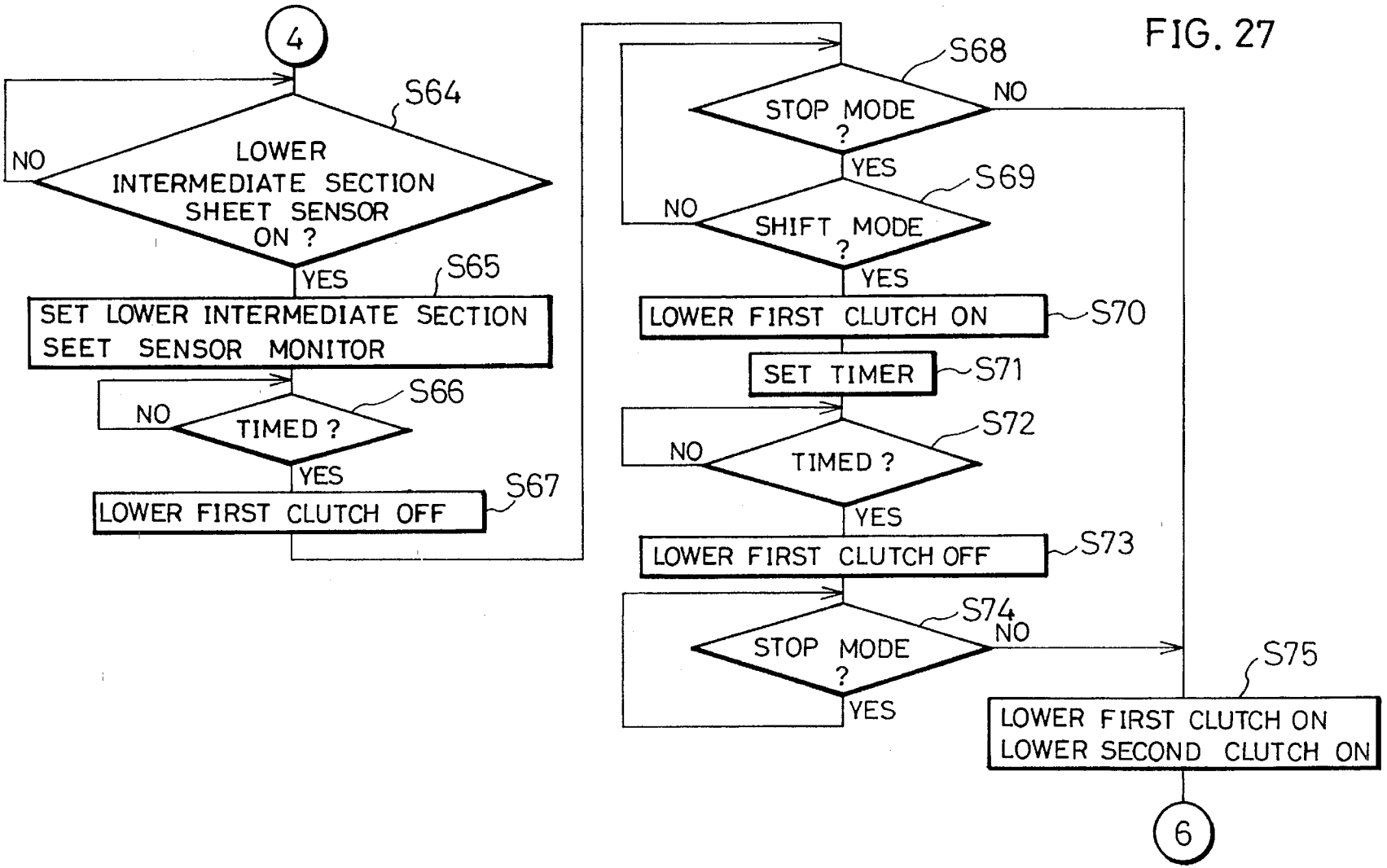
FIG. 27 is a flowchart showing the next operations of the LDU after the operations of FIG. 26.
Figure 28:
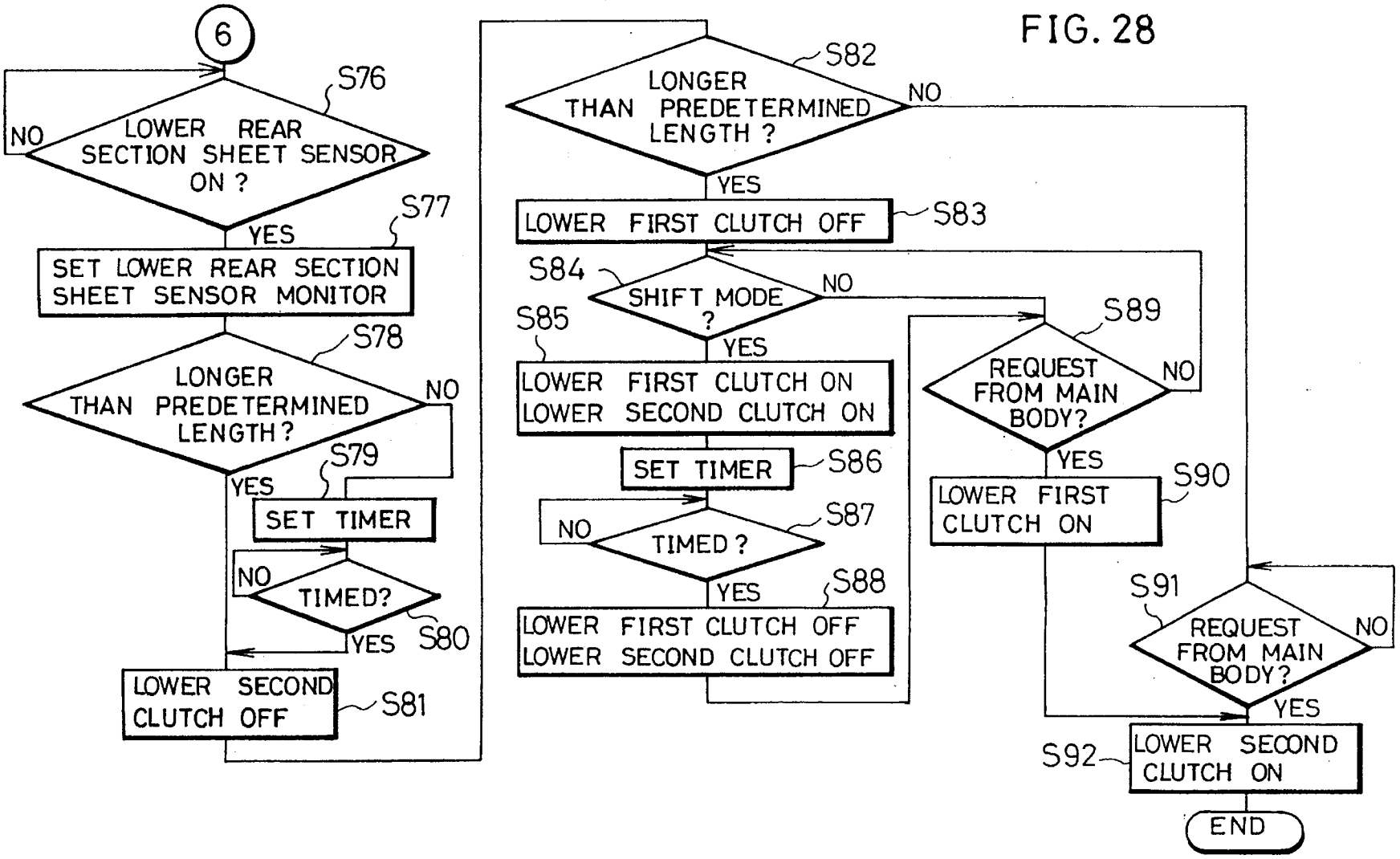
FIG. 28 is a flowchart showing the next operations of the LDU after the operations of FIG. 27.

Moreover, when the lower reversing transport path 55 is used in step 26, the operation of step 60 shown in FIG. 24 through the operations shown in FIG. 27 to the operation of step 92 of FIG. 28 are performed. These operations correspond to the above-mentioned operations in steps 27 to 59.

When the lower reversing transport path 55 is used in step 26, the lower separating solenoid 79*c* is turned on, and the lower separable roller 73 is separated from the reversible roller 71 (step 60).

In addition, if the stop mode is set (step 61) because there is another sheet in a forward position when transporting a sheet through the lower reversing transport path 55, the LDU controller 131 turns off the lower first clutch 135 so as to stop the lower first to third transport rollers 112 to 114, and clears the shift mode (step 62). In this case, it is possible to input a sheet to the sheet feed position 61 through the upper sheet passage 82 by the reversible roller 71 and the upper separable roller 72 pressed against the reversible roller 71.

On the other hand, if the stop mode is not set in step 61, the LDU controller 131 turns on the first clutch 135, and continues the transport of the sheet (step 63).

Then, as illustrated in FIG. 27, when the leading edge of the sheet is detected by the lower intermediate sheet sensor 125 (step 64), the LDU controller 131 sets the lower intermediate sheet sensor monitor and the timer for a predetermined time (step 65).

Figure 30A:
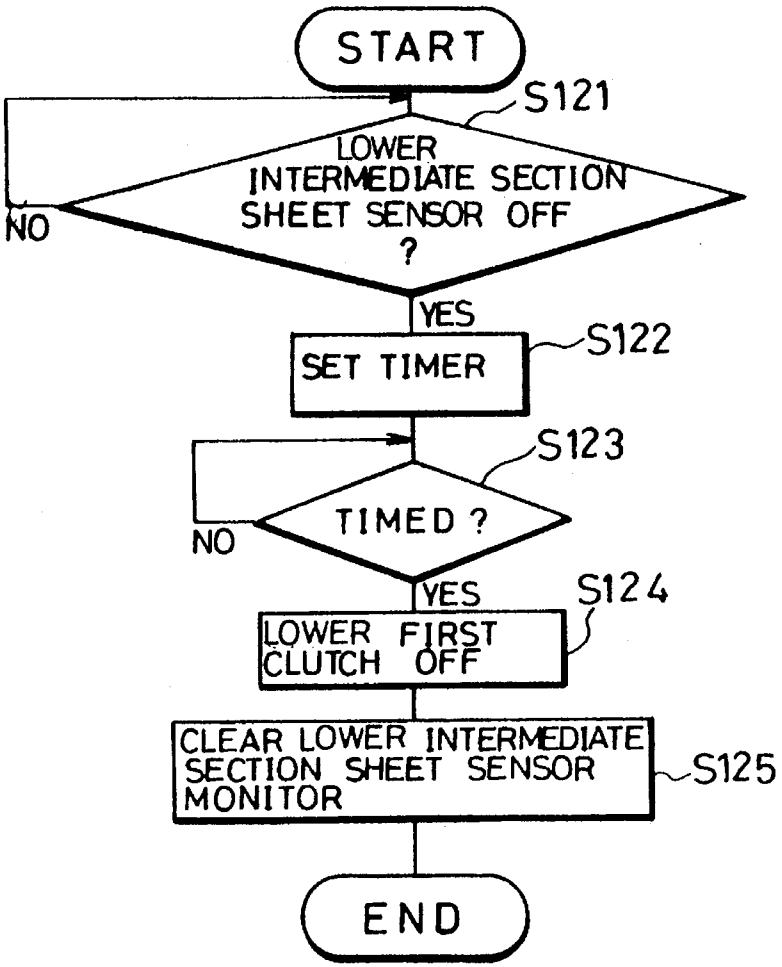
FIG. 30(*a*) is a flowchart explaining the operations of step 65 in FIG. 27, and FIG. 30(*b*) is a flowchart explaining the operations of step 77 in FIG. 28.
Figure 30B:
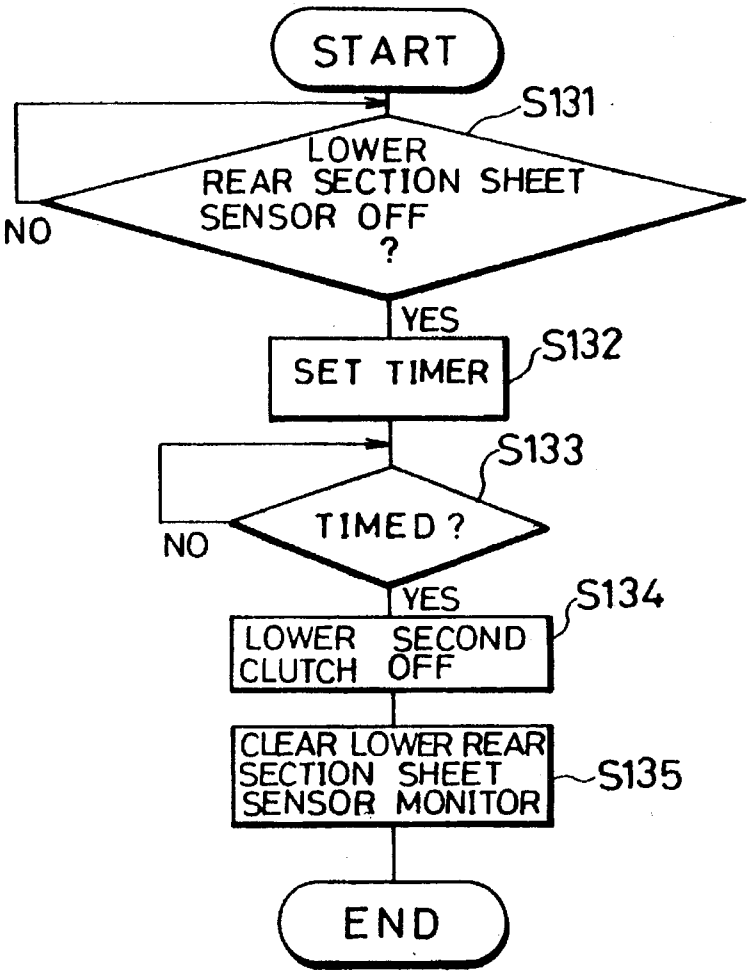

How the lower intermediate section sheet sensor monitor is controlled is explained by the flowchart of FIG. 30(*a*). When the lower intermediate sheet sensor 125 is turned off (step 121), the timer is set for a predetermined time (step 122). When the set time elapses (step 123), the lower first clutch 135 is turned off, and the lower first to third transport rollers 112 to 114 which have completed the sheet transporting operations are stopped (step 124). Then, the lower intermediate sheet sensor monitor is cleared (step 125).

When the time set in step 65 is measured, the LDU controller 131 temporarily turns off the lower first clutch 135 so as to stop the lower first to third transport rollers 112 to 114.

When inputting a sheet, if there is another sheet in a forward position in the sheet transporting direction of the lower reversing transport path 55, the LDU controller 131 sets the stop mode (step 68). At this time, if the shift mode is also to be set, the LDU controller 131 sets the shift mode (steps 69), and turns on the lower first clutch 135 so as to rotate the lower first to third transport rollers 112 to 114 (step 70). Simultaneously, the LDU controller 131 sets the timer for a predetermined time (step 71). When the set time elapses (step 72), the lower first clutch 135 is turned off, and the lower first to third transport rollers 112 to 114 are stopped (step 73).

Thereafter, if the stop mode continues (step 74), the LDU controller 131 waits until when the sheet is to be fed forward, i.e., when the stop mode is to be cancelled. When the stop mode is cancelled, the operational step proceeds to step 75. Whereas when the shift mode should not to be set in step 69, the LDU controller 131 also waits the cancellation of the stop mode and then proceeds to step 75.

On the other hand, when there is no another sheet in a forward position in the sheet transporting direction of the lower reversing transport path 55, i.e., when the stop mode is not set in step 68, or when the stop mode is cancelled in step 68 or 74, the LDU controller 131 turns on the lower first clutch 135 so as to rotate the lower first to third transport rollers 112 to 114 and turns on the lower second clutch 136 so as to rotate the lower fourth and fifth transport rollers 115 and 116 (step 75).

Then, as illustrated in FIG. 28, when the leading edge of the sheet is detected by the lower rear section sheet sensor 126 (step 76), the LDU controller 131 sets the lower rear section sheet sensor monitor (step 77).

As illustrated in FIG. 30(*b*), like the control of the lower intermediate section sheet sensor monitor, when the lower rear section sheet sensor 126 is turned off (step 131), the LDU controller 131 sets the timer for a predetermined time (step 132). Then, when the set time elapses (step 133), the LDU controller 131 turns off the lower second clutch 136 to stop the lower fourth and fifth transport rollers 115 and 116 (step 134) which have completed the transport of sheet, and clears the lower rear section sheet sensor monitor (step 135).

Next, if the sheet is long, i.e., a dimension of the sheet in a transporting direction is longer than that of a laterally-fed A4-size sheet, the LDU controller 131 turns off the lower second clutch 136 to stop the lower fourth and fifth transport rollers 115 and 116 (step 81).

By contrast, if the sheet is short, i.e., a dimension of the sheet in the transporting direction is shorter than that of a laterally-fed A4-size sheet (step 78), the LDU controller 131 sets the timer for a predetermined time (step 79). When the set time elapses (step 80), the LDU controller 131 turns off the lower second clutch 136 (step 81). This operation is performed due to the reason mentioned above for steps 46 and 47.

When the lower second clutch 136 is turned off, if the sheet is long (step 82), the LDU controller 131 turns off the lower first clutch 135 and stops the lower third transport rollers 114 (step 83). When the sheet is long, the trailing edge thereof is nipped between the lower third transport rollers 114, and therefore the transporting operation of the lower transport rollers 114 is also stopped. As a result, the sheet is stopped over the rear section 106 and the intermediate section 105 of the lower reversing transport path 55.

When the shift mode is set (step 84), the LDU controller 131 turns on the lower first and second clutches 135 and 136 to rotate the lower first to fifth transport rollers 112 to 116 (step 85). Simultaneously, the LDU controller 131 sets the timer for a predetermined time (step 86). When the set time elapses (step 87), the LDU controller 131 turns off the lower first and second clutches 135 and 136 to stop the lower first to fifth transport rollers 112 to 116 (step 88).

Thereafter, if the main body controller 161 sends a request for output of sheet from the lower reversing transport path 55 (step 89), the LDU controller 131 turns on the lower first clutch 135 to rotate the lower third transport rollers 114 (step 90), and turns on the lower second clutch 136 to rotate the lower fourth and fifth transport rollers 115 and 116 (step 92). As a result, a long sheet located in the most forwarded position in the lower reversing transport path 55 is moved to the sheet output path 52, and supplied through the transport path 43 to the laser printer section 12. The lower first and second clutches 135 and 136 are then controlled to be turned off by the lower intermediate section sheet sensor monitor and the lower rear section sheet sensor monitor shown in FIGS. 30(*a*) and 30(*b*), respectively.

When the shift mode is not set in step 84, the LDU controller 131 waits the sheet output request from the main body controller 161 in step 89, and outputs the sheet in steps 90 and 92. On the other hand, if there is no sheet output request in step 89, the operational step returns to step 84. In this case, however, if the operations of steps 84 to 88 have been performed once, they are not repeated.

By contrast, when the sheet is short in step 82, the LDU controller 131 waits until a sheet output request is sent by the main body controller 161 (step 81). When the sheet output request is received, the LDU controller 131 turns on the lower second clutch 136 to rotate the lower fourth and fifth transport rollers 115 and 116 (step 92). As a result, a short sheet located in the most forwarded position in the lower reversing transport path 55 is supplied to the laser printer section 12.

Referring now to FIGS. 35 to 38, the connection between the operation of the LDU 28 and the image forming operation in the laser printer section 12 is explained below. The processing in the main body of the digital copying machine 10 except the LDU 28 is controlled by the main body controller 161 in the main body. The controllers 131 and 161 exchange information so as to carry out linkage operations between the main body and the LDU 28.

If the dimension of a sheet in the transporting direction is not larger than that of a laterally-fed A4-size sheet, as illustrated in FIG. 35(*a*), the LDU 28 is capable of holding six sheets in total, three sheets in the upper reversing transport path 54 and three sheets in the lower reversing transport path 55 due to the above-mentioned operation for reversing the leading and trailing edges of sheet with respect to the transporting direction. If the dimension of a sheet in the transporting direction is larger than that of a laterally-fed A4-size sheet, for example, if the sheet is a longitudinally-fed B4-size sheet, as illustrated in FIG. 35(*b*), the LDU 28 is capable of holding four sheets in total, two sheets in the upper reversing transport path 54 and two sheets in the lower reversing transport path 55.

Here, for instance, one copy is produced from each of twelve A4-size one-side documents by double-side copying to A4-size sheets.

When carrying out copying, first, the twelve one-side documents are set in the RDF 16 shown in FIG. 1, and a copy start switch is turned on. Then, the scanner unit 17 successively reads the documents from the last page, and image data $M_1$ to $M_{12}$ of the twelve documents is stored in an image memory in the image processing section, not shown (steps 151 and 152).

Next, an A4-size sheet is laterally fed from one of the first to third cassettes 29 to 31 or the manual-feed tray 25 to the laser printer section 12. At this time, in order to specify the timing of supplying the sheet held in the LDU 28 to the laser printer section 12, a sheet feed timer is set (step 153). In the laser printer section 12, first, the image data $M_{12}$ of the last page of the documents, which is to be an image to be printed on the back side of the sheet when double-side copying is performed, is read out from the image memory (step 154), and an image formation is performed on the sheet based on the image data $M_{12}$ (step 155).

Figure 38:
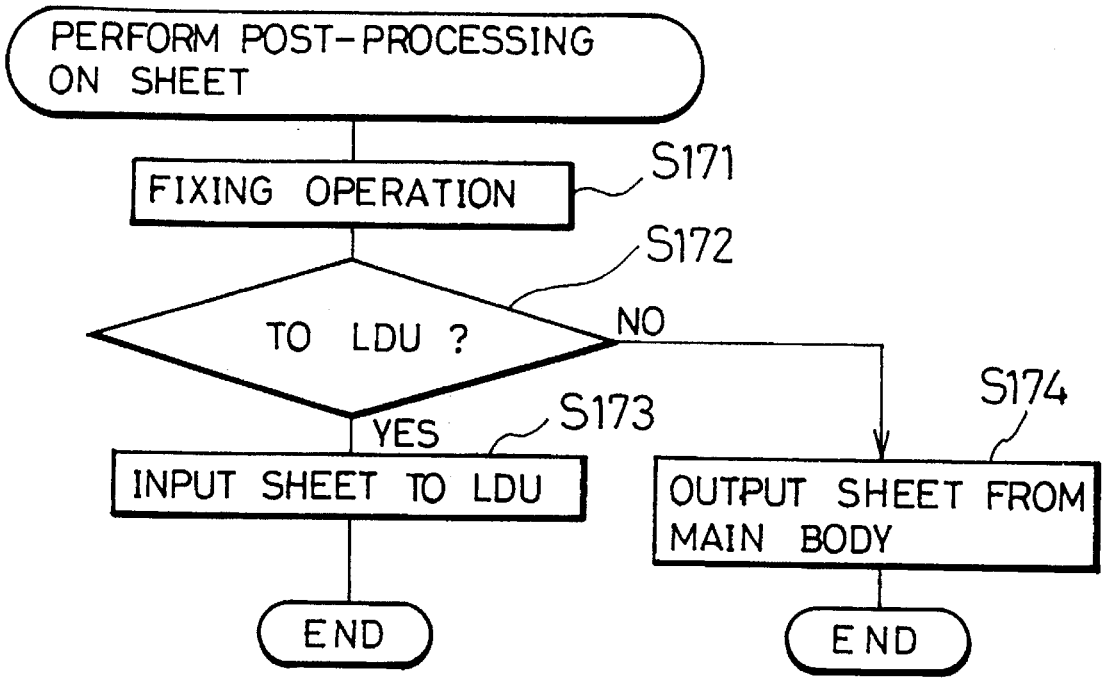
FIG. 38 is a flowchart showing the operations of step 156 in FIG. 36 and the operations of step 163 in FIG. 37.

Subsequently, post-processing is performed on the sheet (step 156). In the post-processing, as illustrated in FIG. 38, the above-mentioned fixing operation is performed on the sheet by the fixing device 32 (step 171). In the post-processing, when feeding the sheet again to the laser printer section 12 through the LDU 28 (step 172), the sheet is fed to the LDU 28 (step 173). In this case, the sheet is transported to the upper reversing transport path 54 or the lower reversing transport path 55 through the switching gate 36, the transport path 35, and the sheet input path 51 and the turnaround section 53 of the LDU 28. On the other hand, when the sheet is not to be input to the LDU 28 (step 172), the sheet is output from the digital copying machine 10 through the switching gate 36 and the sorter 14 (step 174).

When feeding the sheet to the LDU 28, the sheet is fed to a reversing transport path which is different from the reversing transport path which was used last in the previous double-side copying operation. In order to select transport paths in this manner, the previous processing data is stored in a memory in the LDU controller 131, and the LDU controller 131 controls the switching gate 91 based on the stored data.

Then, sheets are successively supplied to the laser printer section 12, and image forming operations based on the image data $M_{10}$, $M_8$, $M_6$, $M_4$, and $M_2$ which are to be images to be printed on the back sides of sheets are sequentially performed. When feeding a sheet to the LDU 28 in the post-processing, the sheet is fed to a reversing transport path which is different from the reversing transport path to which a sheet on which the image forming operation was performed is fed last time. Namely, sheets are alternately fed to the upper reversing transport path 54 and the lower reversing transport path 55.

As described above, if A4-size sheets are laterally fed, the number of sheets capable of being held in the LDU 28 is six. Therefore, when six sheets are input to the LDU 28 (step 157) or when the image forming operations based on image data which is to be images to be printed on the back sides of the sheets are performed on at most six sheets (step 158), feeding of sheets to the laser printer section 12, i.e., the image forming operations are paused.

In this state, it is possible to supply the reversed sheets to the laser printer section 12 through the upper reversing transport path 54, the lower reversing transport path 55, and the sheet output path 52. Then, when the time set by the LDU sheet feed timer in step 153 elapses (step 159), the feeding of sheets from the LDU 28 is started (step 160). At this time, sheets are sequentially supplied to the LDU 28 in the order in which the sheets were fed to the LDU 28. In the laser printer section 12, the image data $M_{11}$, $M_9$, $M_7$, $M_5$, $M_3$, and $M_1$ of images to be formed on the front sides of the sheets are sequentially read out from the memory (step 161), and the images are formed based on the data (step 162). After the above-mentioned post-processing (step 163), these sheets are output from the digital copying machine 10 through the sorter 14.

When all the sheets in the LDU 28 are fed out (step 164), whether the image forming operations of all the image data stored in the memory have been finished or not is judged (step 165). If finished, copying is completed. On the other hand, if the image forming operations have not been finished, the operations after step 152 are repeated.

As described above, when one copy is produced from each of twelve A4-size single-side documents by double-side copying to A4-size sheets, the image forming operations based on the image data $M_1$ to $M_{12}$ are performed in the order as follows.

$$M_{12}, M_{10}, M_8, M_6, M_4, M_2/M_{11}, M_9, M_7, M_5, M_3, M_1$$

$$\text{|}\rightarrow\text{sheets fed from cassettes}\rightarrow\text{|}\leftarrow\text{sheets fed from LDU}\rightarrow\text{|}$$

where images corresponding to the image data before/are formed on sheets supplied from any of the first to third cassettes 29 to 31 or the manual-feed tray 25, and images corresponding to the image data after/are formed on sheets supplied from the LDU 28.

The following are other examples (1) to (5) of the order of image forming operations determined on the basis of the number of documents and the number of copies to be produced. In these examples, T represents a time counted by the LDU sheet feed timer. More specifically, six sheets are fed as a unit from any of the first to third cassettes 29 to 31 or the manual-feed tray 25, and the LDU 28. Feeding from the LDU 28 is always started after the LDU sheet feed timer counts the set time even when the number of sheets to be supplied from any of the first to third cassettes 29 to 31 or the manual-feed tray 25 is less than six.

(1) When one copy is to be produced from each of two single-side documents, $$M_2 \text{-------} /M_1$$
$$|\leftarrow T \rightarrow|$$

(2) When three copies are to be produced from each of two single-side documents, $$M_2, M_2, M_2 \text{-------} /M_1, M_1, M_1$$
$$|\leftarrow T \rightarrow|$$

(3) When eight copies are to be produced from each of two single-side documents, $M_2, M_2, M_2, M_2, M_2, M_2/M_1, M_1, M_1, M_1, M_1, M_1 \ldots$ (one unit of processing)

$$\rightarrow M_2, M_2 \text{----------} /M_1, M_1$$
$$|\leftarrow T \rightarrow|$$

(4) When two copies are to be produced from each of ten single-side documents, $M_{10}, M_8, M_6, M_4, M_2, M_{10}/M_9, M_7, M_5, M_3, M_1, M_9 \ldots$ (one unit of processing)

$$\rightarrow M_8, M_6, M_4, M_2 \text{-------} /M_7, M_5, M_3, M_1$$
$$|\leftarrow T \rightarrow|$$

(5) When one copy is to be produced from each of fourteen single-side documents, $M_{14}, M_{12}, M_{10}, M_8, M_6, M_4/M_{13}, M_{11}, M_9, M_7, M_5, M_3 \ldots$ (one unit of processing)

$$\rightarrow M_2 \text{----------} /M_1$$
$$|\longleftarrow T \longrightarrow|$$

As described above, in the digital copying machine 10, since the LDU 28 includes a plurality of reversing transport paths, i.e., upper and lower reversing transport paths 54 and 55, it is possible to arrange the upper and lower reversing transport paths 54 and 55 to be straighter compared with a structure in which only one reversing transport path capable of holding the same number of sheets is provided. Namely, since the number of curved sections of the upper and lower reversing transport paths 54 and 55 are reduced, the structure of the LDU 28, i.e., the digital copying machine 10 is simplified, and the size thereof is reduced.

Moreover, in the digital copying machine 10, the upper and lower reversing transport paths 54 and 55 are formed above and below the turnaround section 53, respectively. It is therefore possible to prevent the concentration of the upper first to fifth transport rollers 107 to 111, the lower first to fifth transports rollers 112 to 116 and the driving mechanisms thereof in one location in the upper and lower reversing transport paths 54 and 55. Consequently, the space is effectively used, resulting in a simplified structure.

Furthermore, in the digital copying machine 10, when a sheet is transported to the sheet feed position 61 by the sheet input and output device 60, the reversible roller 71 is stopped while holding the trailing edge of the sheet with the upper separable roller 72 or the lower separable roller 73. Then, after the separable roller 72 or 73 is separated from the reversible roller 71, the position of sheet is adjusted by the adjusting device 59. Thereafter, the upper separable roller 72 or the lower separable roller 73 is pressed against the reversible roller 71. Therefore, in the structure where a sheet is input to and output from the sheet feed position 61 by the reversible roller 71 and the upper separable roller 72 or the lower separable roller 73, i.e., in a simplified structure in which no pickup roller is provided for outputting the sheet from the sheet feed position 61, the sheet is adjusted by the adjusting device 59 so as to prevent defective sheet feeding. This structure also prevents a displacement of the sheet after the adjustment.

In this embodiment, the adjusting plates 141 start to return to the standby positions after the upper separable roller 72 or the lower separable roller 73 is pressed against the reversible roller 71 for transporting the sheet from the sheet feed position 61. However, if the adjusting plates 141 start to return to the standby positions after the upper or lower separable roller 72 or 73 starts pressing the reversible roller 71 and before the next sheet is input to the sheet feed position 61, it is possible to prevent the sheet from being obliquely fed from the sheet feed position 61.

Additionally, since the LDU 28 is capable of simultaneously inputting the sheet from the sheet input path 51 to the turnaround section 53 and outputting the sheet from the turnaround section 53 to the upper or lower reversing transport path 54 or 55, an increased processing speed is achieved in feeding sheets while reversing the sheets. Since the input and output sheets are guided by a single switching gate 91, the structure of the LDU 28 is simplified.

When feeding a sheet from the sheet feed position 60 to the upper or lower reversing transport path 54 or 55, if another sheet exists in a front location in the upper or lower reversing transport path 54 or 55, the sheet to be fed is nipped between the upper first transport rollers 107 of the upper reversing transport path 54 or the lower first transport rollers 112 in the lower reversing transport path 55, and one of the upper and lower separable roller 72 and 73 which is feeding the sheet together with the reversible roller 71 is separated from the rotating reversible roller 71. Consequently, even when the transport of sheet from the sheet feed position 61 in the turnaround section 53 is to be stopped due to the existence of another sheet in a front location in the sheet revering transport path 54 or 55, the feeding of sheet to the sheet feed position 61 is continued by the rotating reversible roller 71 and one of the upper and lower separable rollers 72 and 73 which is not separated from the reversible roller 71. It is thus possible to increase the processing speed in feeding sheets while reversing the sheets.

In the LDU 28, every time a sheet is fed from the turnaround section 53, the sheet is guided to one of the upper and lower reversing transport paths 54 and 55 which was not used for the transport of the previous sheet. Namely, every time a sheet is fed from the turnaround section 53, the upper and lower reversing transport paths 54 and 55 are used alternately. It is therefore possible to prevent variations in the degree of wear of the respective transport rollers in the upper and lower reversing transport paths 54 and 55. As a result, sheets are transported in a uniform manner through the upper and lower sheet revering transport paths 54 and 55.

Furthermore, in the LDU 28, since the upper first to fifth transport rollers 107 to 111 in the upper reversing transport path 54 and the corresponding lower first to fifth transport rollers 112 to 116 in the lower reversing transport path 55 are arranged in the corresponding locations equally separated from the starting point of the upper and lower reversing transport paths 54 and 55, respectively. In addition, the upper intermediate section sheet sensor 123 and upper rear section sheet sensor 124 in the upper reversing transport path 54 and the corresponding lower intermediate section sheet sensor 125 and the lower rear section sheet sensor 126 in the lower reversing transport path 55 are also arranged in the corresponding locations equally separated from the starting point of the upper and lower reversing transport paths 54 and 55, respectively. With this arrangement, since the respective transport rollers in the upper and lower reversing transport paths 54 and 55 are controlled in a uniform manner, it is possible to easily control the upper and lower reversing transport paths 54 and 55 by the LDU controller 131.

Figure 39:
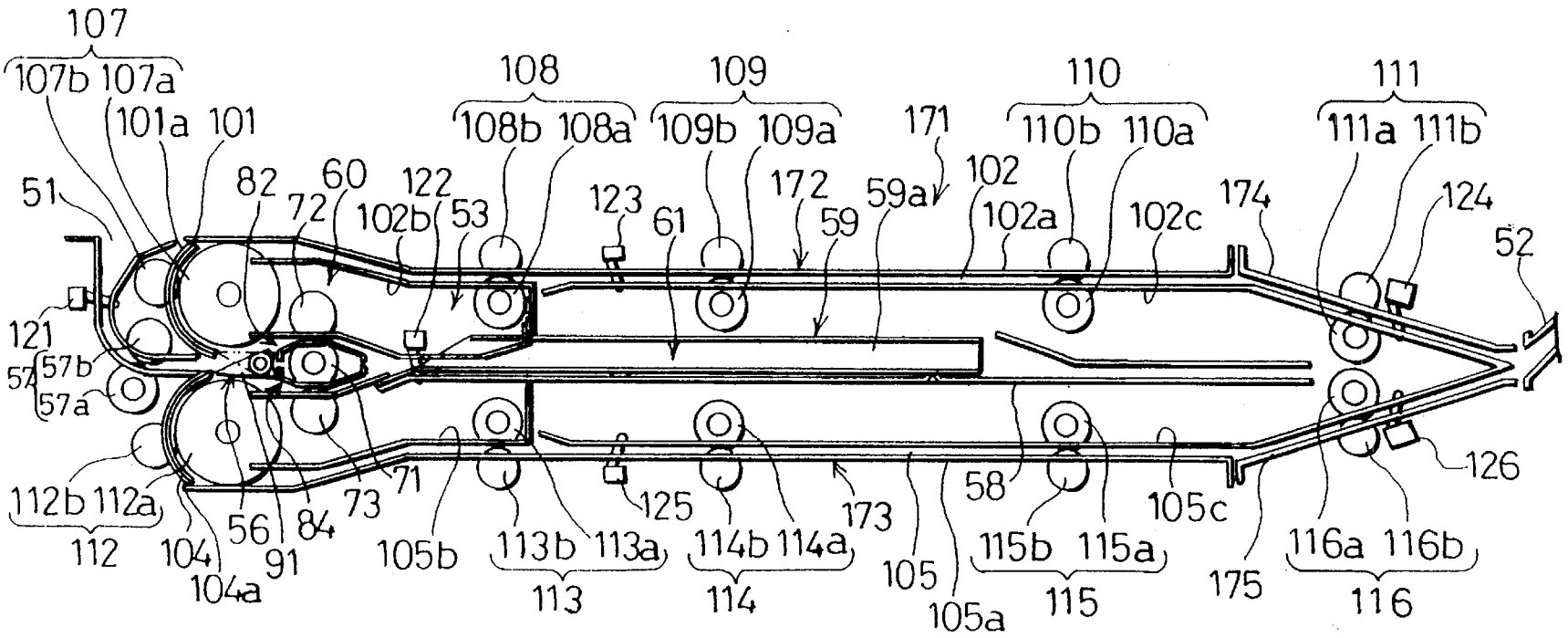
FIG. 39 is a front view illustrating another example of the LDU.

The digital copying machine 10 may include an LDU 171 shown in FIG. 39 instead of the LDU 28. In the LDU 171, an upper reversing transport path 172 and a lower reversing transport path 173 are formed so that rear transport sections 174 and 175 are symmetrically formed as well as the front transport sections 101 and 104, and the intermediate transport sections 102 and 105. In short, the upper and lower reversing transport paths 54 and 55 in LDU 28 are completely symmetrical. With this arrangement, it is possible to use common members for forming the upper and lower reversing transport paths 172 and 173, thereby reducing the cost.

In the upper and lower reversing transport paths 54 and 55 of the LDU 28, the driving rollers 108*a* to 110*a* of the upper second to fourth transport rollers 108 to 110 are disposed on the intermediate lower front section sheet guide 102*b* and the intermediate lower rear section sheet guide 102*c* as fixing members in the turnaround section 53. In addition, the driven rollers 108*b* and 110*b* are disposed on the intermediate upper section sheet guide 102*a* capable of being opened and closed. Similarly, the driving rollers 113*a* to 115*a* of the lower second to fourth transport rollers 113 to 115 are arranged on the intermediate upper front section sheet guide 105*b* and the intermediate upper rear section sheet guide 105*c* as fixing members in the turnaround section 53. The driven rollers 113*b* to 115*b* are arranged on the intermediate lower sheet guide 105*a* capable of being opened and closed. Consequently, in the configuration in which the upper and lower reversing transport paths 54 and 55 need to be opened for fixing a paper jam, the structure around the reversing transport paths 54 and 55 is simplified, and the paper jam is easily fixed.

More specifically, considering a general idea of protecting an image forming surface, it is necessary to dispose the driving rollers 108*a* to 110*a* and 113*a* to 115*a* on the lower members forming the upper and lower reversing transport paths 54 and 55 so that the driving rollers 108*a* to 110*a* and 113*a* to 115*a* do not make contract with the image forming surface. However, when such a structure is applied to the LDU 28, the driving rollers 113*a* to 115*a* are disposed on the intermediate lower sheet guide 105*a* capable of being opened and closed, thereby complicating the structure of the driving force transmitting mechanism to the driving rollers 113*a* to 115*a*. This arrangement also considerably increases the weight of the intermediate lower sheet guide 105*a*. As a result, it becomes difficult to open and close the intermediate section lower sheet guide 105*a*. Hence, in order to simplify the structure and ease the fixing of paper jam, the LDU 28 adopts the above-mentioned structure.

Furthermore, in the LDU 28, when inputting the last sheet among the number of sheets capable of being held in the upper and lower reversing transport paths 54 and 55, a sheet fed in advance and held in the upper or lower reversing transport path 54 or 55 is forwarded in the transporting direction by an amount necessary for holding the leading edge of the last sheet in a transportable condition, i.e., nipping the leading edge thereof between the upper first transport rollers 107 or the lower first transport rollers 112. Therefore, even if the length of the upper and lower transport paths 54 and 55 is shorter than a length capable of completely holding a predetermined number of sheets therein, the predetermined number of input sheets are held in a transportable condition. It is thus possible to reduce the size of the LDU 28.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A double-side image forming apparatus comprising:

an image forming section for forming an image on a sheet;

a turnaround section for reversing a leading edge and a trailing edge of a sheet with respect to a transporting direction after the sheet passes through said image forming section;

a plurality of reversing transport paths for transporting the sheet output from said turnaround section to said image forming section while turning over the sheet;

sheet guiding means for guiding the sheet output from said turnaround section to said reversing transport paths; and controlling means for controlling said image forming section, said turnaround section, said reversing transport paths, and said sheet guiding means so that an image is formed on one side of each of the sheets by said image forming section and that the sheets are sequentially held in said reversing transport paths and then supplied from said reversing transport paths to said image forming section for forming an image on the other side of each of the sheets.

2. The double-side image forming apparatus according to claim 1, wherein said plurality of reversing transport paths include one upper reversing transport path disposed above said turnaround section, and one lower reversing transport path formed below said turnaround section.

3. The double-side image forming apparatus according to claim 2, wherein said upper and lower reversing transport paths are symmetrically formed with respect to said turnaround section.

4. The double-side image forming apparatus according to claim 2, wherein said upper and lower reversing transport paths include a fixed member in said turnaround section, and a movable member for covering and uncovering said fixed member, said movable member being disposed to face said fixed member, and each of said upper and lower reversing transport paths comprises sheet transporting means including a pair of driving and driven rollers, said driving roller being disposed on said fixed member, said driven roller being disposed on said movable member.

5. The double-side image forming apparatus according to claim 1, wherein said sheet guiding means includes a guiding member for feeding sheets output from said turnaround section alternately to said reversing transport paths.

6. The double-side image forming apparatus according to claim 1, wherein said controlling means includes memory means for recording one of said reversing transport paths, to which a sheet previously output from said turnaround section is fed.

7. The double-side image forming apparatus according to claim 1, wherein each of said reversing transport paths has a uniform length, and includes sheet transporting means for transporting sheets along said reversing transport paths and sheet detecting means for detecting a position of a sheet, said sheet transporting means being disposed in corresponding locations equally separated from a starting point of said reversing transport paths, said sheet detecting means being disposed in corresponding locations equally separated from the starting point of said reversing transport paths.

8. The double-side image forming apparatus according to claim 1, wherein said turnaround section includes:

sheet input and output means comprising a reversible roller driven in forward and backward directions, and a separable roller capable of being pressed against and separated from said reversible roller, for inputting a sheet to a sheet feed position and outputting the sheet from said sheet feed position by said reversible roller and said separable roller pressed against said reversible roller; and adjusting means for adjusting the sheet in said sheet feed position to a position corresponding to a size of the sheet, and wherein said double-side image forming apparatus further comprises turnaround-section controlling means for controlling said adjusting means and said sheet input and output means so that, when a sheet is input to said sheet feed position by said sheet input and output means, said reversible roller is stopped rotating in a state in which the trailing edge of the sheet is nipped between said reversible roller and said separable roller, said separable roller is separated from said reversible roller, said adjusting means performs an adjusting operation, and then said separable roller is pressed against said reversible roller.

9. The double-side image forming apparatus according to claim 8, wherein said adjusting means comprises a pair of adjusting members for performing the adjusting operation including a pressing operation and a separating operation in directions orthogonal to sheet input and output directions with respect to the input sheet, and when the sheet is input, said pair of adjusting members are controlled by said turnaround-section controlling means so that said adjusting members are kept in standby positions in which said adjusting members are separated from each other by a distance slightly larger than a width of the sheet.

10. The double-side image forming apparatus according to claim 8, wherein said adjusting means comprises a pair of adjusting members for performing the adjusting operation including a pressing operation and a separating operation in directions orthogonal to sheet input and output directions with respect to the input sheet, and said pair of adjusting members are controlled by said turnaround-section controlling means so that said pair of adjusting members start returning to standby positions after the adjusting operation is performed and then said separable roller is pressed against said reversible roller.

11. The double-side image forming apparatus according to claim 8, wherein said adjusting means comprises a pair of adjusting members for performing the adjusting operation including a pressing operation and a separating operation in directions orthogonal to sheet input and output directions with respect to the input sheet, and said pair of adjusting members are controlled by said turnaround-section controlling means so that said pair of adjusting members start returning to standby positions after the adjusting operation is performed and the pressing of said separable roller against said reversible roller is started but before the next sheet is input to said sheet feed position.

12. The double-side image forming apparatus according to claim 8, wherein said adjusting means comprises a pair of adjusting members for performing the adjusting operation including a pressing operation and a separating operation in directions orthogonal to sheet input and output directions with respect to the input sheet, said double-side image forming apparatus further comprises:

a power switch of a main body;

a door attached to said main body, said door being freely opened and closed; and a door switch interconnected with said door, said door switch being turned on when said door is closed, and wherein said turnaround-section controlling means controls said pair of adjusting members to be moved to standby positions when said power switch is turned on and when said door switch is turned on.

13. The double-side image forming apparatus according to claim 1, wherein said turnaround section includes:

sheet input and output means comprising a reversible roller driven in forward and backward directions, and a separable roller capable of being pressed against and separated from said reversible roller, for inputting a sheet to a sheet feed position and outputting the sheet from said sheet feed position by said reversible roller and said separable roller pressed against said reversible roller; and adjusting means for adjusting the sheet in said sheet feed position to a position corresponding to a size of the sheet, and wherein said double-side image forming apparatus further comprises turnaround-section controlling means for controlling said adjusting means and said sheet input and output means so that, when a sheet is input to said sheet feed position by said sheet input and output means, said reversible roller is stopped rotating in a state in which the trailing edge of the sheet is nipped between said reversible roller and said separable roller, said separable roller is separated from said reversible roller, said adjusting means performs an adjusting operation and is stopped in an adjusted state, said separable roller is pressed against said reversible roller, an output of the sheet from the sheet feed position is started by said sheet input and output means, and said adjusting means resets the adjusted state.

14. The double-side image forming apparatus according to claim 13, wherein said adjusting means includes a pair of adjusting members for performing the adjusting operation including a pressing operation and a separating operation in directions orthogonal to sheet input and output directions with respect to the input sheet, and when the sheet is input, said pair of adjusting members are controlled by said turnaround-section controlling means so that said adjusting members are kept in standby positions in which said adjusting members are separated from each other by a distance slightly larger than a width of the sheet.

15. The double-side image forming apparatus according to claim 13, wherein said adjusting means comprises a pair of adjusting members for performing the adjusting operation including a pressing operation and a separating operation in directions orthogonal to sheet input and output directions with respect to the input sheet, and said pair of adjusting members are controlled by said turnaround-section controlling means so that said pair of adjusting means start returning to standby positions after the adjusting operation is performed and then said separable roller is pressed against said reversible roller.

16. The double-side image forming apparatus according to claim 13, wherein said adjusting means comprises a pair of adjusting members for performing the adjusting operation including a pressing operation and a separating operation in directions orthogonal to sheet input and output directions with respect to the input sheet, and said pair of adjusting members are controlled by said turnaround-section controlling means so that said pair of adjusting members start returning to standby positions after the adjusting operation is performed and the pressing of said separable roller against said reversible roller is started but before the next sheet is input to said sheet feed position.

17. The double-side image forming apparatus according to claim 13, wherein said adjusting means comprises a pair of adjusting members for performing the adjusting operation including a pressing operation and a separating operation in directions orthogonal to sheet input and output directions with respect to the input sheet, said double-side image forming apparatus further comprises:

a power switch of a main body;

a door attached to said main body, said door being freely opened and closed; and a door switch interconnected with said door, said door switch being turned on when said door is closed, and wherein said turnaround-section controlling means controls said pair of adjusting members to be moved to standby positions when said power switch is turned on and when said door switch is turned on.

18. A reverse sheet feeding device comprising:

a turnaround section including sheet input and output means, for reversing a leading edge and a trailing edge of a sheet with respect to a transporting direction, said input and output means comprising a reversible roller driven in forward and backward directions, and upper and lower auxiliary rollers disposed above and below said reversible roller, said input and output means inputting a sheet from a sheet input and output position located on one side of said reversible roller to a sheet feed position located on the other side of said reversible roller and outputting the sheet from said sheet feed position to said sheet input and output position by said reversible roller and either said upper and lower auxiliary rollers;

a pair of upper and lower reversing transport paths for holding a sheet output from said turnaround section and transporting the sheets while turning over the sheets, said reversing transport paths being formed so that a starting point thereof is located on the sheet input and output position in said turnaround section, said reversing transport paths are separated from each other at the starting point to run above and below said turnaround section;

a sheet input path for supplying the sheet to the sheet input and output position in said turnaround section, said sheet input path being formed so that an end point thereof is located at the starting point of said upper and lower reversing transport paths; and sheet guiding means disposed either between the starting point of said upper and lower reversing transport paths and the sheet input and output means or the end point of said sheet input path and the sheet input and output means, said sheet guiding means being switched between a first guide state in which the sheet is input from said sheet input path to a section between said upper auxiliary roller and said reversible roller and the sheet is output from a section between said lower auxiliary roller and said reversible roller to said lower reversing transport path and a second guide state in which the sheet is input from said sheet input path to the section between said lower auxiliary roller and said reversible roller and the sheet is output from the section between said upper auxiliary roller and said reversible roller to said upper reversing transport path.

19. The reverse sheet feeding device according to claim 18, wherein said sheet guiding means includes one guiding member disposed between said sheet input and output means and the starting point of said upper and lower reversing transport paths or the end point of said sheet input path, said guiding member being rotated on an end thereof near said reversible roller, and said sheet guiding means is switched to the first guide state when said guiding member is rotated toward said lower reversing transport path, and said sheet guiding means is switched to the second guide state when said guiding member is rotated toward said upper reversing transport path.

20. The reverse sheet feeding device according to claim 19, wherein said guiding member being alternately switched between the first and second guide states every time a sheet is output from said turnaround section.

21. The reverse sheet feeding device according to claim 18, wherein said upper and lower auxiliary rollers of said sheet input and output means are formed by separable rollers which are capable of being pressed against and separated from said reversible roller, and said reverse sheet feeding device further comprises:

transporting means, disposed in said upper and lower reversing transport paths, for holding and transporting a sheet; and controlling means for controlling said sheet input and output means so that, when feeding a sheet to said upper or lower reversing transport path by said sheet input and output means, if another sheet exists in a forward location in a sheet transporting direction in the reversing transport path, said separable roller which is outputting the sheet being nipped by said transporting means toward said reversing transport path together with said reversible roller is separated from said reversible roller.

22. The reverse sheet feeding device according to claim 18, wherein each of said reversing transport paths has a uniform length, and includes sheet transporting means for transporting a sheet along said reversing transport path and sheet detecting means for detecting a position of the sheet, said sheet transporting means being disposed in corresponding locations equally separated from the starting point of said reversing transport paths, said sheet detecting means being disposed in corresponding locations equally separated from the starting point of said reversing transport paths.

23. The reverse sheet feeding device according to claim 18, wherein said upper and lower reversing transport paths are symmetrically formed with respect to said turnaround section.

24. The reverse sheet feeding device according to claim 18, wherein said upper and lower reversing transport paths include a fixed member located in said turnaround section, and a movable member for covering and uncovering said fixed member, said movable member being disposed to face said fixed member, and each of said upper and lower reversing transport paths comprises sheet transporting means including a pair of driving and driven rollers, said driving roller being disposed on said fixed member, said driven roller being disposed on said movable member.

25. The reverse sheet feeding device according to claim 24, further comprising a pressing member, disposed on said movable member, for pressing said driven roller against said driving roller.

26. The reverse sheet feeding device according to claim 18, wherein said upper and lower auxiliary rollers of said sheet input and output means are formed by separable rollers capable of being pressed against and separated from said reversible roller, and said reverse sheet feeding device further comprises:

transporting means, disposed in said upper and lower reversing transport paths, for holding and transporting a sheet; and transport controlling means for controlling said transporting means so that, when inputting a last sheet among a number of sheets capable of being held in said upper and lower reversing transport paths, a sheet which is previously fed and held in said reversing transport path is moved forward in the transporting direction by at least an amount required by said transporting means to nip a leading edge of the last sheet.

* * * * *